US012575640B2

(12) United States Patent
Bruns et al.

(10) Patent No.: US 12,575,640 B2
(45) Date of Patent: Mar. 17, 2026

(54) SOLE COMPRISING A REINFORCING STRUCTURE, SHOE WITH SUCH A SOLE, AND METHOD FOR THE MANUFACTURE OF SUCH ITEMS

(71) Applicant: adidas AG, Herzogenaurach (DE)

(72) Inventors: Falk Bruns, Nuremberg (DE); Robbie Paterson, Nuremberg (DE); Daniel Ruiz, Erlangen (DE); Harry Miles, Nuremberg (DE); Valentin Perrin, Nuremberg (DE); Sam Forester, Nuremberg (DE); Jochen Bartl, Langensendelbach (DE); Tobias Biegel, Grosshabersdorf (DE)

(73) Assignee: adidas AG, Herzogenaurach (DE)

( * ) Notice: Subject to any disclaimer, the term of this patent is extended or adjusted under 35 U.S.C. 154(b) by 400 days.

(21) Appl. No.: 17/827,221

(22) Filed: May 27, 2022

(65) Prior Publication Data

US 2022/0378147 A1 Dec. 1, 2022

(30) Foreign Application Priority Data

May 31, 2021 (EP) ..... 21176874

(51) Int. Cl.
*A43B 13/14* (2006.01)

(52) U.S. Cl.
CPC ..... *A43B 13/141* (2013.01); *A43B 13/145* (2013.01)

(58) Field of Classification Search
CPC ... A43B 3/0073; A43B 13/127; A43B 13/125; A43B 7/1445; A43B 13/141; A43B 13/026
See application file for complete search history.

(56) References Cited

U.S. PATENT DOCUMENTS

| | | | |
|---|---|---|---|
| 1,848,518 | A | 3/1932 | Doran et al. |
| 2,129,424 | A | 9/1938 | Jay |
| 2,386,667 | A | 10/1945 | Doherty |
| 3,999,558 | A | 12/1976 | Barnwell et al. |
| 4,441,499 | A | 4/1984 | Comparetto et al. |
| 4,941,273 | A | 7/1990 | Gross |
| 5,025,573 | A | 6/1991 | Giese et al. |
| 5,311,680 | A | 5/1994 | Comparetto |

(Continued)

FOREIGN PATENT DOCUMENTS

| | | | |
|---|---|---|---|
| CN | 101212914 | A | 7/2008 |
| CN | 102869276 | A | 1/2013 |

(Continued)

OTHER PUBLICATIONS

European Search Report in Application No. EP 21176874.2, Dated Nov. 12, 2021, 7 pages.

*Primary Examiner* — Alissa L Hoey
*Assistant Examiner* — Akwokwo Olabisi Redhead
(74) *Attorney, Agent, or Firm* — Sterne, Kessler, Goldstein & Fox P.L.L.C.

(57) ABSTRACT

A sole for a shoe is provided comprising at least two reinforcing members extending at least in a front half of the sole, and at least two blade members extending at least in the front half of the sole. The reinforcing members define a first layer within the sole, and the blade members define a second layer in the sole, wherein the first layer and the second layer are at least partially displaced from one another in a vertical direction.

21 Claims, 37 Drawing Sheets

(56) References Cited

U.S. PATENT DOCUMENTS

| | | | | |
|---|---|---|---|---|
| 5,572,805 | A | 11/1996 | Giese et al. | |
| 5,647,145 | A | 7/1997 | Russell et al. | |
| 6,000,148 | A | 12/1999 | Cretinon | |
| 6,119,373 | A | 9/2000 | Gebhard et al. | |
| 6,502,330 | B1 | 1/2003 | David et al. | |
| 6,954,998 | B1 | 10/2005 | Lussier | |
| 6,968,637 | B1 | 11/2005 | Johnson | |
| 7,263,788 | B2 | 9/2007 | Johnson | |
| 7,401,422 | B1 | 7/2008 | Scholz et al. | |
| 8,117,770 | B2 | 2/2012 | Wong | |
| 8,505,220 | B2 | 8/2013 | James et al. | |
| 8,613,150 | B2 | 12/2013 | Wong | |
| 8,776,401 | B2 | 7/2014 | James et al. | |
| 9,044,064 | B2 | 6/2015 | Baucom et al. | |
| 9,241,535 | B2 | 1/2016 | Baudouin et al. | |
| 9,491,983 | B2 | 11/2016 | Rushbrook | |
| 9,603,416 | B1 | 3/2017 | Walsh et al. | |
| 10,470,518 | B1 | 11/2019 | Walsh et al. | |
| 2002/0050078 | A1 | 5/2002 | Dietrich et al. | |
| 2003/0168767 | A1 | 9/2003 | Kurihara et al. | |
| 2005/0034328 | A1 | 2/2005 | Geer | |
| 2005/0268489 | A1 | 12/2005 | Austin | |
| 2007/0266598 | A1 | 11/2007 | Pawlus et al. | |
| 2009/0000150 | A1 | 1/2009 | Wong | |
| 2009/0056165 | A1 | 3/2009 | Lee | |
| 2009/0056166 | A1 | 3/2009 | Edy et al. | |
| 2009/0183393 | A1 | 7/2009 | Lee | |
| 2010/0122472 | A1 | 5/2010 | Wilson, III et al. | |
| 2010/0199523 | A1 | 8/2010 | Mayden et al. | |
| 2010/0293816 | A1 | 11/2010 | Truelsen | |
| 2011/0214313 | A1 | 9/2011 | James et al. | |
| 2012/0180343 | A1* | 7/2012 | Auger | A43B 1/0009 12/146 B |
| 2013/0118035 | A1 | 5/2013 | Segato et al. | |
| 2014/0020264 | A1* | 1/2014 | Holt | A43B 13/04 12/146 B |
| 2014/0245640 | A1 | 9/2014 | Heard et al. | |
| 2014/0259747 | A1* | 9/2014 | Baudouin | A43B 13/181 36/28 |
| 2015/0366290 | A1 | 12/2015 | Chang | |
| 2016/0029746 | A1 | 2/2016 | Rushbrook | |
| 2016/0051009 | A1 | 2/2016 | Kormann et al. | |
| 2016/0278476 | A1 | 9/2016 | Stien | |
| 2017/0035143 | A1 | 2/2017 | Sato et al. | |
| 2017/0095034 | A1 | 4/2017 | Dupre et al. | |
| 2018/0213886 | A1 | 8/2018 | Connell et al. | |
| 2019/0159547 | A1 | 5/2019 | Nakatsuka | |
| 2019/0200699 | A1 | 7/2019 | Ghiotti | |
| 2019/0223553 | A1 | 7/2019 | Lussier et al. | |
| 2019/0320759 | A1 | 10/2019 | Conrad et al. | |
| 2019/0365030 | A1 | 12/2019 | Chambers et al. | |
| 2020/0113276 | A1* | 4/2020 | Boudreau | A43B 13/127 |
| 2020/0214384 | A1 | 7/2020 | Gruben et al. | |
| 2021/0259358 | A1 | 8/2021 | Paterson et al. | |
| 2022/0117355 | A1 | 4/2022 | Smith et al. | |

FOREIGN PATENT DOCUMENTS

| | | | |
|---|---|---|---|
| CN | 102665467 | B | 7/2015 |
| CN | 105831874 | B | 5/2018 |
| CN | 108783746 | A | 11/2018 |
| CN | 105380340 | B | 12/2018 |
| DE | 60027500 | T2 | 5/2007 |
| EP | 1842441 | B1 | 7/2011 |
| EP | 2 454 959 | A | 5/2012 |
| EP | 1906783 | B1 | 9/2012 |
| JP | 2002-172645 | A | 6/2002 |
| JP | 2015208504 | A | 11/2015 |
| JP | 2015533591 | A | 11/2015 |
| JP | 2018534028 | A | 11/2018 |
| WO | 03075698 | A1 | 9/2003 |
| WO | WO-2007010253 | A1 | 1/2007 |
| WO | WO-2015124523 | A1 | 8/2015 |
| WO | WO-2018017893 | A1 | 1/2018 |

* cited by examiner

SOLE COMPRISING A REINFORCING STRUCTURE, SHOE WITH SUCH A SOLE, AND METHOD FOR THE MANUFACTURE OF SUCH ITEMS

TECHNICAL FIELD

The present disclosure relates to a sole for a shoe, in particular for a running shoe. The present disclosure also relates to a shoe, in particular a running shoe, comprising such a sole. The present disclosure further relates to a method for the manufacture of such items.

BACKGROUND

A shoe sole typically serves a number of different functions, such as cushioning of the impact forces occurring upon foot strike and providing traction to avoid slipping of the wearer's foot. Another function a shoe sole typically serves is to provide a degree of stability to the wearer's foot, so that the danger of twisting one's ankle or other kinds of injuries, for example injury to the plantar fascia or muscle overloading, etc., are reduced. Still another function of a shoe sole, particularly for performance footwear like running shoes, is to facilitate a good transmission of forces from the athlete's legs through their feet to the ground and an efficient running style, in order to improve the athlete's performance.

To address the mentioned stability- and performance issues in running shoes, shank elements, torsion systems, stiffening plates, etc., have been considered. However, one weakness of these constructions is that they result in shoes with high rigidity and stiffness, leading to a running experience that is not very ergonomic. It has also been observed that footwear constructions known from the art do not cater to specific anatomical landmarks in the foot. Such constructions tend to artificially restrict and restrain the feet to a plane, allowing only a fixed degree of movement and an unnatural push-off while running. This may lead to straining or using the joints in the leg and the foot in a way that might cause discomfort or even injuries in the long run.

On the other hand, a stabilizing element with five stabilizing members that extend from a connecting member is known from U.S. Pat. No. 6,968,637 B1. However, this stabilizing element is located primarily in the midfoot region. This entails the problem of insufficient support in the toe-off area of the sole, for example, which is a factor when it comes to a dynamical and energy-efficient push-off of the foot during running.

US 2005/0268489 A1 describes a resilient shoe lift incorporating a series of lever rods stabilized by bars and integrally molded into the structure of a shoe sole.

EP 1 906 783 B1 describes a sole comprising at least three elongate elements oriented longitudinally within the horizontal plane of the sole and adapted to increase in rigidity in response to an increase in longitudinal tension of the sole.

U.S. Pat. No. 6,502,330 B1 describes a sole which includes a strengthener in the form of a closed loop which surrounds the zone on which the heel rests and is extended forward in the form of two branches extending along the two edges of the sole at least as far as the zone of the first and fifth metatarsal heads.

Based on this prior art, it is a problem of the present disclosure to provide a reinforcing structure for a sole for a shoe, in particular for a running shoe, that improves on and overcomes at least some of the drawbacks of the known constructions mentioned above. A particular goal of the present disclosure is to provide a reinforcing structure that allows to better take account of the physiology of a wearer's feet and that facilitates a natural and enjoyable running experience and helps to lower the risk of injuries. A further problem addressed by the present disclosure is to provide a method of manufacture for such a reinforcing structure and/or shoe sole.

SUMMARY OF THE DISCLOSURE

The above-outlined problems are addressed and are at least partly solved by the different (but combinable) aspects of the present disclosure.

According to a first aspect of the present disclosure, a sole for a shoe is provided.

The sole can, in particular, be used in a running shoe. However, the sole can also be used in different kinds of shoes, in particular other kinds of sports shoes, and its use is not limited to running shoes. For example, the sole can be used in shoes for track-and-fields, shoes for long jump, shoes for sprinting or short distance track races, shoes for hurdle races, shoes for mid- or long-distance track races, and so on.

In some embodiments, the sole comprises at least two reinforcing members extending in a front half of the sole, wherein the reinforcing members are adapted to be independently deflected by forces acting on the sole during a gait cycle.

It may be desirable to provide sufficient stiffness and cushioning around the toe area of the foot in order to reduce motion and fatigue, and also at the metatarsophalangeal joints (MTP joints) and the $1^{st}$ metatarsal bone in order to avoid stress overload. By extending in the front half of the sole, the reinforcing members may adequately support and stabilize the toes and toe joints, which are put under high loads during running, thereby helping to reduce overloading on key anatomical landmarks and muscle groups.

The reinforcing members may further help in reducing the eccentric work created during running, which in turn may help reduce the energy lost by an athlete, which may reduce the work done at the MTP-, knee-, ankle- and hip joints. Less work done means less fatigue and less overloading or overuse injuries to the wearer of such a shoe. The reinforcing members can also cater to the anatomy and physiology of the foot, unlike previously known rigid or unitary elements of the prior art.

In addition, when acting together, the reinforcing members can also provide a stabilizing platform for the foot to land on, giving the user a smooth running experience. The stability may be attained, for example, through a stiff, rod- or tube-like structure of the reinforcing members.

In summary, the reinforcing members according to the present disclosure take account of the human foot structure and its anatomy in order to provide biomechanical protection, motion and ease. In other words, the present disclosure derives its inspiration from the human foot itself: by complementing the natural shape and anatomy of the foot it improves the foot-to-ground interface, increasing the smoothness of rolling and lessening the impact forces, thus reducing overload on the structure of the foot and muscle groups. This can help the wearer to achieve a smoother and more natural running gait.

Further still, by having several reinforcing members and having the individual reinforcing members react and respond independently to the forces occurring during a gait cycle, their reinforcing function can be controlled and tailored to the specific needs of a runner in more detail than if a simple singular reinforcing element is used. The individual reinforcing members can cater to specific anatomical landmarks in the foot, such as each individual metatarsal structure. For example, the stiffness of each reinforcing member can cater to such anatomical landmarks. All in all, using individual reinforcing members, acting alone and/or in combination with each other, can allow to stabilize the sole and the shoe in a longitudinal direction, while at the same time also allowing a biomechanically preferred movement of the foot, ankle and surrounding sub-structures during the stance phase of the gait cycle when running.

Another benefit of using the disclosed reinforcing members, which may preferably be suspended in a midsole material such as a soft foam material, is that they may allow the foot to move from a lateral to a medial side and vice versa with more control. Since each reinforcing member element can move independently of the other, the foot will not move and twist as quickly, but a 'controlled freedom' is provided instead. The following analogy may be used to further elaborate on this effect: when playing a piano using the five fingers, each finger can hit one key without the other keys being pressed down, so moving from left to right can be done at a slower speed and with greater control over each key. On the other hand, if a single unitary structure were to be used, for example a flat bar or a plate, instead of five individual fingers, little control could be exercised over how many keys are be pressed, and in reality it would most likely be only possible to press the various keys all at the same time. Similarly, with the help of the individual reinforcing members of the present disclosure, each member can be individually activated from a lateral to a medial side during running to create a smooth and stable ride, whereas a unitary structure activates at once and thus could be less stable and provide less controllability.

Already at this position, it is emphasized that different geometries and cross-sectional shapes are possible for the reinforcing members. The cross-sectional shape may also vary along different section of a given reinforcing member and/or it may vary between different reinforcing members. Examples of possible cross-sectional shapes for the reinforcing members or sections of the reinforcing members include, but are not limited to, circular, elliptic, prismatic, trapezoid, quadratic, rectangular, and the reinforcing members may be rod-/tube-shaped or plate-like (or contain sections with such a shape), as will be discussed in more detail in the remainder of this document.

Each of the reinforcing members may comprise a non-linear section.

In this context, "non-linear" means not extending along a straight line. In other words, each of the reinforcing members can have a section that is curved or bent. Kinks or sharp bends, for example, are also possible but generally less preferred.

For reinforcing members that have, for example, a circular cross-section, it is evident how to determine whether they follow a straight line or not. However, for reinforcing members that have a different cross-section, for example plate-like reinforcing members as further discussed below, the term "flow-line of the reinforcing member" will be used in the following, to describe the general shape and geometry of the reinforcing member. The flow-line of a given reinforcing member can be considered as a line running through the 'center' of the reinforcing member (or through the center of each section of the reinforcing member, if the cross-sectional shape of the reinforcing member varies across different sections of the reinforcing member).

A more rigorous way, mathematically speaking, of defining the flow-line for a reinforcing member irrespective of its cross-sectional shape would be, for example, to divide the reinforcing member lengthwise into a plurality of slices of constant thickness (e.g., of thickness 1 mm, or 2 mm, or 5 mm, or so on, depending on the desired degree of accuracy), determine the center of mass for each slice and mark it with a point, piece the reinforcing member back together, and then connect all of the points thus determined. The resulting line can then be considered the flow-line of the reinforcing member. While the above-described process can, in principle, be 'physically' performed by actually cutting the reinforcing member into pieces, usually a computer simulation will be employed to do this 'virtually' and without having to destroy the reinforcing member. Suitable processes and devices (e.g., 3D-scanners) to this end are known to the skilled person and will not be further discussed here.

Irrespective of the cross section of the reinforcing members, then, the center line or flow-line of a non-linear reinforcing member does not follow a straight line.

However, a given reinforcing member may also comprise a linear (i.e., straight) section or sections in addition to the non-linear section or sections, or the entire reinforcing member may be non-linear. Linear and non-linear sections may also alternate. Moreover, combinations of reinforcing members with and without such straight sections are also possible within a sole. These statements remain applicable for the following discussion, where more specific shapes and geometries of the reinforcing members are discussed, even if not explicitly repeated again.

Using non-linear sections in the reinforcing members allows the reinforcing members, for example, to follow the general shape and anatomy of the foot and hence to provide adequate support, stability and guidance of the foot and the surrounding sub-structures, thus helping to preventing injuries, overloading of joints and fatigue, and to generally promote a good roll-off behavior of the sole.

For example, each of the reinforcing members may comprises a section having a concave shape in a side view of the sole (when the sole sits on a flat piece of ground or a table in a force-free state without being bent or twisted, and is looked at from the medial or later side).

A "concave shape" is understood in the context of the present disclosure as a shape akin to a bowl, or a saucer, or a ladle, i.e., a shape in which water would gather, and not be expelled.

Pictorially speaking, therefore, the reinforcing members may provide a 'bowl shape' or 'saucer shape' or 'ladle shape' in the front half of the foot, in which the toes and, in particular, the metatarsal bones and the metatarsophalangeal joints (MTP joints) can rest, thus avoiding pressure points, for example. Moreover, this geometry particularly promotes allowing the metatarsal and phalangeal bone structures to be guided in an anatomically efficient position through the stance phase, and for the moment arm between the ankle and the ground to be increased at toe-off. This geometry also reduces the braking forces attenuated at each MTP joint and can aid in injury prevention during the stance phase of the gait cycle during running.

To further promote these effects, the reinforcing members may curve in a smooth and continuous manner throughout the front half of the foot, e.g., their geometry (as, e.g., defined by their flow-lines) may follow at least approximately an arc of a circle (possibly with different arcs/circles for different reinforcing members). This may allow a very smooth roll-off or stride during running, from heel to toe, namely a rolling movement, because a circle is a very efficient shape for movement and hence provides a very efficient movement path, as it rolls effortlessly.

Each of the reinforcing members can have a shape comprising a localized low point relative to a horizontal plane, wherein each of said low points is located in the front half of the sole.

The term "horizontal plane" is used to designate a plane parallel to a flat piece of ground in the state when the sole sits on this flat piece of ground and is not bent or twisted, i.e. in a force-free state.

For example, considering again the flow-lines of the reinforcing members defined above, according to the option discussed here each of these flow-line passes through a localized low point in the front half of the sole. "Localized" means that the low point is not an extended region but an identifiable point. In other words, on both sides of the low point, the reinforcing members move upwardly.

Each of said low points can be located in a region between the midfoot area and the toe area of the sole. In some embodiments, each of said low points can be located in the region of the MTP joints.

Having the low points of the reinforcing members correspond to the low point of the bone structure and anatomy of the foot again helps to provide adequate support to the foot, and to create a stable structure to reduce overloading of the muscles and tendons during running.

In some embodiments, each of said low points can be located at a distance of at least 5 mm beneath a plane tangential to the upper side of the structure formed by the reinforcing members. In some embodiments, each of said low points may be located a distance at least 8 mm beneath a plane tangential to the upper side of the structure formed by the reinforcing members.

The distance from this (conceptual) plane describes the 'depth' of the 'saucer' formed by the reinforcing members in the front half of the foot. This depth can be chosen according to a number of factors, for example the general size of the sole (generally, the larger the sole, the larger the depth). However, since the present disclosure uses individual reinforcing members, the depth of each individual reinforcing member can also be chosen and adapted independently, which may allow for a particularly fine-tuned control of the properties of the sole. The mentioned minimal values may provide for a sufficient depth, to ensure a pleasant wearing sensation and to avoid fatigue, for example, and they may also allow the forefoot anatomy to 'settle' into the reinforcing structure provided by the reinforcing members. The depth of the low points can also be adjusted according to the intended activity for which the sole and shoe are provided. For example, for an activity where stability is desired, a larger depth may be chosen. The depth of the low points may further be adjusted to accommodate for a desired stack height of the midsole, e.g. if a thinner midsole is wanted then the depth of the low points can be chosen somewhat smaller.

The distance between the tangential plane and each of said low points can be the same or at least approximately the same, to provide a constant roll-off behavior across the entire width of the sole, which may improve stability during roll-off and push-off and help to avoid injuries and fatigue in the forefoot joints, for example.

However, the distance between the tangential plane and each of said low points can also depend on the position of the respective low point relative to a lateral or a medial edge of the sole.

In other words, the depth of each low point can vary across the sole from the medial side towards the lateral side.

In one example, the depth of the low points on the medial and lateral edges of the sole can be smaller than in the middle of the sole, so that the reinforcing structure provided by the reinforcing members not only has a curvature in a side view of the sole and in the longitudinal direction, but there is also curvature in the medial-to-lateral direction.

In another example, the depth of the low points gradually increases from the medial side towards the lateral side. Such a construction may be advantageous as it may allow a greater external hip rotation angle, which can increase gluteal muscle activation through the last point of ground contact. It may thus redistribute positive work contribution up from the lower extremities, to enhance running efficiency. Such a shaping may also guide the forefoot slightly more into eversion, which may improve the activation of the hallux and allow the center of pressure to have a more linear translation in the direction of motion, at toe-off.

To summarize, since it may be preferable that the low points align with the anatomical landmarks of the foot, e.g. the position of the MTP joints, as already mentioned above, and since these generally vary between person to person both in location and/or depth, the option of choosing the location and/or depth of each low point separately and independently provides for a large degree of customizability, which is very hard, if not impossible, to achieve using unitary stability structures as known from the art.

The section of each reinforcing member having the non-linear shape can extend at least from the midfoot area to the toe area of the sole.

The area from the toes to the midfoot may be a factor for toe-off or push-off of the foot, and it is therefore particularly supported by the reinforcing structure of the inventive sole. Avoiding straight lines, i.e. linear reinforcing members, in this area helps to promote a natural roll-off and push-off motion of the foot, while still providing stability and stiffness to allow less stress and fatigue on the lower extremities, and reducing the eccentric work done by an athlete.

The reinforcing members, or at least some of them, may also extend rearwardly beyond the midfoot area and into a heel area of the sole (s. also the discussion of the second aspect of the present disclosure farther below for more details on this possibility).

In the heel area, the reinforcing members may also be curved and non-linear, or they may be straight or at least straighter, since the rearfoot area usually does not undergo as much flexion as the midfoot- and toe area. Using approximately straight sections for the reinforcing members here can therefore be beneficial, to provide a high degree of stability during heel strike.

However, in some cases (e.g., depending on the intended field of use of the sole) it may also be preferred that the reinforcing members do not extend rearwardly beyond the projection of the calcaneus bone, to allow the heel to have more solid support as compared to the toes. In the heel area, there is mainly one bone in contact during the stance phase, namely the calcaneus, while during the transition to the forefoot area the bones generally act independently from each other. Therefore, while the individual reinforcing members supporting the midfoot and, in particular, the forefoot area are adapted to move independently from one another, they may make room in the heel area for a more solid support structure, e.g. the load distribution member discussed further below.

The reinforcing members can be plate-like members.

In this context, "plate-like" may mean having a vertical thickness which is small compared to the longitudinal and transvers extension of the member. Plate-like reinforcing members can be beneficial as they provide a large surface area on which the foot may rest, thus providing a good stability frame to the foot.

The reinforcing members can also be rod-shaped and/or tube-shaped members.

Rod-shaped or tube-shaped members are, for example, members having an (approximately) circular, elliptic, prismatic, trapezoid, quadratic, or rectangular cross-section, wherein the cross-section is small compared to the longitudinal extension of the members. Rod-shaped members may be considered as generally solid members (i.e. predominately made up of solid sections), while tube-shaped members may be considered as generally hollow members (i.e. predominately made up of hollow sections).

Hybrid shapes lying between rod-/tube-shaped and plate-like are also possible, and the cross-sectional shape may also change along a given reinforcing member (e.g., a given member may have a rod-/tube-shaped section or sections and a plate-like section or sections). Moreover, not all of the reinforcing members within a given sole must be of the same type and shape, but mixtures are also possible.

As already indicated above, the reinforcing members can comprise solid sections, and the reinforcing members can also comprise hollow sections. Again, this may change along a given reinforcing member, and not all of the reinforcing members within a given sole must be of the same construction in this regard.

Using hollow sections, in particular for circular or elliptic tube-shaped reinforcing members, may allow providing a particularly low-weight construction while still providing a degree of reinforcing (e.g., stiffening) of the sole.

Using solid sections, on the other hand, may, for example, allow to purposefully add weight to certain regions or sections of the sole, which may be used to balance out the sole and improve the sole's dynamic behavior during a gait cycle, when it undergoes multiple stages of accelerations into different directions.

The diameter of the reinforcing members can also vary between at least two of the reinforcing members and/or the diameter of at least one of the reinforcing members can vary along said reinforcing member.

In other words, the diameter is another parameter of the reinforcing members that can be changed and adapted to modify the dynamical behavior of the sole as wanted. Reinforcing members positioned at location that are subject to higher forces during toe-off (e.g., beneath the first and the third toe and the corresponding metatarsals) can for example have a larger diameter, to withstand such forces and provide high reinforcement specifically in these regions.

For circular cross-sections, the meaning of the diameter is clear. For other types of geometries for rod- or tube-shaped members, the diameter can for example be the smallest (or alternatively the largest) distance across the cross-section of such a member. For example, for an elliptic cross section, the diameter can be the length of the minor (or alternatively the major) axis of the ellipse. For plate-like reinforcing members, the vertical thickness can be taken as a measure of their diameter.

Moreover, if the diameters of the concerned members vary along their extension, the above statements about the diameters may e.g. apply to an average diameter obtained by averaging the respective member's diameter over its longitudinal extension, or to the diameter of the respective members at a certain position within the sole (e.g., defined by a certain sectional plane through the sole).

For reinforcing members containing tube-shaped sections, additionally or alternatively to changing or varying their diameter, their wall thickness may also be modified and adjusted, to influence their physical properties (e.g., their deformation- and stiffness properties and their weight).

In some embodiments of the present disclosure, there are five reinforcing members, each corresponding to a respective metatarsal bone. This may provide anatomical support during rolling from lateral to medial toe-off.

For example, the five reinforcing members can extend roughly beneath the metatarsal bones of the foot. However, they need not be precisely beneath these bones but can also be slightly shifted to one side or to different sides (at least some of them), for example to assist the center of mass of the sole being shifted over towards the big toe, for maximal push-off efficiency, or to provide more natural flow-lines that better follow the general anatomy of the foot.

In this case, the reinforcing members corresponding to the first and the third metatarsal bone can have a higher deflection stiffness than the three remaining reinforcing members.

This may, for example, be achieved by the reinforcing members corresponding to the first and the third metatarsal bone having a larger diameter and/or larger wall thickness (if provided tube-shaped) than the three remaining reinforcing members.

An increased stiffness for the first metatarsal is beneficial as this is typically the largest and strongest structure of the five metatarsals in the foot, which hence has to exert and withstand the highest forces during running. The third metatarsal in the center of the foot, on the other hand, sits naturally around the center of pressure during the stance phase of the gait cycle during running, and hence also benefits from increased support.

To further foster the beneficial support provided by the present disclosure, the reinforcing member underneath the first metatarsal can also be extended to the edge of the midsole unit to increase the distance between the ankle joint and the toe-off location, increasing the moment arm in the anterior-posterior axis (i.e. the longitudinal axis). The reinforcing member underneath the first metatarsal can furthermore have a flattened or tapered tip in the area underneath the big toe to promote this effect even further.

The reinforcing members can comprise carbon fibers, a carbon fiber composite material, and/or a glass fiber composite material. An example of a suitable carbon fiber composite material is for instance a polyamide material infused with carbon fibers and an example of a suitable glass fiber composite material is for instance a polyamide material infused with glass fibers.

These materials may be preferred, because they provide high stability and stiffness while having a comparatively low weight.

However, other kinds of material for the reinforcing members like metal, or wood, or injections molded plastic materials are also possible and covered by the present disclosure.

In addition, the material composition may vary between the different reinforcing members and/or along a given reinforcing members, which may also allow to impart different physical proprieties to different reinforcing members or different sections of a given reinforcing member.

The reinforcing members may be manufactured using a number of manufacturing methods. In some embodiments, such methods include, for example: molding (e.g. injection molding), additive manufacturing (e.g., 3D printing), or carbon extrusion.

More details on a manufacturing method according to an aspect of the present disclosure that allows for the manufacture of hollow, tube-shaped reinforcing members are given below.

At least two of the reinforcing members can further be connected by a connecting member.

This can help to provide some additional stability to the overall reinforcing structure provided by the reinforcing members, for example in the heel region where heel strike usually occurs. However, the connection provided by this connection member may be only supplemental in the sense that it does not impede, or at least not completely negate, the reinforcing members' ability to react and respond independently to the forces acting on them during a gait cycle, in particular not in the front half of the foot.

The connecting member may, for example, be arranged at or close to an end region of the reinforcing members. The connecting member may, for example, connect several or all of the reinforcing members close to their rearward end, to improve the stability in this area (which may be the midfoot- or heel area, for example, depending on the rearward extension of the reinforcing members.)

The connection may also be provided in the midfoot area, in particular in the area underneath the arch of the foot, because this is a very sensitive region of the foot that may need particular support, e.g. to prevent injuries or fatigue.

Another possibility is to have a connection between the two reinforcing members closest to the medial side of the sole (for example, the reinforcing members corresponding to the big toe and the second toe) and close to the front end of these two reinforcing members (e.g., in the area underneath the above-mentioned toes). By a suitable positioning and design of such a connection, some additional support for a stable push-off over these two toes can be provided, while the two connected reinforcing members may still be able to maintain a large degree of independency regarding their response to forces acting during the stages of the gait cycle preceding the actual push-off over the tips of the toes. In any case, by having only a pair of reinforcing members connected, the independency of motion of the remaining reinforcing members (if present) is not impaired.

The reinforcing members can extend substantially along the longitudinal direction of the sole.

Thus, the flow-lines of the reinforcing members can follow the natural flow-lines of the foot and the anatomy, and hence provide a particularly good support for reducing overloading on the lower extremities. Also, roll-off of the foot happens predominately along this direction, so that making the reinforcing members follow this direction also allows the natural roll-off movement to be taken into account by their shape and design.

The word "substantially" may be understood in this context as meaning that the deviation of the flow-lines of the reinforcing members from the longitudinal direction are small compared to the length of the reinforcing members. To give a specific example, for a reinforcing member that is 20 cm long, a deviation from the longitudinal direction (i.e., a 'lateral movement') of the flow-line of that member of up to 1 cm, or up to 2 cm or even up to 5 cm may still be considered to be a "substantially" longitudinal extension of the member.

The reinforcing members can be arranged next to each other in a medial-to-lateral direction.

This can help to provide a support frame on which the foot of the wearer can rest and is well supported, and may also be beneficial from a constructional point of view, as the thickness of the sole can be kept within an acceptable range, for example.

It also facilitates the option that the reinforcing members may be connected to a mesh-like material.

Such a mesh-like material can further increase the overall stability of the reinforcing structure provided by the reinforcing members, while still maintaining, at least to a large degree, their ability to deflect individually, i.e. to react and respond individually to the acting forces.

The reinforcing members may advantageously be further designed depending on and adapted to the need of the wearer, for example an athlete's running speed, running style and anatomy, as well as the distance of the run. Such customization may be related to changing the stiffness, length, material compositions, cross-sections, elasticity, plasticity, etc., of the individual reinforcing members as desired.

For example, by using a more plastic material for making the reinforcing members, it may be possible to customize their shape to the gait pattern of the runner, thereby adapting the structure of the midsole comprising the reinforcing members to the actual individual anatomical characteristics of the runner.

In another example, more elastic reinforcing members will retain their original shape and give a better energy return, facilitating the take-off phase in a smoother way, thereby reducing the load and stress at lower joints, specifically the MTP joints and the ankle joint.

The sole may furthermore comprise a load distribution member arranged in a back half of the sole. In some embodiments, the sole may comprise a load distribution member arranged in the heel area of the sole.

As the name says, such a load distribution member may serve to distribute the high forces occurring e.g. during heel strike to a larger area of the foot and sole, to spare the runner's joints and to also improve the stability of heel strike, to avoid injuries and ankle twisting. More specifically, the load distribution member can help to distribute the forces occurring during impact from the lower extremities into the shoe sole from the calcaneus bone, to prevent that all the forces are distributed directly underneath the origin of the plantar fascia, and to facilitate that the forces are distributed over the complete surface area of the calcaneus. To enhance this effect, the load distribution member can be slightly curved, rather than being completely flat, because this can allow the foot to sit in a more ergonomical manner on the load distribution member, and it may also allow medial/lateral forces to be absorbed by the load distribution member (due to its upward curvature) and from there being distributed into the midsole material.

The load distribution member may in particular comprise a load distribution plate, or be constructed as a load distribution plate, to provide a particular high degree of load distribution while keeping the weight down. The plate may be curved, for example upwardly curved at its edges, for the reasons already discussed immediately above.

For example, a load distribution member in the form of a heel plate may help to ensure the stability of the ankle joint at ground-reaction when the foot strikes during running, which in turn may help to reduce overloading at the ankle.

To save weight, the load distribution member may also comprise carbon fibers, a carbon fiber composite material and/or a glass fiber composite material. An example of a suitable carbon fiber composite material is for instance a polyamide material infused with carbon fibers and an example of a suitable glass fiber composite material is for instance a polyamide material infused with glass fibers. As already mentioned, these materials offer a particularly beneficial combination of high stability and stiffness and low weight.

The load distribution member may also extend further up the sole and into the midfoot area of the sole.

The load distribution member may hence also help to support the arch of the foot, which is a particularly sensitive region of the foot, and distribute the forces and pressure loads acting there, to avoid fatigue and injury and to facilitate a pleasant wearing sensation and good overall stability of the sole.

The reinforcing members and the load distribution member can also at least partially overlap.

In this context, the term "overlap" refers to a vertical projection or top view of the sole. If viewed from such a perspective, parts of the reinforcing members lie below or above the load distribution member. The term "overlap" does not imply that the reinforcing members and the load distribution member need to be in contact with one another or even be connected to each other, although this is generally also possible.

On the one hand, this overlap may provide a degree of interlock between the back half and the front half of the foot, again contributing to a high overall stability and the desired reinforcement to facilitate dynamic running movements. In other words, even though the reinforcing members and the load distribution member need not necessarily be physically connected, the overlap may have the effect that the load distribution member, once loaded, transfers the forces evenly to the reinforcing members (e.g., by way of the intermediate midsole material), helping to maintain adequate longitudinal support and also to create a high level of stability in the midfoot area, which is linked to reduce the risk of injury, for example caused by twisting of the feet. If an even stronger transmission of forces is desired, the reinforcing members and the load distribution member may also be physically connected, e.g. by one or more connectors or connecting wings or flaps.

On the other hand, the overlap may also help the foot transition from the heel plate in the heel region towards the reinforcing members in the forefoot region and may hence lead to a comfortable fit in the arch region.

In some cases (e.g., depending on the intended field of application of the sole or shoe), it may be preferred that the reinforcing members and the load distribution member are independent elements, even though a physical connection is in principle also possible, as already explained above.

While this may decrease the interlock mentioned above, it helps to maintain the independency of the individual reinforcing members to react and respond to the acting forces, which has already been discussed as one beneficial feature of the present disclosure above.

Alternatively or in addition to a load distribution member arranged in a back half of the sole, the sole may also comprise a forefoot support plate arranged in a front half of the foot. In some embodiments, the sole may comprise a forefoot support plate arranged in the toe area of the sole.

The forefoot support plate may be curved, for example upwardly curved at its edges.

It may comprise carbon fibers, a carbon fiber composite material and/or a glass fiber composite material. An example of a suitable carbon fiber composite material is for instance a polyamide material infused with carbon fibers and an example of a suitable glass fiber composite material is for instance a polyamide material infused with glass fibers. These materials offer a particularly beneficial combination of high stability and stiffness and low weight.

The forefoot support plate may also extend further up the sole and into the midfoot area of the sole, particularly into the arch region, and the reinforcing members and the forefoot support plate can also at least partially overlap.

The forefoot support plate can, in particular, be provided as a bottom plate, forming part of an outsole or ground contacting surface of the sole and being arranged underneath the reinforcing members, and it can e.g. provide sockets for cleats or spikes to be mounted on.

The forefoot support plate can be connected to one or more of the reinforcing members by means of one or more connectors or wings. For example, the two reinforcing members at the medial and lateral edge of the sole can be connected to the forefoot support plate, or four of five reinforcing members can be connected to the forefoot support plate.

Between the forefoot support plate and the reinforcing members, there can be a foam- or cushioning layer (or several such layers of different materials), as will now be discussed.

The reinforcing members can be at least partially embedded within a midsole of the sole. The midsole may further comprise a polymer foam material. The reinforcing members can also be completely embedded within the midsole.

Embedding (partly or entirely) the reinforcing members within a midsole, in particular a foam midsole, provides a number of benefits:

First, by embedding the reinforcing member, additional fastening means or constructions might be unnecessary and not even a bonding agent or glue may have to be used (although this is also possible within the scope of the disclosure), as the reinforcing members are simply held in position by the surrounding midsole material. This facilitates manufacture and makes the entire sole more environmentally friendly. The more the reinforcing members are surrounded by the midsole material, the better generally their fixation, i.e. if the reinforcing members are completely embedded within the midsole, their fixation by means of the midsole material is generally best.

Second, by at least partially embedding the reinforcing members within the midsole, they may be kept from direct contact both with the feet of the wearer and with the ground. The former may be unpleasant and uncomfortable, while the latter may decrease traction and cause slipping of the sole when treading, for example, on a root or a stone, due to the comparative rigidity of the reinforcing members. From this point of view, exposing some sections of the reinforcing members at the sidewalls of the sole, for example, may be acceptable, while exposing the reinforcing members at the top or bottom side of the sole may not be desirable. However, it is also possible to reveal the reinforcing members at least partly from the top or bottom side of the sole, if needed for aesthetic, technical or fitting reasons.

Using a foam material for the midsole helps to keep the weight of the sole down, while at the same time providing good cushioning and shock absorbing properties.

The midsole may comprise a particle foam. The midsole may, in particular, comprise a particle foam that comprises particles of one or more of the following materials: expanded thermoplastic polyurethane (eTPU), expanded polyamide (ePA), expanded polyether-block-amide (ePEBA), expanded thermoplastic polyester ether elastomer (eTPEE).

These materials are particularly suited for performance footwear like running shoes, as they have a comparatively low weight, a high life span, good temperature stability (i.e., they keep their cushioning and energy returning properties over a large temperature range) and high cushioning and energy return to the runner. Particularly regarding the option of using an ePEBA particle foam, a specific advantage of such a particle foam is that it allows to achieve similar performance level of other particle foams for a lower weight.

Alternatively or in addition the following materials can also be used, individually or in combination, for the particles of the particle foam midsole: expanded polylactide (ePLA), expanded polyethylene terephthalate (ePET), expanded polybutylene terephthalate (ePBT), and expanded thermoplastic olefin (eTPO).

The midsole may also comprise, alternatively or in addition to a particle foam material, a homogeneous foam material.

Examples of such materials are ethylene-vinyl-acetate (EVA), injection-molded thermoplastic polyurethane (TPU), thermoplastic polyester ether elastomer (TPEE), Polyamide, polyether-block-amide (PEBA) or other suitable materials. Such materials may be used because they are cheaper and/or easier to process in certain regards than particle foams. For example, with injection molding where a liquid material is injected into a molding cavity under high pressure, it may be easier to obtain an even distribution of the midsole material around the reinforcing members than using a particulate base material which might get stuck.

Once again, particle foams and homogeneous foam materials may also be combined in the midsole, and, in particular, different materials may be used in different places and/or layers in the midsole, to provide different properties to the respective regions/layers.

Alternatively or in addition to using a foam material for the midsole, other materials and manufacturing options may also be used, and what has been said above about embedding the reinforcing members within a foam midsole may also apply, as far as physically and technically feasible, to such other midsole options. For example, the midsole may comprise or be comprised of a lattice structure, for example an additively manufactured lattice structure (e.g., a structure made using a 3D printing method or a laser sintering method or a stereolithography method), which may be tailored both for long distance running shoes, where a high cushioning is preferred, and for sprint spikes or lower distance running shoes where the high cushioning is not a necessity, but high stiffness and anatomical guidance of the foot during ground contact is beneficial.

The midsole can comprise a lower midsole part and an upper midsole part, wherein the reinforcing members are positioned between the lower midsole part and the upper midsole part.

This can facilitate assembly of the sole, in that the upper and lower part can first be separately manufactured, and then the reinforcing members be arranged between the two. This may, for example, be relevant when particle foams are used, as it may not always be easy to achieve an even distribution of the particles around the reinforcing members during manufacture, in particular if the reinforcing members are 'dense' within the midsole and do not provide sufficient openings for the particles to pass through during mold loading. By individually manufacturing the upper and lower midsole part, such problems can be avoided. Such an approach can, however, also be beneficial if other material and/or manufacturing options for the midsole are used, for example the lattice structures mentioned above.

Moreover, using separate upper and lower parts can also be used to provide the different parts of the midsole with different physical- and performance properties. For example, the lower part can be made more wear resistant and stable, while the upper part can be specifically geared towards cushioning and shock absorption, to name just one possible example.

This construction with an upper and lower midsole part can also be used to further advantage in that the reinforcing members and the load distribution member can be separated by the upper midsole part (and analogously, if desired, for the forefoot support plate and, e.g., the lower midsole part).

For example, the upper midsole part can be generally arranged on top of the reinforcing members and the load distribution member can then be put on top or be partially or fully embedded in a top side of the upper midsole part. As mentioned above, in some embodiments, the reinforcing members and the load distribution member may be kept separate elements while still providing some degree of functional interlock, and by using the upper midsole part as an intermediate element both demands can be beneficially balanced against each other.

To repeat this once again, the load distribution member can be at least partially embedded within the upper midsole part.

However, it is once again emphasized that the functional interlock between the reinforcing members and the load distribution member/forefoot support plate can also be achieved in other ways, for example, the load distribution member/forefoot support plate may have portions extending into the spaces between and/or connecting to some or all of the reinforcing members.

Apart from the functional interlock with the reinforcing members mentioned above, embedding the load distribution member within the upper midsole part can also help to keep the load distribution member in place, and also to keep it from direct contact with the runner's foot or at least from sticking out of the sole (again, similar statements also apply to the forefoot support plate and the lower midsole part).

It is mentioned that in all of these constructions, however, the reinforcing members may retain their ability to be independently movable with respect to the other reinforcing members, thereby being able to 'adhere' to the anatomical and biomechanical characteristics of the feet of an individual wearer.

Alternatively or in addition to embedding the load distribution member (partly or fully) within the upper midsole part, the sole can also comprise a sock-liner.

The sock-liner can be arranged on top of the upper midsole part and at least partially cover the load distribution member, to achieve the benefits mentioned directly above, if this is not already done by embedding the load distribution member in the upper midsole part.

It is also emphasized that a sock-liner may also be used in an inventive sole which does not have a load distribution member. The sock-liner can also more generally serve the purpose of an upper midsole part, for example to reduce the manufacturing complexity connected to embedding the reinforcing members within the midsole. The reinforcing members can, for example, be placed in a lower midsole 'shell' and then the sock-liner is simply added on top to act as a 'lid', to cover and contain the reinforcing members inside the sole. Another benefit of using a sock-liner may be to allow for the thickness of the upper midsole part or midsole to be reduced, and to compensate for the loss of cushioning, a high sock-liner can then be included which has good cushioning properties (for example, a sock-liner using an eTPU particle foam). In other words, the sock-liner can provide a further degree of cushioning to the sole. Or it can provide a further degree of stability to the sole. Yet another option is that the sock-liner may simply be desirable in order to have replaceable elements in a pair of shoes, for example if the shoes get wet by rain or sweat, when the sock-liners can be replaced by a dry pair without having to change the entire pair of shoes. A sock-liner may further help to reduce the eccentric forces and muscle damage after a long usage, for example, after a long run.

The sole can further comprise an outsole.

This may help to increase traction and also provide improved wear resistance and hence a longer life-span for the sole and the shoe.

While the possible features, options and modifications pertaining to a sole according to the first aspect of the present disclosure have been described in a specific order above, it is emphasized that this is not done to express a certain dependency between the described features and options (unless stated otherwise). Rather, the different features and options can be combined among each other also in different orders and permutations—as far as physically and technically feasible—and such combinations of features or even sub-features are also covered by the present disclosure. Individual features or sub-features described above may be omitted, if they are not necessary to obtain the desired technical result.

To briefly summarize and further expand on the aspects, in some embodiments and options of the present disclosure discussed so far, the present disclosure provides, in particular, for a lightweight reinforcing structure with tube- or rod-shapes members that may help to eliminate supportive material in a shoe sole where it is maybe not necessary, and to open areas where a different effect on footwear bottom units or uppers may be desirable. By using different compounds for the hollow or solid, i.e. tube- or rod-shaped members, these members can be used depending on the deformation and reactiveness of the used material to enhance the propulsion or shock absorption of the sole.

The lightweight, hollow or solid, i.e. tube- or rod-shaped members can also be tuned in size and profile, and by changing the orientation of the profiles and the width of the members they are very adjustable for different needs in soles and shoes. They can be engineered as very stiff to very flexible by changing their geometries and using soft to hard materials, to create a system of applications. The visual of the reinforcing structure thus created also supports its meaning and it hence becomes unique and intuitively understandable for the customer. The disclosure helps, for instance, to look into torsion ability, heel impact, shock absorption, forefoot propulsion, guidance along the center of pressure, banking, heel-upper support, ankle/midfoot support and lock down, and it could become or provide for a new suspension/cushioning technology in different categories, like suspension stud technology for football or cleated shoes.

Adding additional flexible or elastic fibers/textiles/compounds to an inventive reinforcing structure with tube- or rod-shaped members also offers the possibility to create a 'trampoline effect' in a shoe, which may be employed to provide new kinds of midsole-upper constructions, e.g. once more flexible materials are used for the tube-/rod-shaped members.

A second aspect of the present disclosure also relates to a sole for a shoe.

Again, the sole can be used in a running shoe. However, the sole can also be used in different kinds of shoes, in particular other kinds of sports shoes, and its use is not limited to running shoes. For example, the sole can be used in shoes for track-and-fields, shoes for long jump, shoes for sprinting or short distance track races, shoes for hurdle races, shoes for mid- or long-distance track races, and so on.

Moreover, it is emphasized that all options, modifications and embodiments discussed herein in relation to the first aspect and/or the third aspect (s. below) of the present disclosure may also be used within the context of, and be combined with any and all embodiments of this second aspect of the disclosure (as far as technically and physically possible)—and vice versa—even if not explicitly discussed. For the reasons of conciseness, only a few selected such options and combinations are therefore mentioned and described in some more detail below, to provide a better understanding of the scope of the present disclosure and disclosure. With regard to the corresponding technical advantages, we refer to the statements above and farther below which also apply in the context of this second aspect of the disclosure.

In some embodiments, the sole according to this second aspect comprises at least two reinforcing members extending in a front half of the sole, wherein at least a first one of the reinforcing members (called "the first reinforcing member" in the following for definiteness) further extends rearwardly beyond the midfoot area and into a heel area of the sole and wraps up to a posterior portion of the ankle region.

In some embodiments, a second one of the reinforcing members (called "the second reinforcing member" in the following for definiteness) further extends rearwardly beyond the midfoot area and into the heel area of the sole and wraps up to the posterior portion of the ankle region.

This second aspect of the present disclosure provides for the possibility of providing a reinforcing structure with hollow and/or solid, i.e. tube- and/or rod-shaped reinforcing members, which may be manufactured from e.g. carbon fiber composite material or carbon infused polyamide material, and which can be located in the midsole of a shoe directly underneath the metatarsal bones, stretching back to the rearfoot and wrapping up to the posterior portion of the ankle-/calcaneus region, thus providing a homogeneous stiffness which can create an optimized ankle-lever in fast running.

One function of a reinforcing structure according to the second aspect of the present disclosure is to increase the longitudinal bending stiffness of the entire shoe and to allow a biomechanically preferred movement of the foot, ankle and surrounding sub-structures during the stance phase of the gate cycle when running. The reinforcing members may be of similar stiffness but non-equal geometry, with a tunable diameter/wall thickness, and they may be hollow or solid, or have such sections, as already mentioned. The reinforcing member underneath the first metatarsal may be extended to the edge of the midsole unit to increase the distance between the ankle joint and the toe-off location, increasing the moment arm in the anterior—posterior axis.

The reinforcing structure may further curve in a smooth and continuous manner, i.e. its geometry (as, e.g., defined by the flow-lines of the reinforcing members) may follow at least approximately an arc of a circle, from rearfoot to underneath the metatarsal heads, allowing for adequate support and guidance of the foot and the surrounding sub-structures. This geometry may also reduce the braking forces attenuated at the metatarsophalangeal joint and reduce the overall work done at this joint, during the stance phase of the gait cycle during running. Thus, such a geometry may allow the metatarsal- and phalangeal bone structures to be guided in an anatomically efficient position through the stance phase and also allow for the moment arm between the ankle and the ground to be increased at toe-off.

The improvements thus made by the present disclosure could also translate to improved longevity of the athletes, with a reduced recovery time and lower injury risk/rate.

Another advantage of the provided reinforcing structure is its reduced weight, and therefore weigh reduction of the entire product compared to older models. Another advantage is the simplicity of shoe construction and stock fitting to the midsole compared to known techniques and constructions. Another advantage is the possibility to provide a homogenous stiffness from the ankle/calcaneus region to the toe-off region, which was not as homogenous on known structures.

Also with this second aspect, the reinforcing members may be adapted to be independently deflected by forces acting on the sole during a gait cycle, in particular in the front half of the sole.

The first reinforcing member can in particular be a medial reinforcing member and the second reinforcing member a lateral reinforcing member.

The first reinforcing member and the second reinforcing member can be joined together, in particular behind the heel.

The first reinforcing member can further comprise a flattened tip extending into a region underneath the first metatarsophalangeal head/big toe.

The reinforcing members can be rod-shaped and/or tube-shaped members. They can consist of or comprise solid and/or hollow sections.

A diameter of the reinforcing members can vary between at least two of the reinforcing members and/or a diameter of at least one of the reinforcing members can vary along said reinforcing member.

Alternatively or in addition, in the case some or all of the reinforcing members comprise hollow sections, a wall thickness of the hollow sections can vary between at least two of the reinforcing members and/or along one or more of the reinforcing members.

There can, in particular, be five reinforcing members, each corresponding to a respective metatarsal bone. In some embodiments, the first reinforcing member corresponds to the first metatarsal bone/big toe.

The reinforcing members corresponding to the first and the third metatarsal bone can have a higher deflection stiffness than the three remaining reinforcing members. The reinforcing members corresponding to the first and the third metatarsal bone can have a larger diameter and/or larger wall thickness than the three remaining reinforcing members.

A third aspect of the present disclosure also relates to a sole for a shoe.

The sole can be used in a running shoe. However, the sole can also be used in different kinds of shoes, in particular other kinds of sports shoes, and its use is not limited to running shoes. For example, the sole can be used in shoes for track-and-fields, shoes for long jump, shoes for sprinting or short distance track races, shoes for hurdle races, shoes for mid- or long-distance track races, and so on.

Moreover, it is emphasized that all options, modifications and embodiments discussed herein in relation to the first aspect and/or the second aspect of the present disclosure may also be used within the context of, and be combined with any and all embodiments of this third aspect of the disclosure (as far as technically and physically possible)—and vice versa—even if not explicitly discussed. For the reasons of conciseness, only a few selected such options and combinations are therefore mentioned and described in some more detail below, to provide a better understanding of the scope of the present disclosure and disclosure. With regard to the corresponding technical advantages, we again refer to the statements above and farther below which also apply in the context of this third aspect of the disclosure.

In some embodiments, the sole according to this third aspect comprises at least two reinforcing members extending at least in a front half of the sole, and it further comprises at least two blade members also extending at least in the front half of the sole. The reinforcing members define a first layer within the sole and the blade members define a second layer in the sole, wherein the first layer and the second layer are at least partially displaced from one another in a vertical direction.

The at least two reinforcing members of this third aspect can be, for example, reinforcing members as discussed elsewhere in this disclosure, in particular reinforcing members as discussed in the context of the first aspect and/or the second aspect of the disclosure, with all corresponding options and possible features and properties, which are therefore referenced here for conciseness. The reinforcing members may, in particular, be adapted to be independently deflected by forces acting on the sole during a gait cycle, in particular in the front half of the sole.

The blade members are additional members that supplement the reinforcing members by defining a second layer at least partially vertically displaced from them (i.e., above or beneath them), to further improve the performance- and wearing/perception properties of the sole, in particular for a sole having a large stack height/thickness. The vertical direction can be understood, for example, to be the direction from the ground upwards, e.g., from the ground towards the foot of a wearer.

The terms "first layer" and "second layer" are used in this context predominately as conceptual means to describe the relative spatial arrangement of the reinforcing members in relation to the blade members. The terms neither imply that the respective members need to be physically connected to form a continuous layer of material within the sole (although this is also possible, for example, when the members are connected by a textile material or glued to a textile material), nor does it imply a certain size or extension of the layers (like an extension over the entire region of the sole, although this, too, is a possibility). On the other hand, imagining the reinforcing members were connected by a piece of textile material or glued to a piece of textile material with any excess around the outmost members being cut off, is one way to determine the location and extension of the first layer defined by the reinforcing members when there is no actual physical connection between them, and analogously for the second layer defined by the blade members.

In other words, the first layer can be understood as the (conceptual) surface spanned by the reinforcing members in much the same way as the canopy of an umbrella is spanned and supported by its foldable ribs, and analogously for the second layer and the blade members.

As mentioned, the blade members extend at least in the front half of the sole, but they can also extend into the back half of the sole, or they can even extend throughout the back half of the sole. Alternatively, or in addition, one or more of the blade members can also protrude past the big toe and out of the sole/shoe. Not all blade members need to have the same (longitudinal) extension, too, even though this is also an option. Moreover, all of these options may analogously apply to the reinforcing members.

All blade members can have the same dimensions (e.g., height, width, and/or length), or some of them may have the same dimensions while others not, or all of them may have different dimensions.

The same applies to a cross-section of the blade members: all blade members can have the same or a similar cross-section (e.g., oval), or some of them may have the same or a similar cross-section while others not, or all of them may have different cross-sections. Alternatively, or in addition, the cross-section may also change along a given blade member.

The blade members may be connected among each other, or some of them may be connected among each other while others are not connected to any other blade member, or all blade members may be individual members. Moreover, some or all of the blade members may also be connected to a respective reinforcing member or to several reinforcing members.

The number of blade members can be the same as, or different to, the number of reinforcing members. For example, there can be five reinforcing members (e.g., one associated with each metatarsal bone) but only three blade members.

Similar to the reinforcing members, when viewed from above (i.e., in a top view of the sole), the blade members can be arranged predominantly or even essentially along a longitudinal direction of the sole, i.e., they can generally extend in a direction from the proximal to the distal end of the sole. Other arrangements are also possible, however.

With respect to their projection on the sagittal plane (i.e., a plane cutting vertically and lengthwise through the center of the sole), the blade members can run parallel to each other, or at least some of them can be non-parallel or at least comprise sections that are non-parallel.

The blade members (or some of them) can also run predominantly or even essentially parallel to the reinforcing members (or some of them), e.g., in the sense that the first and second layer run parallel to each other, at least in certain regions of the sole. Or the blade members (or some of them) can be arranged non-parallel to the reinforcing members.

Generally, the curvature and/or geometry of the blade members can be the same or similar for all blade members, or some blade members have the same or a similar curvature and/or geometry while others have not, or all blade members can have different curvatures and/or geometries.

All blade members can have the same stiffness (e.g., bending stiffness and/or torsional stiffness), or some of them may have the same stiffness while others have not, or all of them may have different stiffnesses.

The blade members can, for example, comprise or be made of a reinforced polymer material, and the material composition of the blade members can be the same for all of them, or some of them may have the same material composition while others have a different material composition, or all blade members may differ in their material composition. Alternatively, or in addition, the material composition may also change within a given blade member.

To repeat and further elaborate on some of the options and features discussed so far, regarding the blade members alone, they can be provided with a number of different geometries like different shapes, sizes, lengths, thicknesses, cross-sections (e.g., with an oval or relatively flat cross section), curvatures, and in different numbers (at least two). In one example, they can be provided as longitudinal elements, unconnected to each other, but as already mentioned other cases are also possible.

Regarding the location of the blade members within the sole/shoe, they can generally extend from the midfoot to forefoot region, but they can also extend to the heel or protrude past the big toe out of the sole/shoe.

Regarding a material composition of the blade members, they can be made from or comprise carbon infused composites, carbon, polymer materials, in particular polyamide (PA), BZM8, BZM 30, BSR 30, glass fibers, and carbon fibers. It is also possible to cut them from a carbon plate instead of them being injection molded.

Regarding the combination of the blade members with the reinforcing members within the sole, they may be provided in an overlapping configuration, with a region or regions of overlap with the reinforcing members (e.g., in a top view of the sole). By changing the degree of overlap, it can be controlled and influenced how the two sets of members (i.e., the reinforcing members and the blade members) interact with each other to attain the benefits one is after.

Further concepts that may be realized by the different options and possibilities provided by the present third aspects of the disclosure include, for example, blade members provided as a segmented plate, frames of rods/blades at multiple levels/different planes, an open or closed leaf spring structure, a 'rod leaf spring', or a mini tramp spring.

Generally, it is possible to achieve a spring effect with a specific construction of the blade members to allow better energy storage and better energy return (compared to a simple foam midsole) during the landing/push-off phase.

For example, by using two separated or joined sets of stiffening elements, one being reinforcing members provided as rods and the other being blades (or also rods, etc.), can help to 'squeeze' and compress the foam material between the layers in a more effective way, recruiting more of the foam itself, storing more energy and therefore releasing more stored energy back to the runner, compared to just one layer of reinforcing members. Taking into account the angle and the surface area can help to make sure that the foam between and underneath the rods/blades is being used efficiently. Moreover, when the different layers/sets of members are connected, one generally expects some hysteresis of the material at the junction, which can be used to influence the kinetics and kinematics of the human running in these shoes, by influencing how distally the force application to the ground shifts away from the joint centers. Such a "springboard effect" could allow material characteristics and geometries to be tuned in order to generate force and application points to align with the athlete's body, such that when the compressed/deformed materials return to shape, the human can use the forces and synchronize this with their own movements to create enhanced movement patterns, similar to a person who jumps on a trampoline can recruit the help of the elastic return of energy and resulting velocity of the floor of the trampoline to propel themselves further in the air.

The third aspect of the disclosure thus provides for the possibility to incorporate blade-like structures in form of the at least two blade members into a sole which, for example, can run parallel to the reinforcing members and have a radius allowing a rolling motion and smooth transition during the latter stages of the stance phase. It further allows to incorporate into a sole blade members having different arrangements, different geometries, different stiffness levels, different material behavior properties, e.g., different mechanical and chemical compositions, and so on, to alter and control the properties of the sole in a number of different ways and directions. For example, by using different geometries, arrangements and/or materials for the blade members (and/or the reinforcing members), the kinetics and kinematics of running during the stance phase can be influenced, e.g. by manipulating the distance between the joint centers and the application of the runner's force to the ground.

To further elucidate the scope and concepts covered by this third aspect of the disclosure, some specific features and feature combinations will now be discussed in more detail.

The first layer can be at least partially arranged above the second layer.

In other words, looking from the ground up, the reinforcing members can be arranged above the blade members, at least partially. However, the reinforcing members (or some of them) and the blade members (or some of them) may also meet or merge into one another at certain positions or regions in the sole, meaning that their respective layers also meet or converge.

However, the first layer can also be fully distinct from the second layer.

In some embodiments, the reinforcing members can all be arranged above (or alternatively below) the blade members and be vertically separated from them by a certain distance across the entire sole. It should be kept in mind, however, that this does not exclude the possibility that the blade members (or some of them) and the reinforcing members (or some of them) are connected by additional connecting members.

Also, in either case (i.e., a partial or full vertical displacement of the reinforcing members relative to the blade members), the room or gap between the two sets of members may be filled with a (particle or homogeneous) foam material or a spring element, for example.

Also, by changing and adjusting the vertical distance between the two sets of members, the interaction and interplay between the two sets of members can be altered and controlled to help obtain, for example, the desired stability and elasticity of the sole.

The first layer and the second layer can at least partially overlap in a vertical projection of the sole.

Also this context and as already discussed above, the term "overlap" refers to a vertical projection or top view of the sole, for example in a state in which the sole lies on a flat piece of ground without being subjected to any forces or deformations. If viewed from such a perspective, parts of the reinforcing members can lie below or above the blade members and "cast a shadow" on them. The term "overlap" does therefore not imply that the reinforcing members and the blade members need to be in physical contact with one another or be connected to each other, although this is generally also possible.

By changing and adjusting the degree of overlap, the interaction and interplay between the two sets of members can again be altered and controlled to help obtain, for example, the desired stability and elasticity of the sole.

For example, the reinforcing members may overlap the blade members in a staggered manner, i.e. slightly offset in a top view of the sole. This could help, for example, stabilize the spaces between the reinforcing members by means of the blade members, to further improve the overall stability of the sole.

The first layer and the second layer can further comprise sections with corresponding curvature.

What this can mean, pictorially speaking, is that the two layers defined or spanned by the reinforcing- and blade members, respectively, can fit together like two shells of an onion. This can help to provide a particular smooth roll-off behavior of the sole while still providing for the above-described foam-squeezing-effect or springboard effect, in particular for a sole with a larger stack height/thickness.

The reinforcing members can, in particular, be rod-shaped and/or tube-shaped members, as already discussed farther above, to which discussion reference is therefore made with regard to further details and advantages of this specific option.

There can, in particular, be five reinforcing members in the sole, each corresponding to a respective metatarsal bone. Also this specific case has already been discussed farther above, to which discussion reference is therefore again made.

The blade members can comprise an oval cross-section.

Such a cross-section can be beneficial as it does not overly add to the stack height/thickness of the sole while still allowing the blade members to provide, for example, a "leaf spring function" to the sole, increase the springiness and energy return of the sole.

A diameter of the reinforcing members and/or blade members can vary between at least two of the reinforcing members and/or blade members.

Alternatively or in addition, a diameter of at least one of the reinforcing members and/or at least one of the blade members can vary along said reinforcing member or blade member.

Changing the diameter can be a simple yet effective way to change or influence, e.g., the stiffness and elasticity of the respective member, which can then translate to corresponding changes in the properties of the sole in the respective regions.

As already mentioned a number of times, there can be a connection between at least one blade member and one reinforcing member. In some embodiments, each blade member may be connected to at least one reinforcing member.

Alternatively or in addition, at least some of the blade members can also be connected among each other. For example, the blade members can be provided as a segmented plate.

Such additional connections can increase the overall rigidity and stability of the sole, but it can also help to improve the interplay between the two sets of members and/or between the blade members themselves, to increase the springiness of the sole and its energy return, for example.

As already mentioned above, a (particle and/or homogeneous) foam material, and/or a spring member can be arranged in a gap defined between the first layer and the second layer. In some embodiments, the gap can be filled with the foam material, which can lead to the above-described "foam-squeezing-effect", and hence a better perception and performance of the sole, for example, with regard to its elastic properties.

The blade members can comprise a reinforced polymer material, in particular a glass fiber reinforced-, or a carbon fiber reinforced-, or a carbon infused-polymer material.

Such materials are well suited as they are light-weight yet very stable and can be easily processed to the shapes required by the presently discussed third aspect of the disclosure.

A fourth aspect of the present disclosure is provided by a shoe, in particular a running shoe, comprising a sole according to some of the options and embodiments of the first and/or second and/or third aspect described above or described further below in the present document. As already mentioned in the beginning, though, an inventive sole may also be used in different kinds of shoes, in particular other kinds of sports shoes, for example in shoes for track-and-fields, shoes for long jump, shoes for sprinting or short distance track races, shoes for hurdle races, or shoes for mid- or long-distance track races.

A fifth aspect of the present disclosure is provided by a method for the manufacture of a reinforcing structure or part of a reinforcing structure for a shoe sole with at least one reinforcing member with a hollow section.

In some embodiments, the method comprises the steps of (a.) injecting a liquid molding material into a molding cavity of a mold, the molding cavity having a shape corresponding to the outer dimensions of the reinforcing member with the hollow section, and (b.) injecting a displacement gas into the molding cavity under pressure, wherein (c.)

during steps (a.) and (b.) an exit path connecting the molding cavity to an outlet well is closed. The method further comprises step (d.) of opening the exit path to release the pressurized displacement gas and remove the liquid molding material from the center of the molding cavity to form the hollow section.

The method can be used in the manufacture of a sole according to any option or embodiment of the first and/or second and/or third aspect of the present disclosure, and of a shoe according to some embodiments of the fourth aspect of the present disclosure.

BRIEF DESCRIPTION OF THE DRAWINGS

Possible embodiments of the present disclosure are described in more detail below with reference to the following figures.

DETAILED DESCRIPTION

In some embodiments of the different aspects of the present disclosure are described below, predominately with respect to running shoes. It is, however, emphasized once again that the different aspects of the present disclosure may also be practiced in different kinds of shoes and are not limited to the specific embodiments set forth below.

Reference is further made to the fact that in the following only individual embodiments of the disclosure can be described in more detail. The skilled person will understand, however, that the features and possible modifications described with reference to these specific embodiments may also be further modified and/or combined with one another in a different manner or in different sub-combinations, without departing from the scope of the present disclosure. Individual features or sub-features may also be omitted, if they are dispensable to obtain the desired result. In order to avoid redundancies, reference is therefore made to the explanations in the preceding sections, which also apply to the following detailed description.

FIGS. 1*a-f* show a sole 100, or parts thereof, according some embodiments, of the present disclosure, from different view angles.

Figure 1A:
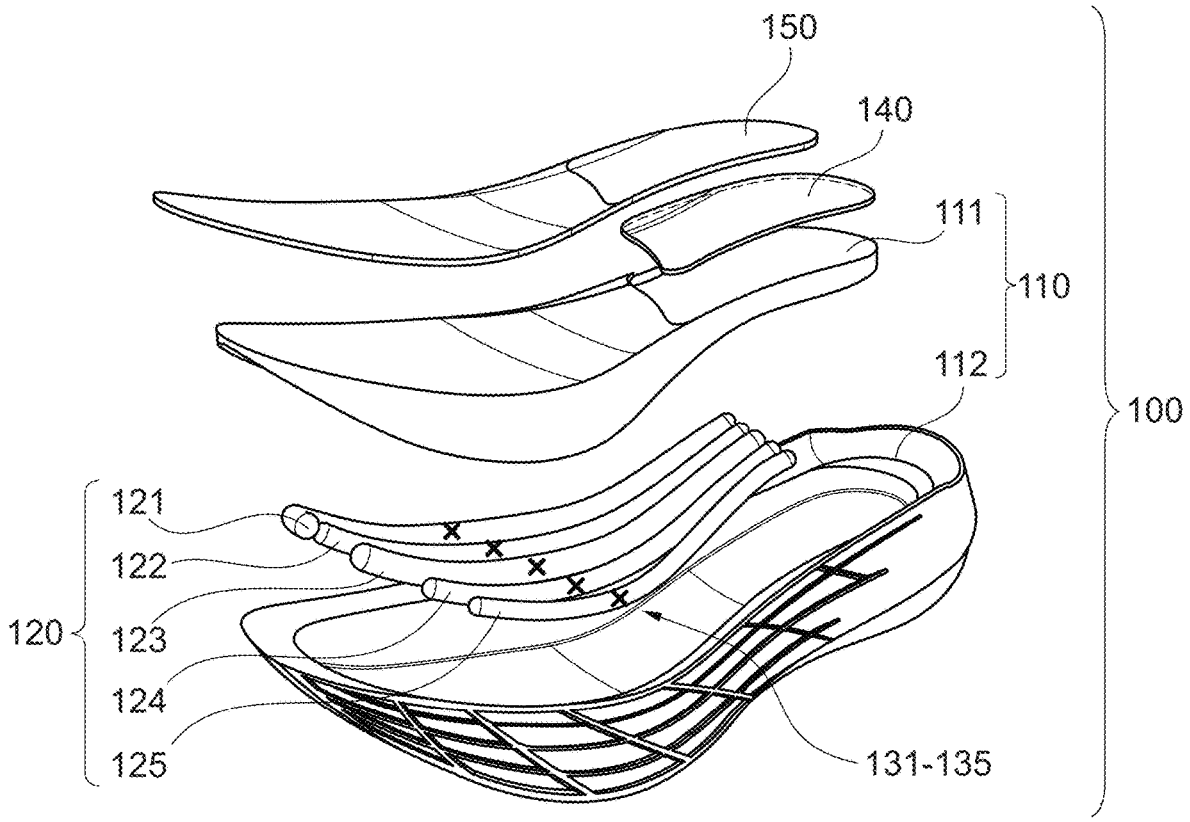
FIGS. 1*a-f* illustrate a sole with five rod-/tube-shaped reinforcing members with variable diameter, each corresponding to a respective metatarsal bone according to some embodiments.

FIG. 1*a* shows an exploded view of the entire sole 100. The sole 100 comprises a midsole 110 with an upper midsole part 111 and a lower midsole part 112. Fully embedded between the upper midsole part 111 and the lower midsole part 112 is a reinforcing structure 120 comprising five reinforcing members, individually referenced by reference numerals 121, 122, 123, 124, 125 in FIG. 1*a*. The sole 100 further comprises a load distribution member 140 partially embedded within the top side of the upper midsole part 111. The upper midsole part 111 thus separates the reinforcing members 121, 122, 123, 124, 125 from the load distribution member 140, i.e., the reinforcing members 121, 122, 123, 124, 125 on the one hand and the load distribution member 140 on the other hand are provided as separate and individual elements. The load distribution member 140 and the upper midsole part 111 are further covered by a sock-liner 150, which may be replaceable or permanently connected to the load distribution member 140 and the upper midsole part 111. In some embodiments, the sock-liner 150 may also be absent. The sole 100 may also comprise an outsole (not shown), to improve traction and wear resistance. The sole 100 may also be fitted with cleats and/or spikes, to make it suitable for track-and-field activities, for example.

The sole 100 may be used in a sports shoe, in particular in a running shoe.

The upper and lower midsole parts 111, 112 may comprise or be made of a polymer foam material. The upper and lower midsole parts 111, 112 can comprise or be made of the same material, or they can comprise or be made of different materials. It is also possible that within a given midsole part, the material composition changes locally, i.e., that different materials are used in different regions, e.g., to locally influence the mechanical properties of the upper and/or lower midsole part 111, 112. The polymer foam material can comprise a homogeneous foam material, like ethylene-vinyl-acetate (EVA) or injection-molded thermoplastic polyurethane (TPU), or thermoplastic polyester ether elastomer (TPEE), Polyamide, PEBA or other suitable materials. The polymer foam material can also comprise a particle foam. For example, particle foams made of or comprising particles of expanded thermoplastic polyurethane (eTPU), expanded polyamide (ePA), expanded polyether-block-amide (ePEBA) and/or expanded thermoplastic polyester ether elastomer (eTPEE) are particularly well suited for use in performance footwear, because they provide a high degree of cushioning and energy return back the wearer. For example, particle foams of eTPU maintain their beneficial properties over a large temperature range (e.g., from −20° C. up to 40° C.). Particle foams including particles of expanded polylactide (ePLA), expanded polyethylene terephthalate (ePET), expanded thermoplastic olefin (eTPO) and/or expanded polybutylene terephthalate (ePBT) are also possible. To give one specific example, the lower midsole part 112 may be made from a homogeneous EVA- or TPU- or TPEE-foam material, to provide good overall stability and wear resistance to the sole 100, while the upper midsole part 111 may be made from a particle foam comprising particles of eTPU, ePA, ePEBA and/or eTPEE, to provide good cushioning, high energy return, and a smoother transition which reduce eccentric forces and give a comfortable ride.

It is emphasized, however, that alternatively or in addition to using a foam material for the midsole 110, other materials and manufacturing options may also be used. For example, the midsole 110 or parts thereof may comprise or be comprised of a lattice structure, for example an additively manufactured lattice structure (e.g., a structure made using a 3D printing method or a laser sintering method or a stereolithography method), which, as already mentioned farther above, may be useful both for long distance running shoes, where a high cushioning is preferred, and for sprint spikes or lower distance running shoes where high cushioning is not a necessity, but high stiffness and anatomical guidance of the foot during ground contact is beneficial.

Moreover, it is also emphasized that the present disclosure also covers embodiments wherein the sole does not comprise separate upper- and lower midsole parts, but only one unified midsole component. Such a midsole may also comprise or be made of one or more of the above-mentioned homogeneous foam materials and/or particle foams and/or non-foamed materials like a lattice structure as mentioned above, for example.

The load distribution member 140 is located in the back half of the sole 100, predominately in the heel area of the sole 100, where heel strike occurs. It also extends some distance towards the center of the sole 100, i.e. the midfoot area, such that in a vertical projection of the sole 100 the load distribution member 140 overlaps partly with the reinforcing structure 120 provided by the five reinforcing members 121, 122, 123, 124, 125 (more details on this below). The load distribution member 140 is provided as a substantially planar load distribution plate in the embodiment shown here, but other geometries like a slight bowl-shape or cup-shape, potentially including a heel counter, are also possible. To save weight but still provide the desired degree of load distribution, the load distribution member 140 may, for example, comprise or be made of carbon fibers, a carbon fiber composite material and/or a glass fiber composite material, such as, for instance, a polyamide material infused with carbon fibers and/or a polyamide material infused with glass fibers.

In some embodiments of the reinforcing structure 120 provided by the five reinforcing members 121, 122, 123, 124, 125, the reinforcing members 121, 122, 123, 124, 125 extend in the front half of the sole 100. More specifically, the reinforcing members 121, 122, 123, 124, 125 extend from the midfoot area—here the area under the arch of the foot—up to the toes. The reinforcing members 121, 122, 123, 124, 125 extend substantially longitudinally through the sole 100, i.e. their longitudinal (i.e., from the back of the sole 100 to the front) extension is much larger than their lateral and medial extension along their course through the sole 100. The reinforcing members 121, 122, 123, 124, 125 are further arranged next to each other in the medial-to-lateral direction, starting with the reinforcing member 121 on the medial side of the sole 100 and continuing up to the reinforcing member 125 on the lateral side of the sole 100. The reinforcing members 121, 122, 123, 124, 125 of the embodiment shown here are of circular cross-section, and their central symmetry axis defines what is called their "flow-lines" in the present document. Other cross-sectional shapes are, however, also covered by the present disclosure. Examples of further possible cross-sectional shapes include elliptic, prismatic, trapezoid, quadratic, or rectangular cross-sections.

As mentioned above, the reinforcing members 121, 122, 123, 124, 125 are positioned between the upper and lower midsole part 111, 112 and may be completely embedded within the midsole 110. In some embodiments, the reinforcing members 121, 122, 123, 124, 125 may be connected to the material of the midsole 110 by a bonding agent or glue, for example, or by some mechanical fastening means. However, since they are completely embedded within the material of the midsole 110, this may not be necessary. In some embodiments, the reinforcing members 121, 122, 123, 124, 125 may also partly protrude from the midsole material and be exposed on the outside of the sole 100, for example at the medial or lateral sidewall. In some embodiments, the reinforcing members 121, 122, 123, 124, 125 may not be exposed on the top side and the bottom side of the sole 100, to not impair the wearing sensation and traction of the sole, respectively.

The reinforcing members 121, 122, 123, 124, 125 are adapted to move independently from each other under the forces acting during a gait cycle. They are, in particular, adapted to be deflected independently from one another by the forces acting during a gait cycle, and hence provide a locally fine-tuned support and reinforcing function that cannot be achieved by a simple unitary structure known from the art, for example. They thus cater to the complicated anatomy of the human foot and the complex movement patterns involved in running- or sprinting motions, by allowing different regions of the sole 100, in particular in the front half and the toe region of the sole 100, to be supported and reinforced to different degrees. This provides a more biomechanically-driven solution than are known from the prior art. The reinforcing members 121, 122, 123, 124, 125 help to provide a smother landing of the foot and a smooth transition, thereby reducing the eccentric forces and reducing overloading of muscle, bones and joints. This helps to lower the overall risk of injuries during sports.

The reinforcing members 121, 122, 123, 124, 125 are non-linear, i.e. their flow-lines do not follow a straight line, in order to further cater to the human anatomy. In some embodiments, for example, as shown in FIGS. 1*a*-1*f*, the reinforcing members 121, 122, 123, 124, 125 do not even comprise straight sections, although this is generally possible within the scope of the present disclosure. As can best be seen in the medial side views of FIGS. 1*d* and 1*e*, the reinforcing members 121, 122, 123, 124, 125 form a concave structure (i.e., a structure in the shape of a bowl or saucer) in the region between the midfoot area and the toes, corresponding to the general shape and anatomy of the foot. This shapes also facilitates a smooth roll-off movement of the foot and hence promotes natural movement patterns.

Figure 1B:
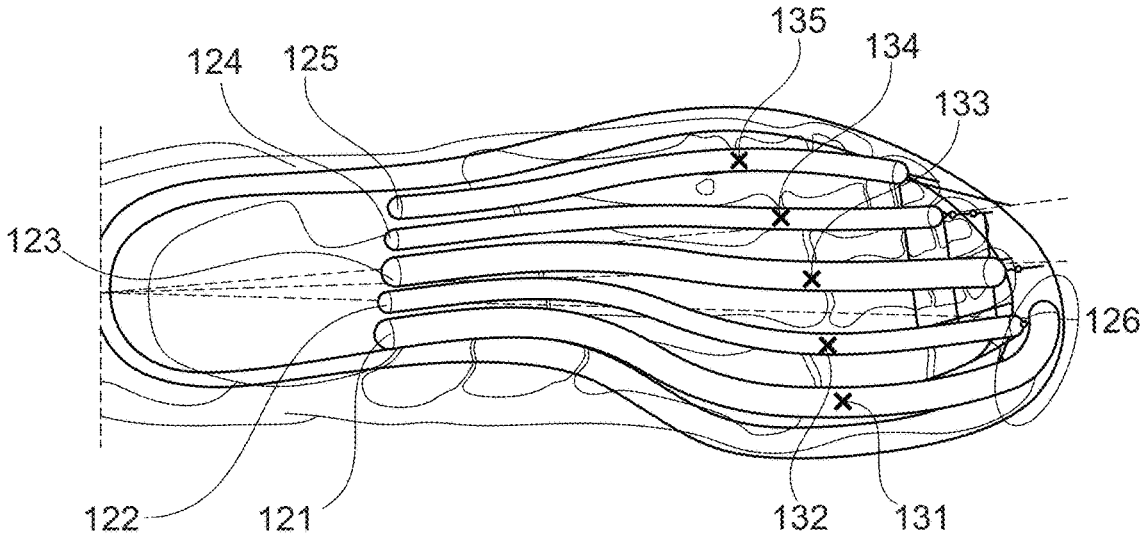

Put into more mathematical language, the shape (e.g., as defined by the flow-line) of each of the reinforcing members 121, 122, 123, 124, 125 comprises a minimum or localized low point with regard to the horizontal plane. It is noted that this statement includes the assumption that the sole sits on a horizontal, flat piece of ground (if the sole is tilted, then the reference-plane must also be tilted in the same manner) and in a force-free state (i.e. without being bent or twisted). The position of these low points is indicated in FIGS. 1*a* and 1*b* by crosses for all five reinforcing members 121, 122, 123, 124, 125 and designated by the reference numerals 131, 132, 133, 134, 135. In the side view of FIGS. 1*d* and 1*e*, only two of these low points are shown, to not clutter up the figures too much. All of the low points 131, 132, 133, 134, 135 are located in the front half of the sole 100. More specifically, each of the low points is located between the midfoot area of the sole 100 and the toes, here in the region of the MTP joints. In some embodiments, the precise position may vary from the position shown here, for example to cater for the specific anatomy of a runner's feet, their running style and pattern of movement, and so forth. It is also emphasized that the position of the low points 131, 132, 133, 134, 135 is only generally indicated in FIGS. 1*a*, 1*b*, 1*d* and 1*e* (and also all subsequent figures of the present application), to illustrate the point at hand, and not determined with the highest precision (e.g., using a computer simulation).

As mentioned above, the reinforcing members 121, 122, 123, 124, 125 form a concave structure (i.e., a structure in the shape of a bowl or saucer) in the region between the midfoot area and the toes. With regard to the low points 131, 132, 133, 134, 135 this means that these points sit a certain distance below the plane tangential to the upper side of the reinforcing structure 120 that is formed by the reinforcing members 121, 122, 123, 124, 125. A clear illustration of this concept is given by FIG. 3*b* (s. the plane 339 and the distance d), and reference is made to the discussion of that figure for more details and explanations. An illustrative way to think about this is to imagine that the reinforcing structure 120 is isolated from the sole 100 with its shape and structure kept intact, and then a sheet of cardboard or a thin metal plate is put on top of the structure. Then the (perpendicular) distance of the low points 131-135 from this plane is determined. The more 'bowl-shaped' the reinforcing structure 120 is, the larger this distance will generally be.

To cater for the typical human anatomy, all of the low points 131, 132, 133, 134, 135 may be a distance of at least 5 mm below the above-defined tangential reference-plane, or even a distance of at least 8 mm. As mentioned above, the depth can also be adjusted according to the intended activity for which the sole and shoe are provided. For example, for an activity that requires or favors more stability, a larger depth may be chosen. However, as also already mentioned, if e.g. a particularly thin midsole is wanted, then the depth can also be chosen smaller.

Alternatively or in addition to obeying a lower limit on the depth of the structure defined by the reinforcing members 121, 122, 123, 124, 125, the distance of the low points 131, 132, 133, 134, 135 to the mentioned tangential reference-plane may also be adjusted or changed depending on the position of the respective low point with regard to the medial-to-lateral direction. For example, the 'center point' 133 may be the deepest, and then the distance to the reference-plane (i.e., the depth of the low points) decreases towards the lateral and medial edges, following the general anatomy of the human foot. Other configurations are, however, also possible, to take account of a specific anatomical feature or some individual movement pattern, for example.

The reinforcing members 121, 122, 123, 124, 125 can be solid (i.e., rod-shaped members) or they can be hollow (i.e., tube-shaped members), or they can be partly solid and partly hollow, depending on the desired trade-off between factors like weight, stability, stiffness, etc. Not all of the reinforcing members 121, 122, 123, 124, 125 have to be of the same construction in this regard, too.

Figure 1C:
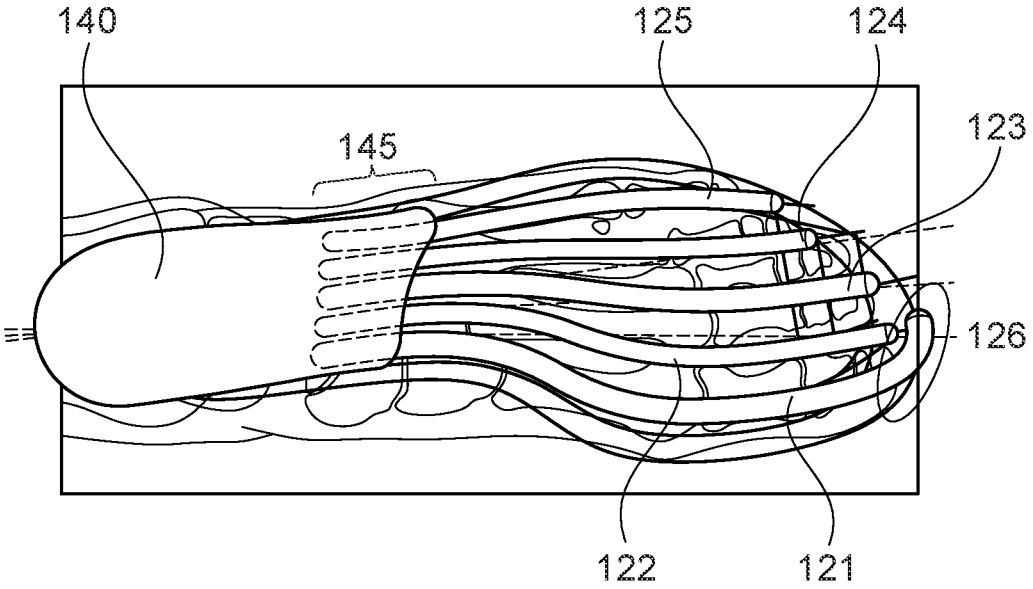

As can be seen in the vertical projection (or top view) of some of the components the sole 100 shown in FIGS. 1*b* and 1*c*, each of the reinforcing members 121, 122, 123, 124, 125 corresponds to one toe/one metatarsal bone of the foot. To make this more visible, the reinforcing structure 120 consisting of the reinforcing members 121, 122, 123, 124, 125 is overlaid in FIGS. 1*b* and 1*c* over a schematic view of an x-ray picture of a typical human foot. While it will be understood from this overlay view that the reinforcing members 121, 122, 123, 124, 125 do not always follow exactly each 'kink and turn' of the human bone structure, the correspondence between the five reinforcing members 121, 122, 123, 124, 125 and the five metatarsal bones is still clearly visible. Each of the reinforcing members 121, 122, 123, 124, 125 will therefore be the predominate source of support for one of the toes of the foot. The reinforcing member 121 corresponds to the first metatarsal bone (i.e., the 'big toe'), reinforcing member 122 corresponds to the second metatarsal bone, reinforcing member 123 corresponds to the third metatarsal bone, reinforcing member 124 corresponds to the fourth metatarsal bone, and reinforcing member 125 corresponds to the fifth metatarsal bone.

As can also be clearly seen in FIGS. 1*b* and 1*a* (but also in all of the other FIGS. 1*a*-*f* pertaining to the sole 100), the reinforcing members 121 and 123, corresponding to the first and third metatarsal bone, respectively, have a larger diameter than the remaining three reinforcing members 122, 124 and 125. The increased diameter leads to a higher deflection stiffness of the reinforcing members 121 and 123 compared to the other three reinforcing members 122, 124 and 125 under the forces acting during a gait cycle, and hence to an increased support of the first and third metatarsal bones and the first and third toe.

Alternatively or in addition to having different diameters, the reinforcing members 121 and 123 could also have a larger wall thickness than the reinforcing members 122, 124 and 125, if they are provided tube-like or at least have hollow sections.

The reinforcing member 121 furthermore has an extended front section 126 which preferably 'curves in' under the tip of the big toe, to provide even better support in this region. One reason for this specific shape and design of the reinforcing members 121 and 123 is, that an increased stiffness for the first metatarsal is beneficial as this is typically the largest and strongest structure of the five metatarsals in the foot, which hence has to exert and withstand the highest forces during running. The third metatarsal in the center of the foot, on the other hand, sits naturally around the center of pressure during the stance phase of the gait cycle during running, and hence also benefits from increased support. This further helps the load to get biomechanically driven and evenly distributed between the different MTP bones. This will reduce the risk of injures.

Figure 1D:
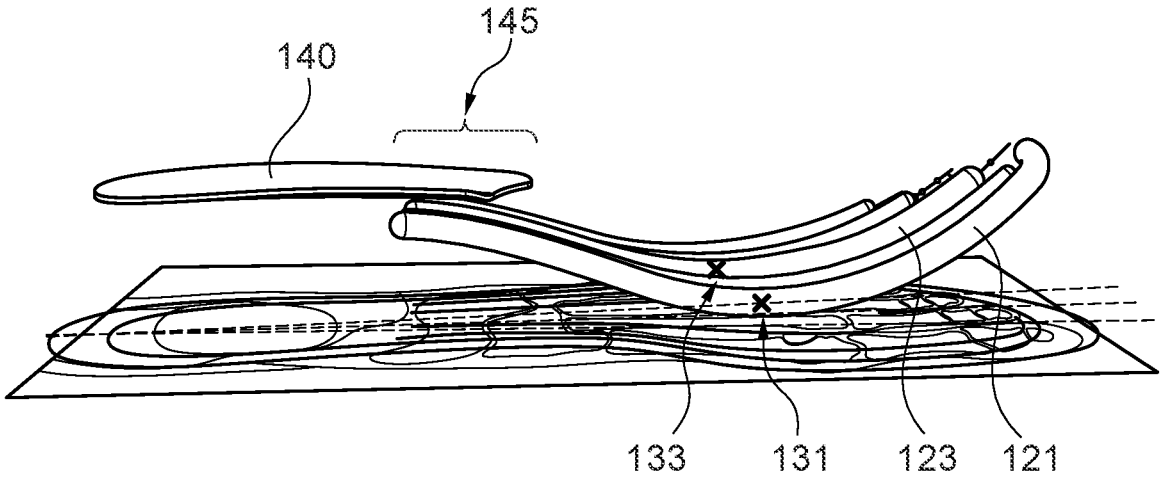
Figure 1E:
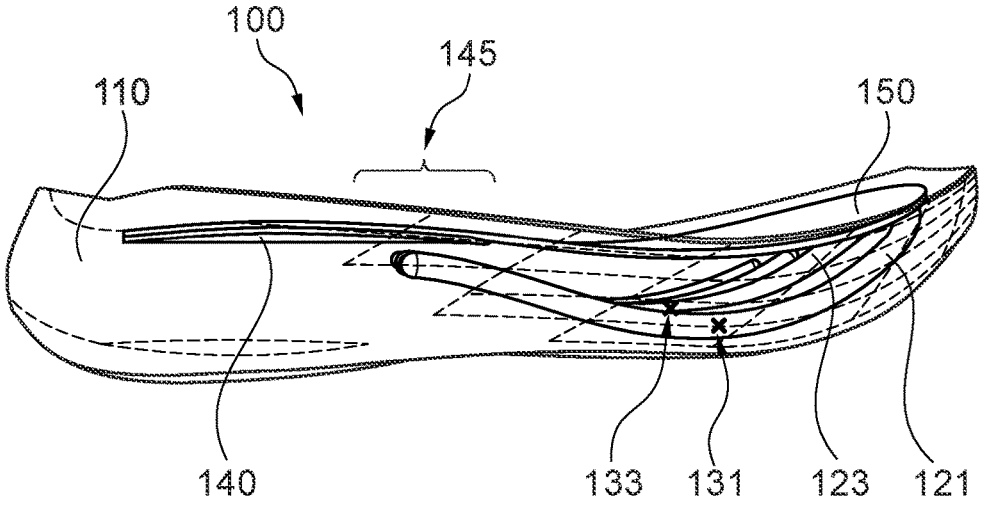
Figure 1F:
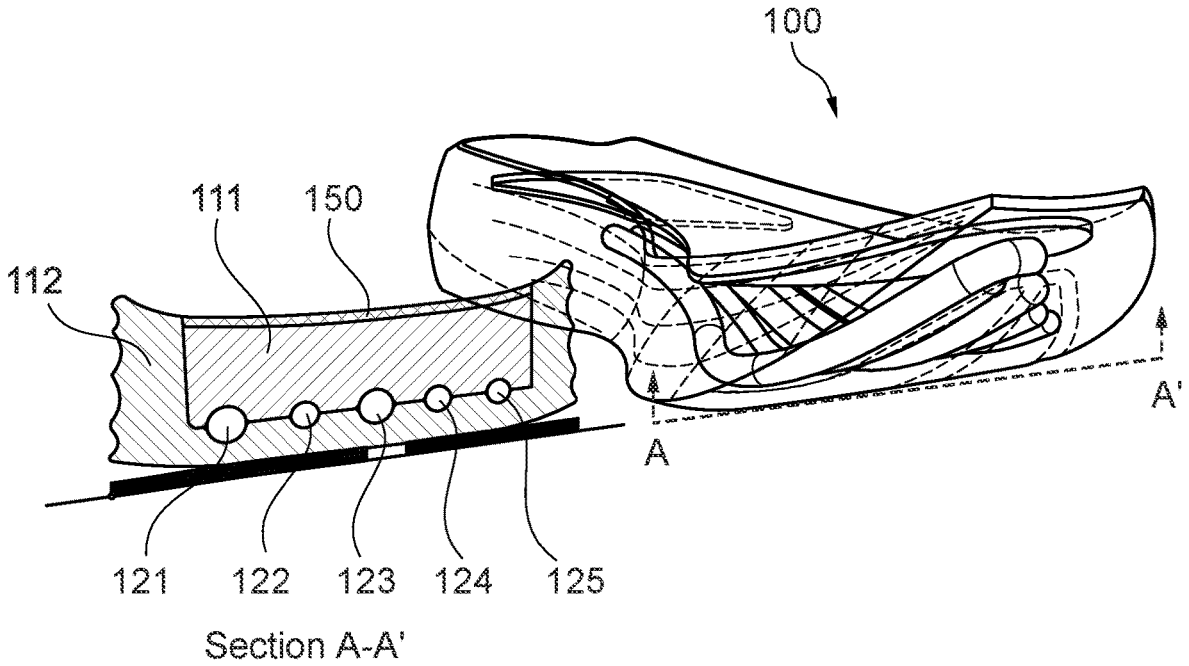

The different diameters of the reinforcing members 121 and 123 compared to the reinforcing members 122, 124 and 125 is also visible in FIG. 1*f*, which shows in the left half of the figure a cross-section through the sole 100 from the medial to the lateral side in the region under the MTP joints. FIG. 1*f* also once again nicely shows how the five reinforcing members 121, 122, 123, 124, 125 are embedded between the upper midsole part 111 and the lower midsole part 112.

More generally speaking, it is mentioned that the diameter and/or wall thickness (for hollow or partly hollow members) of the reinforcing members 121, 122, 123, 124, 125 may also be altered and adapted in a different manner between them, and the diameter and/or wall thickness also does not need to stay constant along a given reinforcing member, even if this is the case in the sole 100 shown in FIGS. 1*a-f*. By altering the diameter/wall thickness between the different reinforcing members and/or along a given reinforcing member, a fine-tuning to a specific set of requirements regarding the support and reinforcement provided by the reinforcing structure 120 can thus be obtained.

Further examples of shoe soles 900 and 1000*a*, 1000*b*, 1000*c*, 1000*d* with different configurations of rod-/tube-shaped reinforcing members are discussed below in relation to FIGS. 9*a-b* and 10*a-d*.

The reinforcing members 121, 122, 123, 124, 125 can comprise or be made of a large number of materials. However, to achieve a beneficial tradeoff between stiffness and reinforcement on the one hand, and low weight on the other hand, materials for the construction of the reinforcing members 121, 122, 123, 124, 125 may be carbon fibers, carbon fiber composite materials and/or glass fibers composite materials, such as for instance, polyamide materials infused with carbon fibers and/or polyamide materials infused with glass fibers. Besides their good stiffness-to-weight ratio, they are also very adaptable when it comes to the kinds of geometries and shapes of reinforcing members that can be made out of them, which is desired to obtain a good fit for an object as complex as a human foot. Other possible materials are, for example, metal, wood, or injection-molded plastic materials.

Potential methods for the manufacture of the reinforcing members 121, 122, 123, 124, 125 include: molding (e.g. injection molding), additive manufacturing (e.g., 3D printing), or carbon extrusion, for example.

Details pertaining to a method for the manufacture of reinforcing members or structures containing hollow, i.e. tube-shaped sections are discussed below in relation to FIGS. 15*a-b*.

A further feature of the sole 100, which was already briefly touched upon above but which becomes more clearly visible from the top view in FIG. 1*c* and the medial side views of FIGS. 1*d* and 1*e* is, that the load distribution member 140 and the rear ends of the reinforcing members 121, 122, 123, 124, 125 overlap at least partially (in a vertical projection of the sole as best seen in FIG. 1*c*). The overlap region is indicated by reference numeral 145 in FIGS. 1*c*-1*e*. What this overlap does is that, even though the reinforcing members 121, 122, 123, 124, 125 and the load distribution member 140 are provided as individual parts of the sole 100 and are separated by the upper midsole part 111 (it is pointed out however that, generally, a physical connection between these parts is also possible), there is still some interplay or interlock between the two, in the sense that the material of the upper midsole part 111 couples the two together and the overall stability of the sole through the entire gait cycle (when the main pressure point typically moves from the heel area through the midfoot area up to the toes, for push-off) is improved, without any sudden jumps or discontinuity of the response of the sole to the acting forces.

Alternatively or additionally of having such a load distribution member 140, the sole may also comprises a forefoot support plate, as discussed below in relation to FIGS. 11*a-f*.

Figure 2:
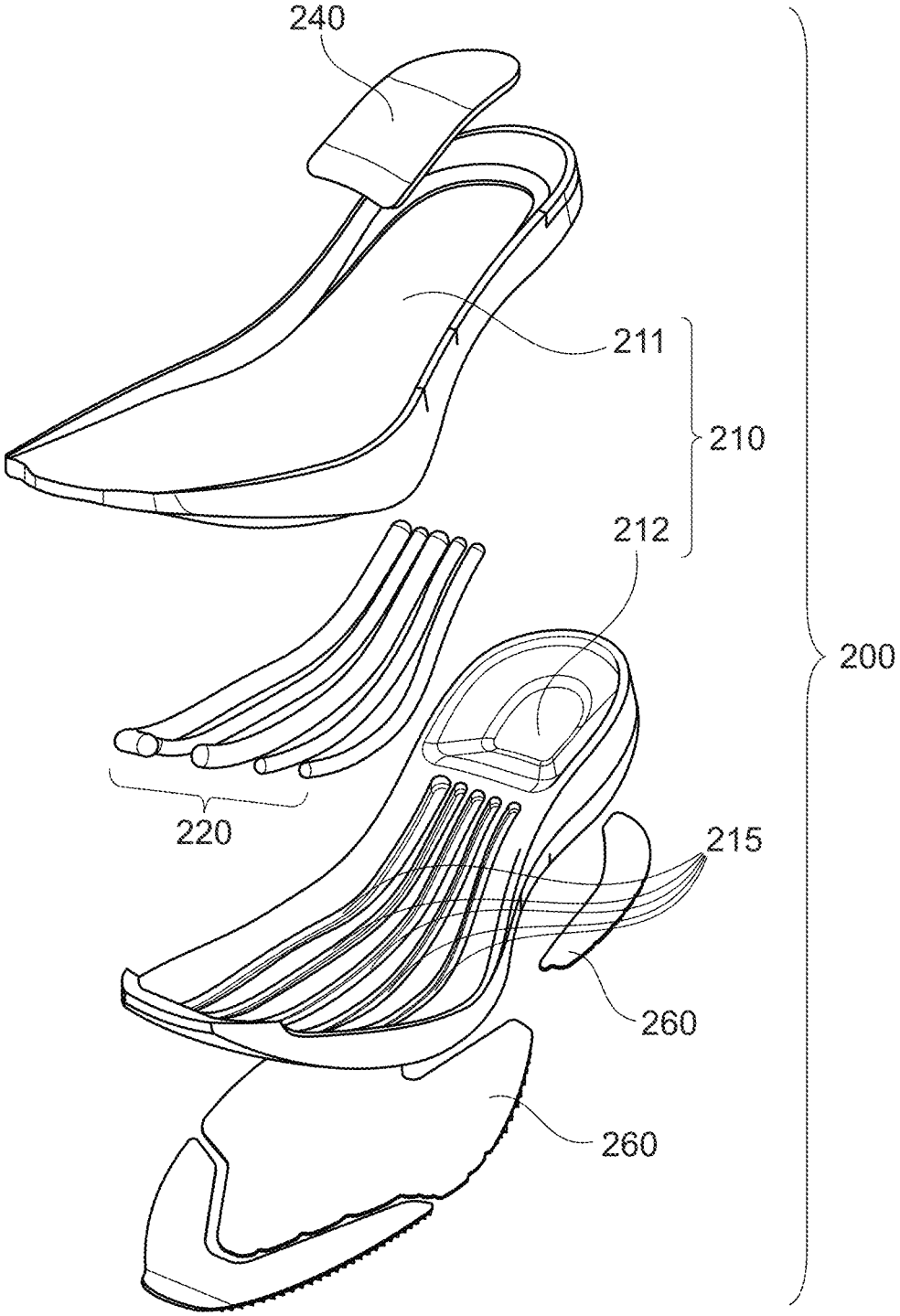
FIG. 2 illustrates a sole with five rod-/tube-shaped reinforcing members with variable diameter, each corresponding to a respective metatarsal bone according to some embodiments.

The sole 200, according to some embodiments of the present disclosure, as shown in FIG. 2 (FIG. 2 shows an exploded view), is very similar to that of FIGS. 1*a-f*. All of what has been said about the corresponding members, elements and components of the sole 100 therefore also applies to the embodiment of FIG. 2 (unless physically or technically ruled out, of course) and is therefore not repeated again.

The sole 200 comprises a midsole 210 with an upper midsole part 211 and a lower midsole part 212, between which five reinforcing members 220 are positioned. They are completely embedded within the midsole 210. The reinforcing members 220 are again rod-/tube-shaped, and the reinforcing members corresponding to the first and third metatarsal have a larger diameter than the other three reinforcing members. The sole also comprises a load distribution member 240 arranged predominately in the heel area and on top of the upper midsole part 211, as well as an outsole 260, which in the embodiment shown here comprises several individual sub-parts (this need not always be the case, however).

One noteworthy feature of the sole 200 is that the lower midsole part 212 comprises five grooves 215, each corresponding to one of the five reinforcing members 220. This may help to secure the reinforcing members 220 in their position and thus help to avoid or limit the use of adhesives or glues, for example, and to generally facilitate assembly of the sole 200.

Figure 3A:
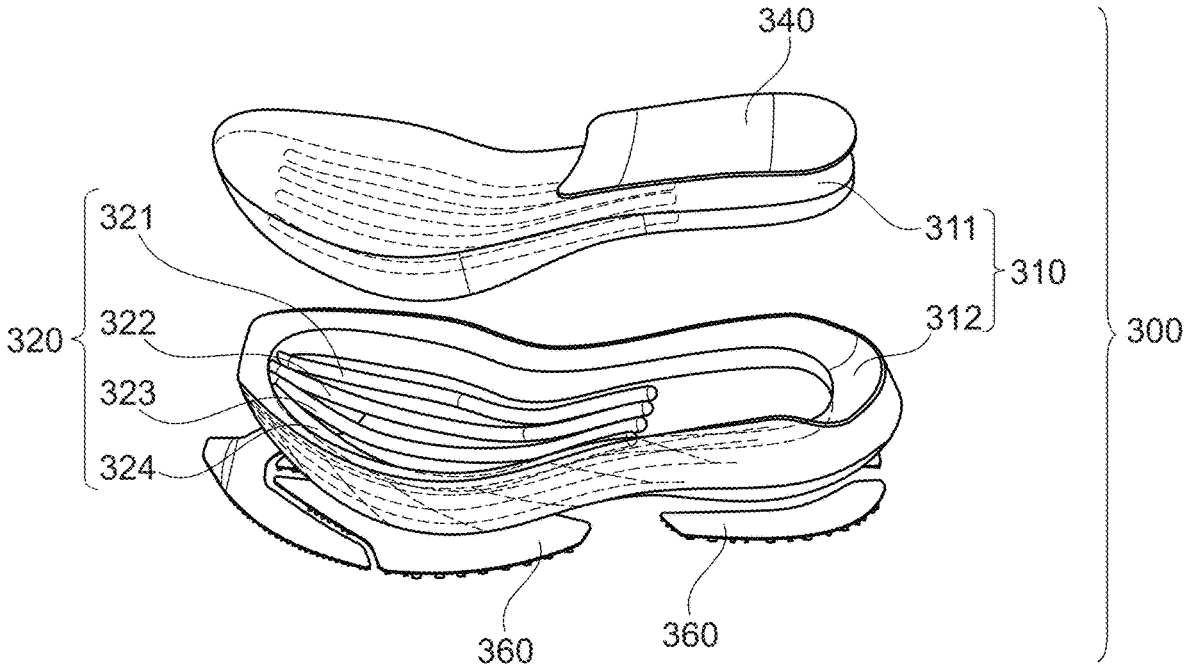
FIGS. 3*a-b* illustrate a sole with four rod-/tube-shaped reinforcing members according to some embodiments.
Figure 3B:
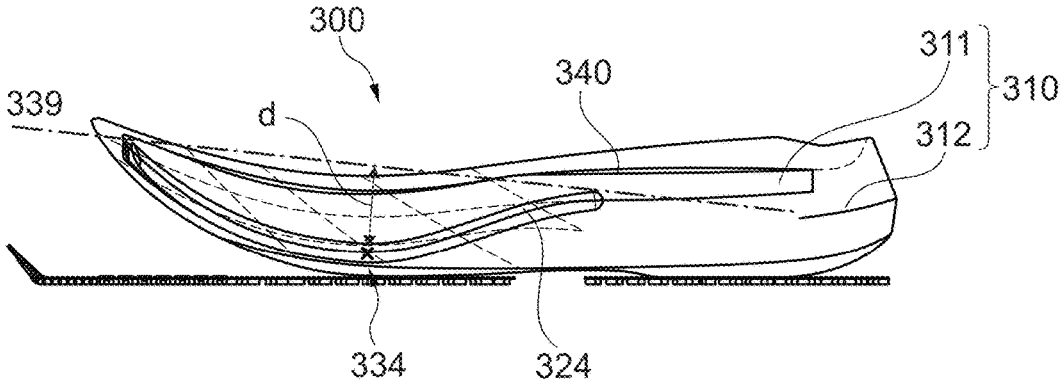

The sole 300, according to some embodiments of the present disclosure, as shown in FIGS. 3*a* and 3*b*, is again quite similar to that of FIGS. 1*a-f* and FIG. 2. All of what has been said about the corresponding members, elements and components of the soles 100 and 200 therefore also applies to the embodiment of FIGS. 3*a* and 3*b* (unless physically or technically ruled out) and is therefore also not repeated.

FIG. 3*a* shows an exploded view of the sole 300 and FIG. 3*b* shows a side view of the sole 300.

The sole 300 comprises a midsole 310 with an upper midsole part 311 and a lower midsole part 312, but now with only four reinforcing members 321, 322, 323, 324 positioned between them to form the reinforcing structure 320. This structure is again completely embedded within the midsole 310.

Reducing the number of individual reinforcing members may, for example, simplify the construction and reduce weight and costs. On the other hand, it might give up a certain degree of control over the reinforcing function provided by the reinforcing structure 320, compared to the structure 120 with five individual members 121, 122, 123, 124, 125, for example. On the other hand, it may well be found that for a specific activity e.g. support of the fifth metatarsal and fifth toe may not be necessary, and then one reinforcing member may simply be omitted with the remaining four reinforcing members 321, 322, 323, 324 still corresponding to the first to forth metatarsal. Or the most lateral of the four reinforcing members, i.e. reinforcing member 324, may be associated with supporting both the fourth and fifth metatarsal, while the first three reinforcing members 321, 322, 323 correspond to one metatarsal each. Further permutations in this regard are conceivable for the skilled person. The reinforcing members 321, 322, 323 are once again rod-/tube-shaped in the shown embodiment.

The sole 300 also comprises a load distribution member 340 arranged predominately in the heel area and on top of the upper midsole part 311, as well as an outsole 360, with several individual sub-parts.

FIG. 3*b* once again illustrates the meaning of the low points of the reinforcing members and their distance to the plane 339 tangential to the upper side of the reinforcing structure 320 that is formed by the reinforcing members 321, 322, 323, 324. Indicated in FIG. 3*b* is one of the low points, specifically the low point 334 of the reinforcing member 324. For the other reinforcing members 321, 322, 323, the situation is similar. The low point 334 can be thought of as the point of the flow-line of the reinforcing member 324 closest to the ground, i.e. the horizontal plane. The reference-plane 339, on the other hand, is the plane tangential to the upper side of the structure formed by the reinforcing members 321, 322, 323, 324 (this plane 339 may be thought of as a 'lid' that is laid on top of the structure). The distance d from this plane is referred to as the depth of the respective low point (here, the low point 334).

Figure 4:
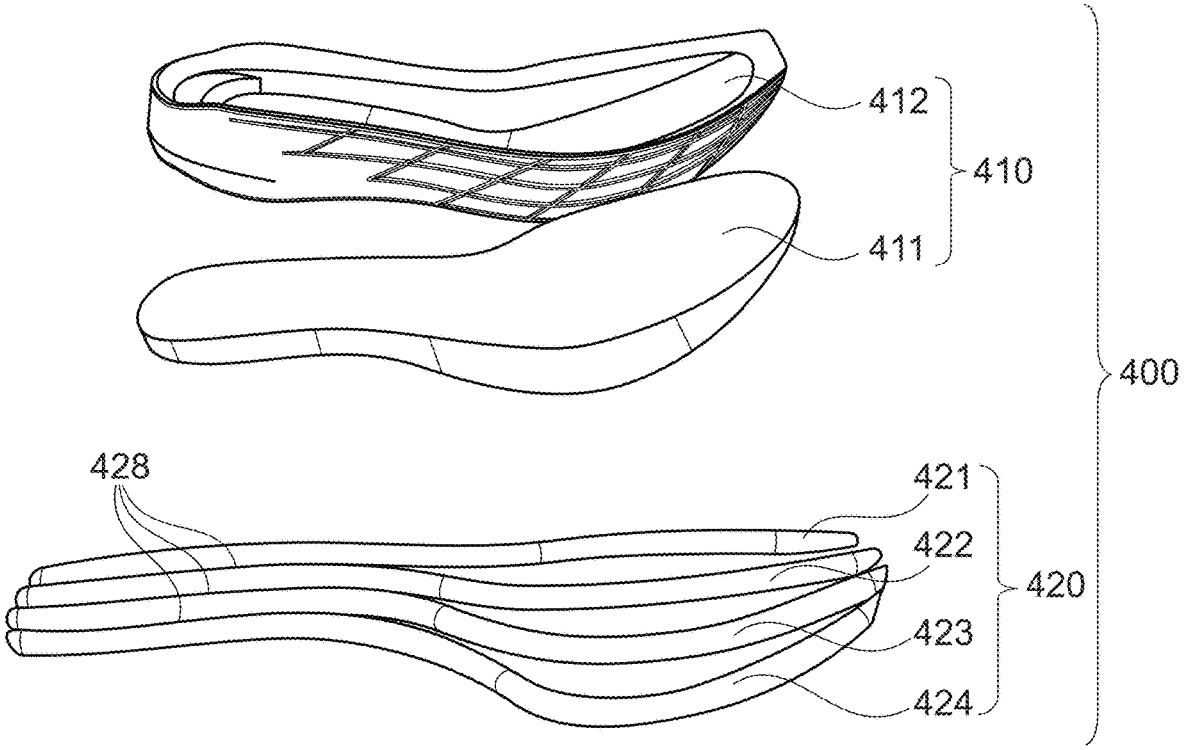
FIG. 4 illustrates a sole with four rod-/tube-shaped reinforcing members according to some embodiments.

FIG. 4 shows sole 400, according to some embodiments of the present disclosure, in a dissembled state, very similar to that of FIGS. 3*a* and 3*b*. Again, analogous statements as above with regard to, for example, the sole 300 apply and are not therefore repeated here.

The sole 400 comprises a midsole 410 with an upper midsole part 411 and a lower midsole part 412. In some embodiment, for example, as shown in FIG. 4, both parts are made from a homogeneous TPEE foam material. However, the parts 411 and 412 may generally be made from all of the materials mentioned throughout the present document. For example, the upper midsole part 411 may comprise a particle foam with particles of ePEBA and the lower midsole part 412 may comprise a particle foam with particles of eTPEE, or vice versa.

The sole 400 also comprises a reinforcing structure 420 with four reinforcing members 421, 422, 423, 424 to be positioned between the midsole parts 411, 412 and to be completely embedded within the midsole 410.

One feature of the reinforcing structure 420 is that the four reinforcing members 421, 422, 423, 424 are connected in the midfoot area by a connection member 428, which is provided as small connecting bars between the individual reinforcing members 421, 422, 423, 424. This may facilitate assembly of the sole 400 but also manufacturing of four reinforcing members 421, 422, 423, 424 themselves, as the individual reinforcing members may be manufactured or molded as a single, (partly) connected unit. The connection member 428 may also increase the stability of the sole 400 in the midfoot area. It is noteworthy that in the front half of the sole, in particular in the forefoot area, there is no connection between the reinforcing members 421, 422, 423, 424, to not impede their ability to deflect individually under the forces acting during a gait cycle.

Using a connection member like member 428 may also compensate (at least partly) for not using a load distribution member in the heel area of the sole, as is the case for the sole 400 shown in FIG. 4. On the other hand, such a load distribution member may also be added to the sole 400, to provide even better stability in the heel area.

Figure 5A:
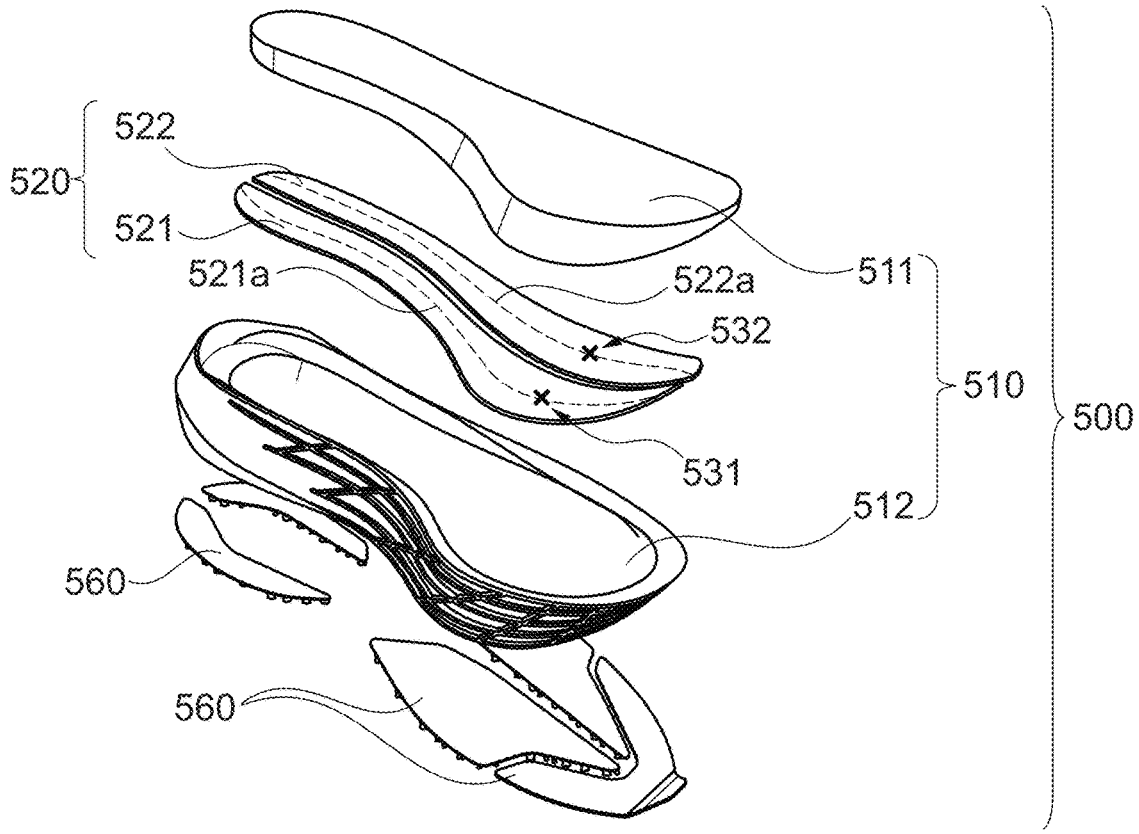
FIGS. 5*a-b* illustrate a sole with two plate-like reinforcing members according to some embodiments.
Figure 5B:
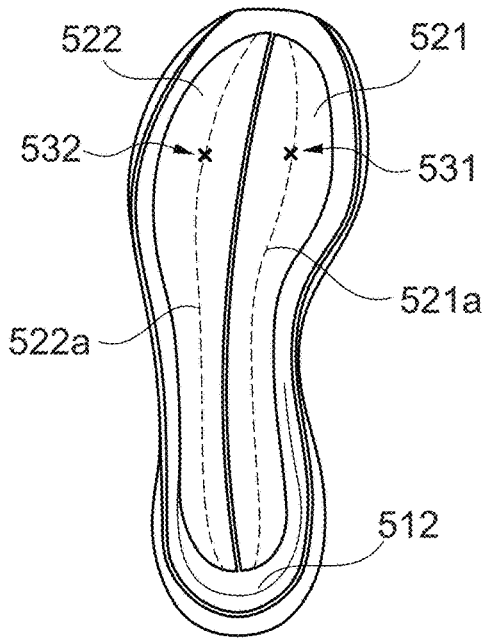

FIGS. 5*a* and 5*b* show sole 500 according to some embodiments of the present disclosure. FIG. 5*a* shows an exploded view of the entire sole 500, and FIG. 5*b* a top view of only some of the parts.

The sole 500 again comprises a midsole 510 with an upper midsole part 511 and a lower midsole part 512 as well as an outsole 560 with several individual pieces. All of what has been said with regard to these components in the context of the embodiments 100, 200, 300 and 400 also applies here (as far as physically and technically compatible) and is not repeated again.

A difference to the embodiments 100, 200, 300 and 400 described above lies in the shape and structure of the reinforcing structure 520, which in the case at hand is provided by two plate-like reinforcing members 521 and 522. Even though these two reinforcing members have a different shape than the reinforcing members discussed above, they are still adapted to be independently deflected by the forces acting on them during a gait cycle. Despite their plate-like shape, the reinforcing members 521 and 522 may also have a hollow core or hollow sections, for example. They may also be solid members.

Another difference to the embodiments described above is that the reinforcing members 521 and 522 extend rearwardly beyond the midfoot area and into the heel area, up to the calcaneus. This can increase the stiffness of the entire sole, not only the front half.

Indicated in FIGS. 5*a* and 5*b* are further the flow-lines 521*a*, 522*a*, of the reinforcing members 521, 522, respectively. As discussed in section 3. above, for reinforcing members with non-circular (or more generally non-symmetrical) cross-section, a way to define the flow-line is to (conceptually) divide the member into equidistant slices, determine the center of mass of each slice, and piece these points together to obtain the flow-line. As was the case with the low points 131, 132, 133, 134, 135 discussed above, also here the position of the flow-lines 521*a*, 522*a* has not been determined with absolute mathematical precision, but is only roughly indicated, to illustrate the point at hand.

What can be seen from the flow-lines is that both reinforcing members 521 and 522 comprise a non-linear section extending across the front half of the sole 500. In the back half of the sole 500, the reinforcing members 521 and 522 comprise straight or at least approximately straight sections. More specifically, in the front half of the sole 500 the reinforcing members 521 and 522 provide a concave shape to the reinforcing structure 520, with both low points 531 and 532 sitting a certain distance below the plane tangential to the upper side of the reinforcing structure 520. Suitable values for a lower boundary on this distance have already been discussed and are not repeated again, because the discussed values may also apply to plate-like reinforcing members like the members 521 and 522.

Figure 6A:
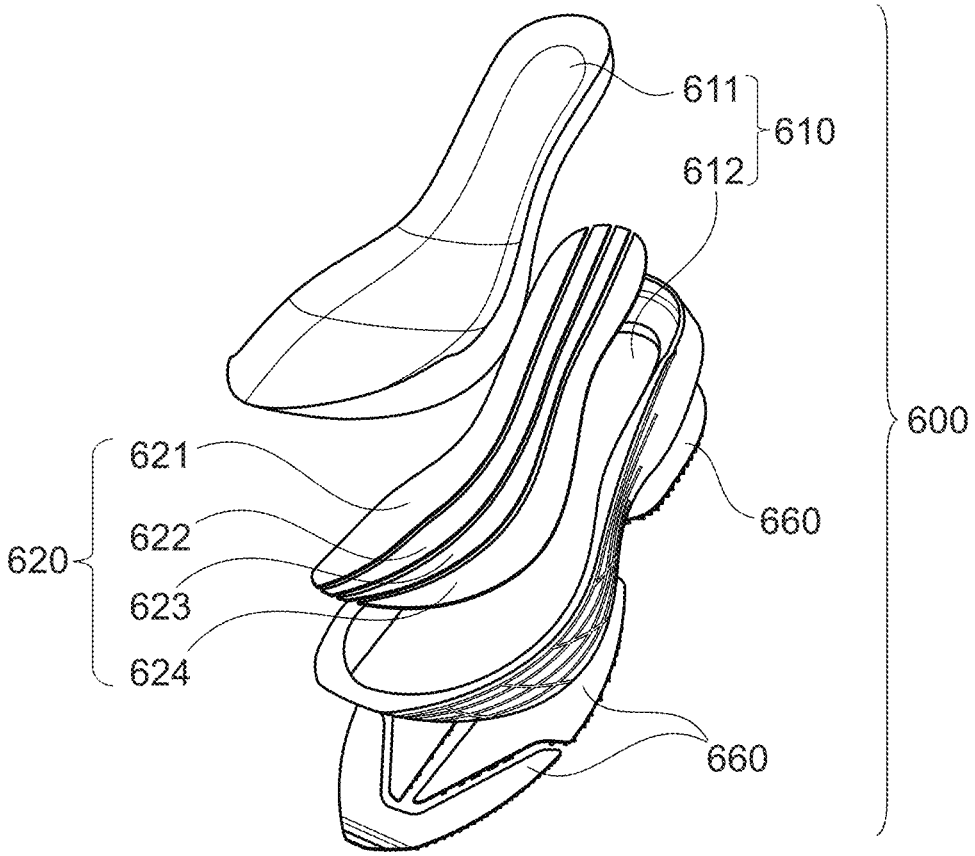
FIGS. 6*a-d* illustrate a sole with four plate-like reinforcing members according to some embodiments.
Figure 6B:
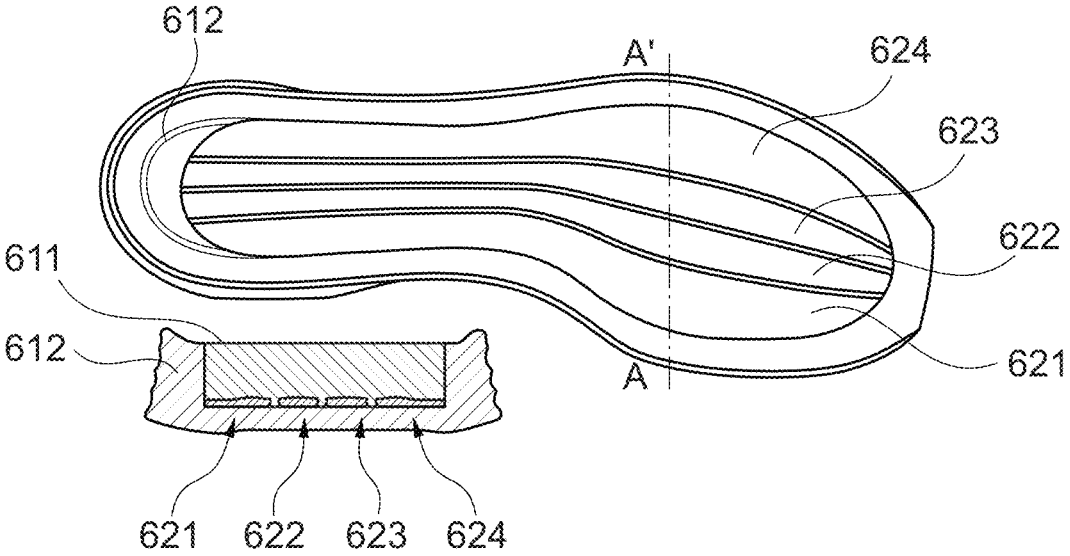
Figure 6C:
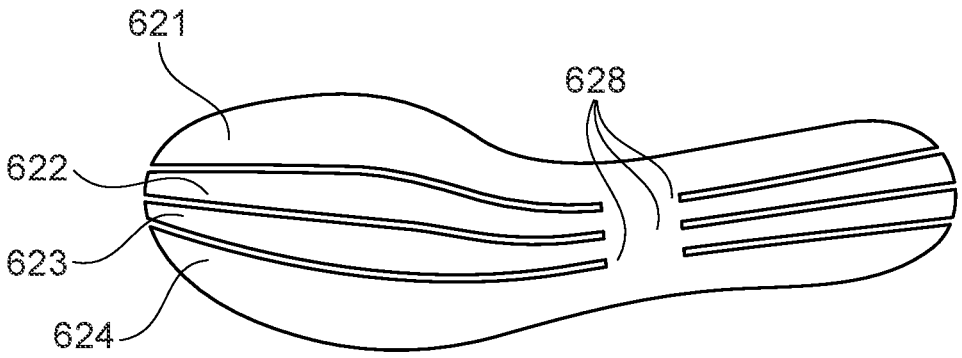
Figure 6D:
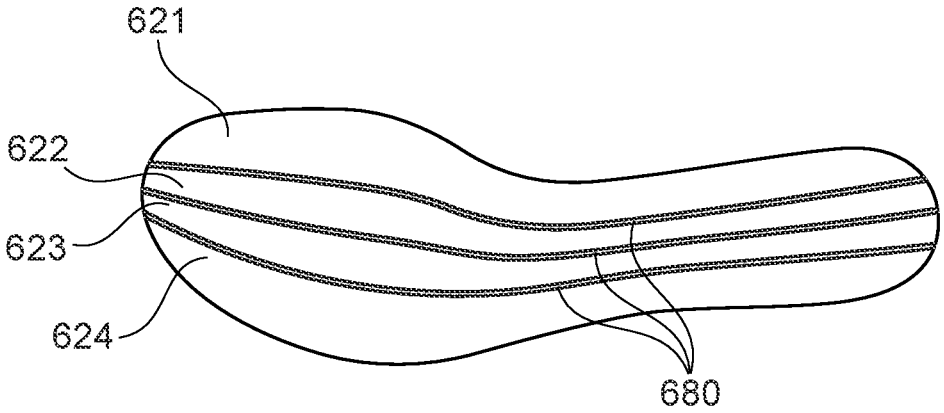

FIGS. 6*a*-6*d* show further variations of the basic construction provided by the sole 500. FIG. 6*a* shows an exploded view of a sole 600 according to some embodiments of the present disclosure, and FIG. 6*b* shows a top view of some of the parts of the sole 600 and a corresponding cross-section along the line A-A. FIGS. 6*c* and 6*d* show possible modifications of the reinforcing structure.

The sole 600 once more comprises a midsole 610 with an upper midsole part 611 and a lower midsole part 612, as well as an outsole 660 with several individual parts. These components have already been extensively discussed and all of the above-said also applies here.

In the sole 600, the reinforcing structure 620 is provided by four plate-like reinforcing members 621, 622, 623, 624, compared to the two of the sole 500. One specific feature of the sole 600 is that the reinforcing members 621, 622, 623, 624 have slightly raised sections along their central longitudinal axes (i.e., at least approximately following their flow-lines), starting approximately at the rear end of the foot arch and extending forwardly up to the toe area. For example in the cross-section along the cut-line A-A shown in the bottom left of FIG. 6*b*, these slightly raised sections can be discerned. Such raised sections can, for example, increase the stiffness of the reinforcing members 621, 622, 623, 624 in the sections where they are applied.

FIG. 6*c* shows a further possible modification of the reinforcing structure 620 provided by the reinforcing members 621, 622, 623, 624, in that the reinforcing members 621, 622, 623, 624 may be connected in the back half of the sole 600, e.g., in the area of the foot arch, by a connecting member 628, here in the form of bars each connecting two adjacent reinforcing members. In some embodiments, this connection is limited to the back half of the sole 600, so that the reinforcing members' ability to respond and react interpedently to the acting forces in the front half of the sole 600 is not impaired by the connection.

Another option to increase the overall stability of the sole 600 while not unduly impairing the independency of movement of the individual reinforcing members 621, 622, 623, 624 is illustrated in FIG. 6*d*. Instead of connecting the reinforcing members 621, 622, 623, 624 among each other, the reinforcing members 621, 622, 623, 624 are here laminated (or otherwise connected) to a mesh-like material 680. Such a material may be highly tear-resistant but still sufficiently flexible to allow a good compromise between stability and independency of movement of the individual the reinforcing members 621, 622, 623, 624. It may also facilitate assembly of the sole 600 and increase its life-span and durability.

Figure 7A:
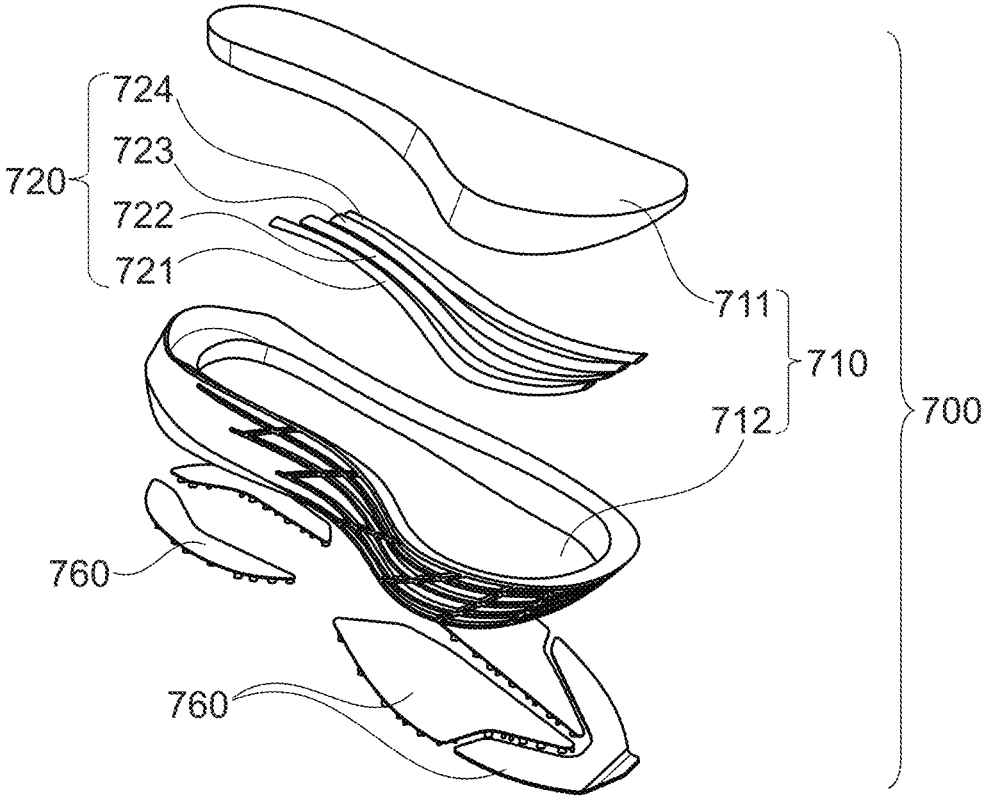
FIGS. 7*a-b* illustrate a sole with four reinforcing members, having a hybrid shape between plate-like and rod-/tube-shaped according to some embodiments.
Figure 7B:
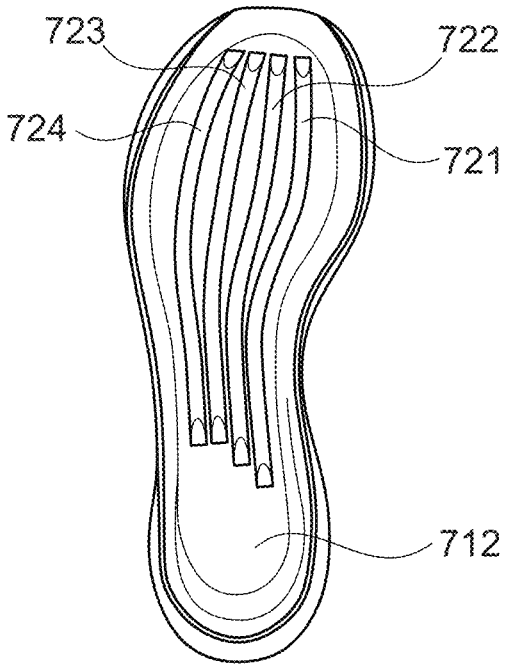
Figure 8A:
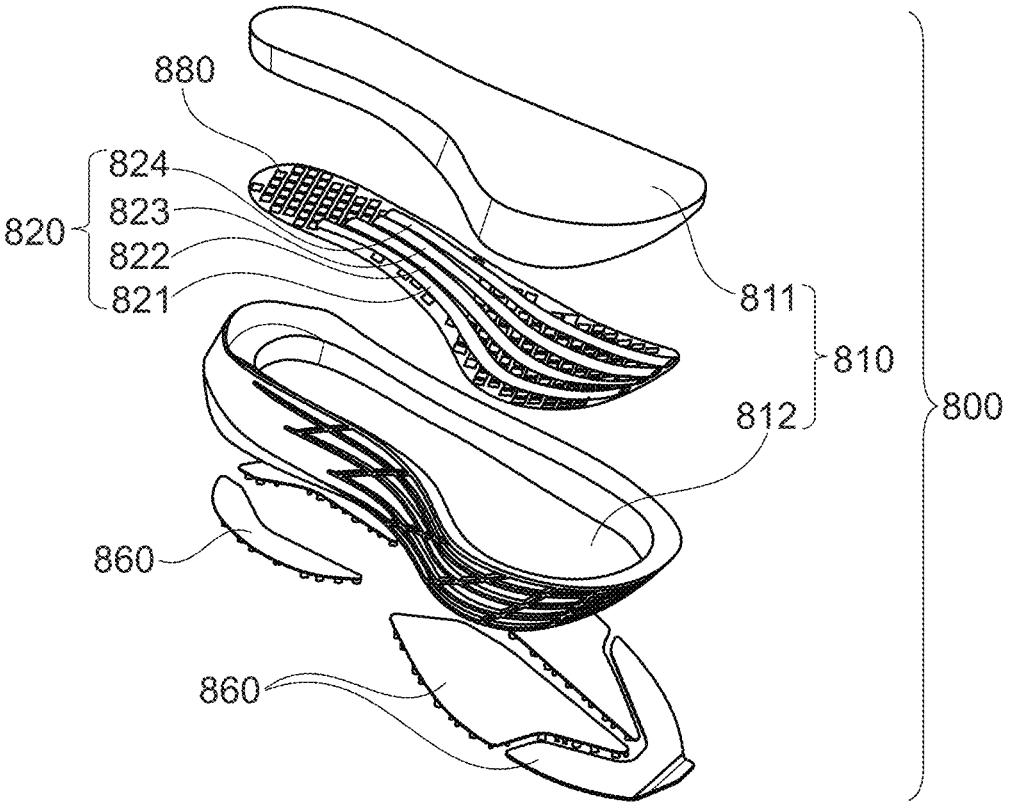
FIGS. 8*a-b* illustrate a sole with four reinforcing members, having a hybrid shape between plate-like and rod-/tube-shaped, and connected by a mesh-like material according to some embodiments.
Figure 8B:
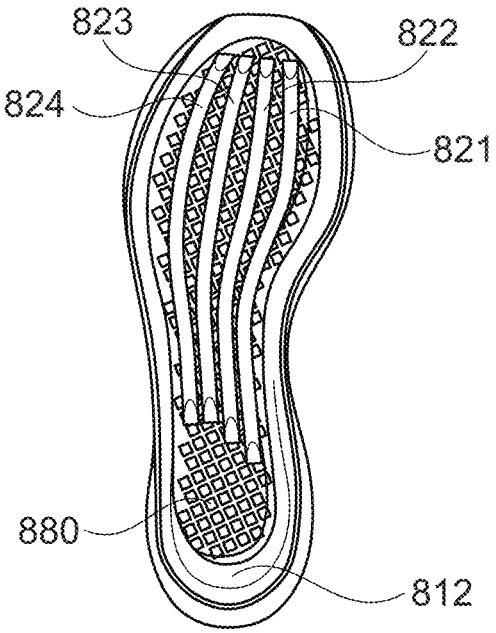

FIGS. 7*a* and 7*b* as well as FIGS. 8*a* and 8*b* show further constructions of the present disclosure. FIGS. 7*a* and 8*a* show exploded views of shoe soles 700, 800, and FIGS. 7*b* and 8*b* show corresponding top views of some parts of the soles 700, 800.

The soles 700 and 800 are quite similar, for example, to the sole 300 discussed above. Both soles comprise a midsole 710, 810 with an upper midsole part 711, 811 and a lower midsole part 712, 812 as well as an outsole 760, 860, respectively. Both soles 700, 800 also comprise a reinforcing structure 720, 820 with four reinforcing members 721, 722, 723, 724 and 821, 822, 823, 824, respectively.

Redundancies are therefore avoided by not repeating everything that has been said about the corresponding elements and components above, which also applies to the show soles 700, 800 at hand.

On difference, though, is the cross-section of the reinforcing members 721, 722, 723, 724 and 821, 822, 823, 824. These are a 'hybrid' between plate-like and rod-/tube-shaped, and the cross-section also changes along the reinforcing members. While the front and back tips of the reinforcing members 721, 722, 723, 724 and 821, 822, 823, 824 are flattened out, their middle sections are circular of elliptic in cross-section. Flattening out the tips, in particular towards the front of the sole 700, 800, may be beneficial because the sole typically becomes thinner towards its front end and there is thus less room to accommodate the reinforcing members. Thinning them out towards the front end may thus help to avoid an excessively thick and bulky front half of the sole.

Moreover, the reinforcing members 721, 722, 723, 724 and 821, 822, 823, 824 also differ in their individual length. Generally, the longer a reinforcing member is, the more transitional support during the stance phase it will provide, as well as a better guidance through the engineered motion. Choosing different lengths for the reinforcing members 721, 722, 723, 724 and 821, 822, 823, 824, also allows to customize the force distribution along the different metatarsal bones in a more anatomical/ergonomical manner, compared to known unitary structures from the prior art.

It is explicitly noted at this position that this option of choosing different length for the different reinforcing members also pertains to all other embodiments described in this document (unless explicitly stated otherwise), and is not limited to the shoe soles 700, 800 of FIGS. 7*a*-*b* and 8*a*-*b*.

The sole 800 also includes a mesh-like material 880, onto which the reinforcing members 821, 822, 823, 824 are laminated, or otherwise connected to, to increase the overall stability, facilitate assembly and/or increase the life-span of the sole 800, for example.

FIGS. 9*a*-*b* and 10*a*-*d* show shoes soles 900, 1000*a*, 1000*b*, 1000*c*, 1000*d* with different configurations of rod-/tube-shaped reinforcing members, according to some embodiments of the present disclosure.

Sole 900, 1000*a*, 1000*b*, 1000*c*, 1000*d*, as shown in FIGS. 9*a*-*b* and 10*a*-*d* are again similar, for example, to the soles 100 and 200 of FIGS. 1*a*-*f* and 2. All of what has been said about the corresponding members, elements and components above, in particular about the soles 100 and 200, therefore also applies to the embodiments of FIGS. 9*a*-*b* and 10*a*-*d* (unless physically or technically ruled out, of course) and is therefore not repeated again.

Figure 9A:
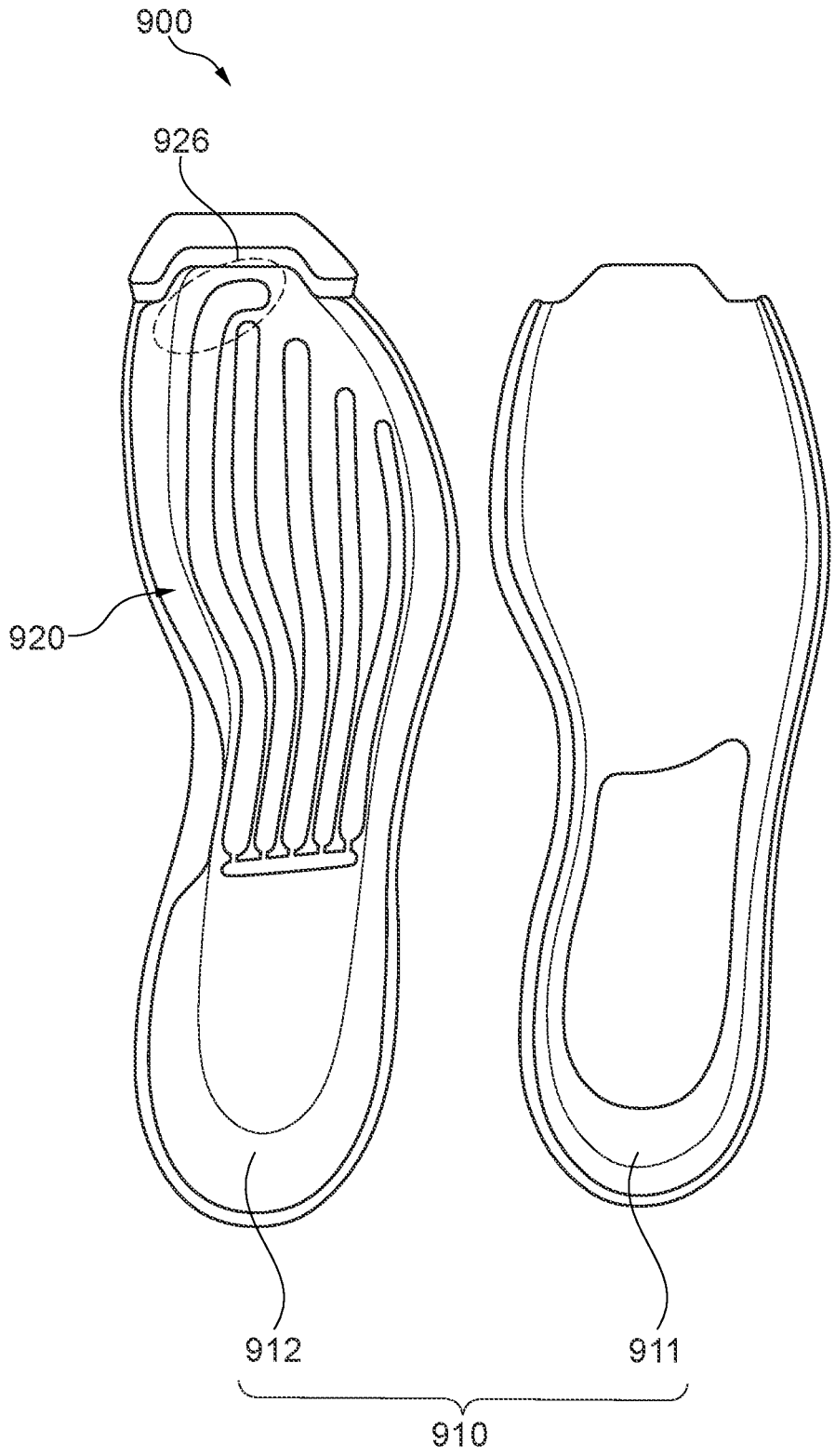
FIGS. 9*a-b* illustrate a sole with five rod-/tube-shaped reinforcing members with variable diameter, each corresponding to a respective metatarsal bone according to some embodiments.

The sole 900 shown in FIG. 9*a* first of all comprises a midsole 910 with a lower midsole part 912. The corresponding upper midsole part 911 to be placed on top of the reinforcing structure 920 is shown on the right-hand side of FIG. 9*a*. The upper midsole part 911 has a recess in the back half of the sole, into which a load distribution member (not shown) may be placed, as already discussed. In the case shown here, both midsole parts 911, 912 are made from a homogeneous foam material, but any of the above-mentioned materials suitable for use in a midsole of an inventive sole could also be employed. FIG. 9*a* shows a sole for the right foot.

Figure 9B:
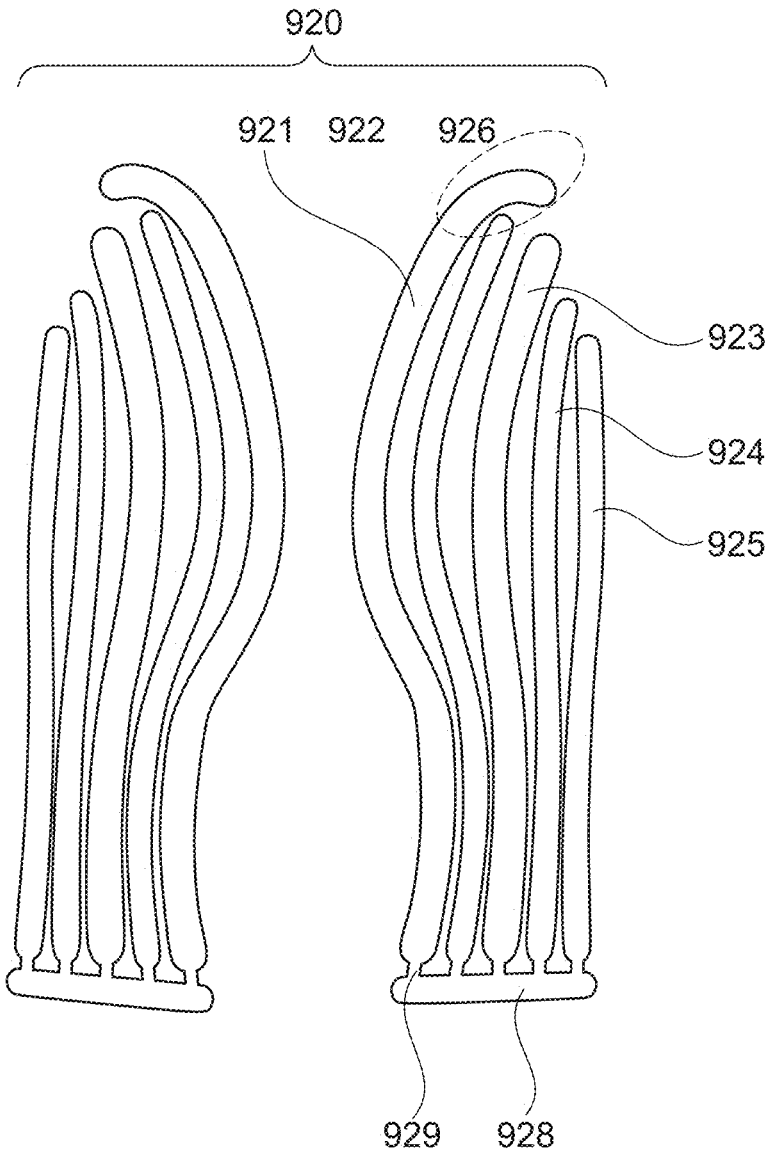

The reinforcing structure 920, which is again shown in isolated form on the right hand side of FIG. 9*b* comprises five tubular/rod-shaped reinforcing members 921, 922, 923, 924, 925, each corresponding to one toe of the foot/metatarsal bone (on the left hand side of FIG. 9*b*, the corresponding 'mirror image', i.e. the corresponding structure for the left foot is also shown). The medial reinforcing member 921 corresponds to the big toe/first metatarsal bone and 'curls in'

(cf. region 926) underneath the big toe to provide additional support for toe-off in this area.

The reinforcing members 921 and 923 corresponding to the first and third toe/metatarsal bone have a larger diameter than the remaining three reinforcing members 922, 924 and 925 to provide addition support by their increased stiffness to the first and third toe/metatarsal bone. If shaped tube-like (i.e. hollow or with hollow sections), the reinforcing members 921 and 923 can alternatively or additionally also have a larger wall thickness than the remaining three reinforcing members 922, 924 and 925.

The five reinforcing members 921, 922, 923, 924, 925 extend throughout the front half of the sole 900 and approximately up to the back edge of the arch region, where they are connected by a connecting member 928, which in the case at hand is also provided as rod-/tube-shaped member. Each of the five reinforcing members 921, 922, 923, 924, 925 is connected to the member 928 by a short passage 929 of reduced diameter. This connection at the back edge of the arch region can provide an additional degree of stability to this sensitive region of the foot, e.g. to help avoid injuries or fatigue of the wearer.

Figure 10A:
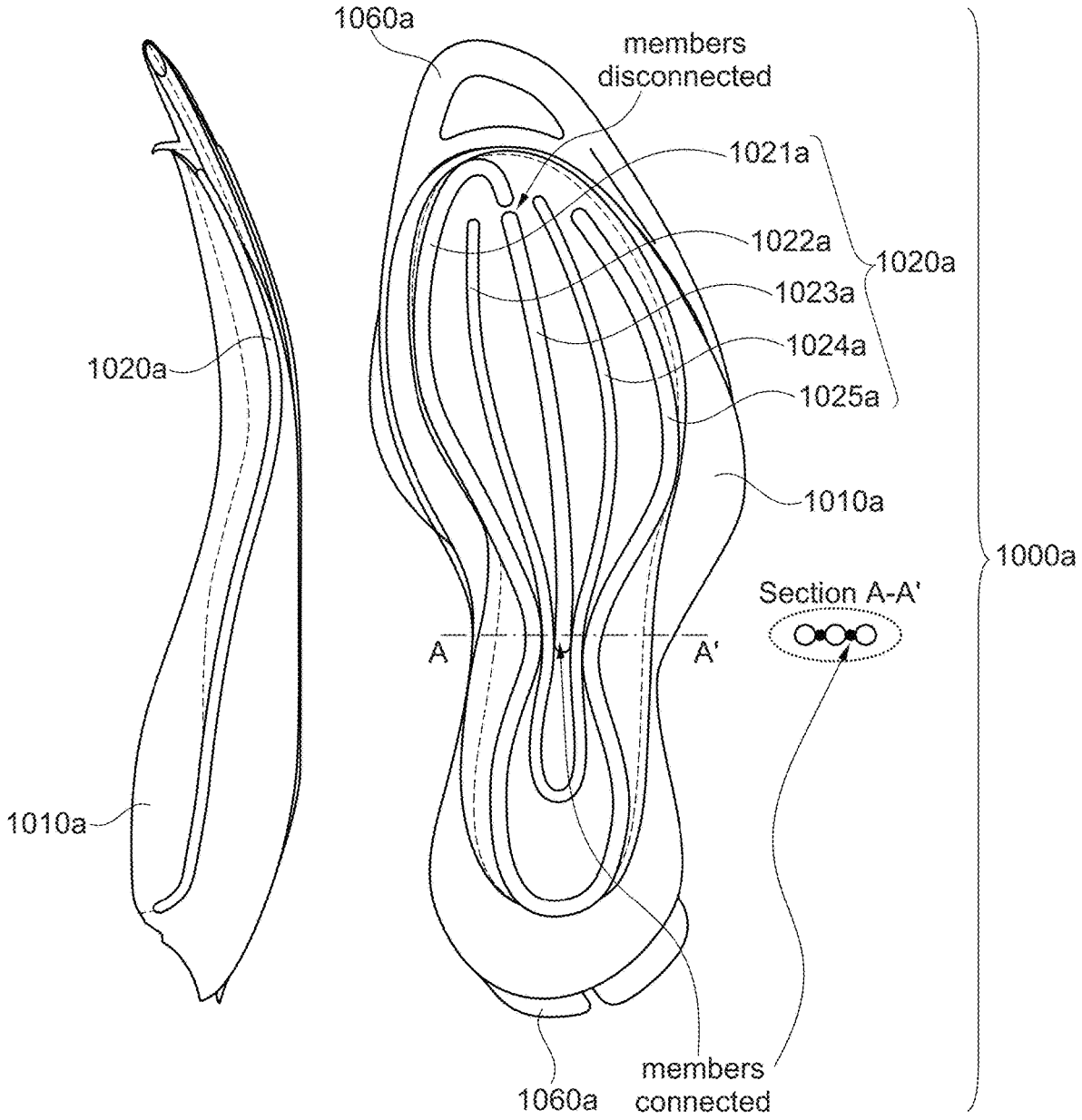
FIGS. 10*a-d* illustrate soles with different configurations of rod-/tube-shaped reinforcing members according to some embodiments.
Figure 10B:
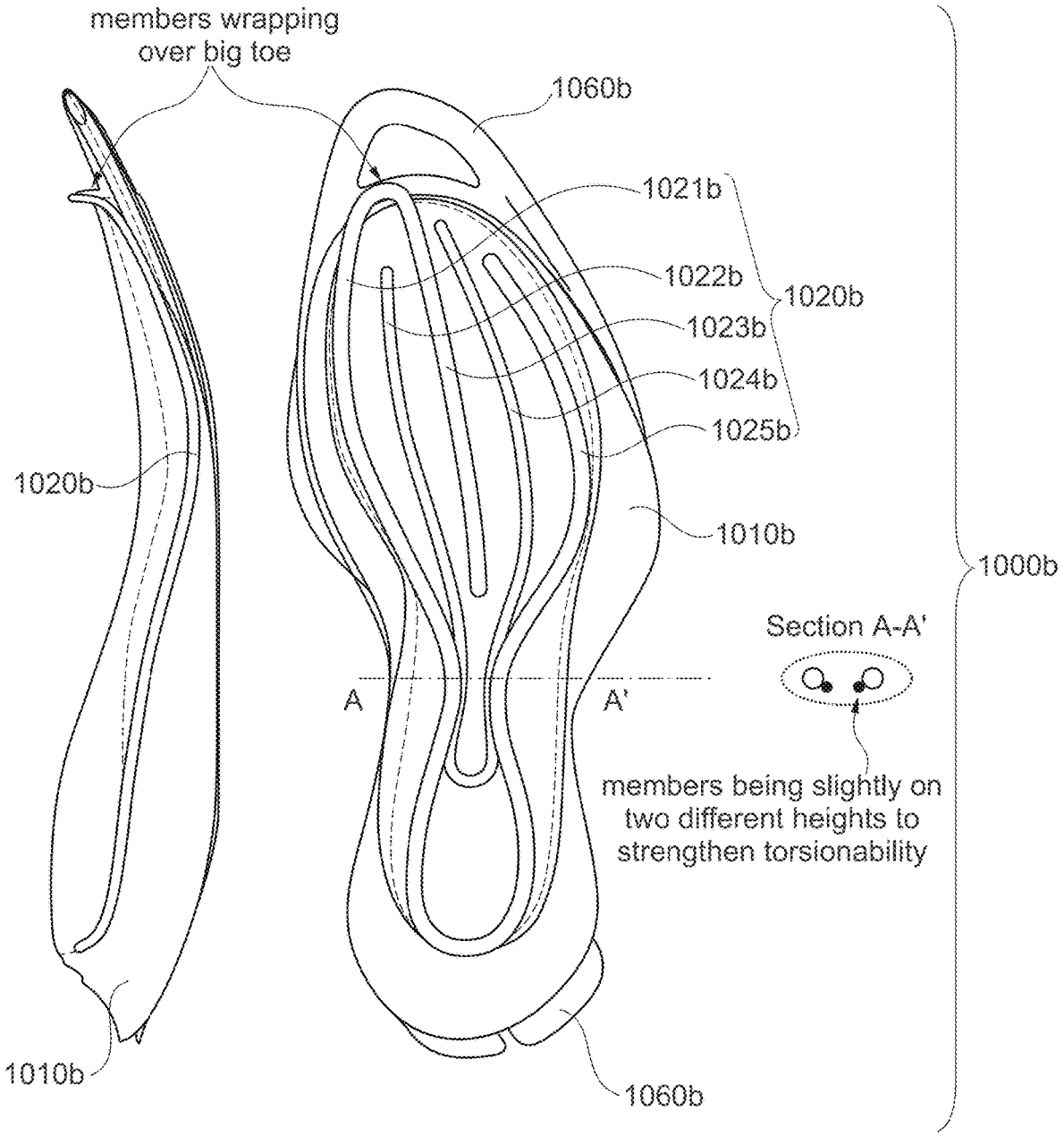
Figure 10C:
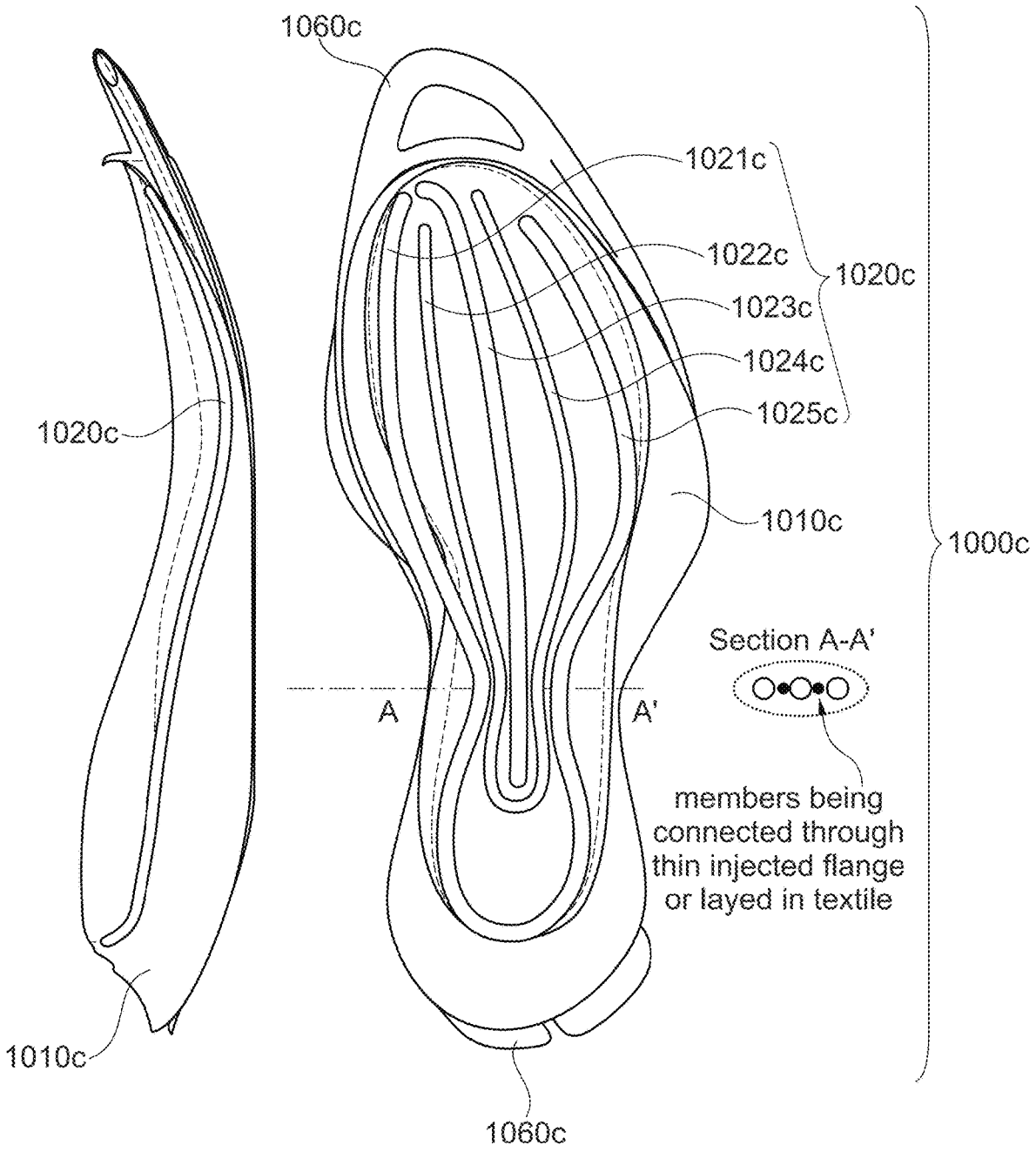
Figure 10D:
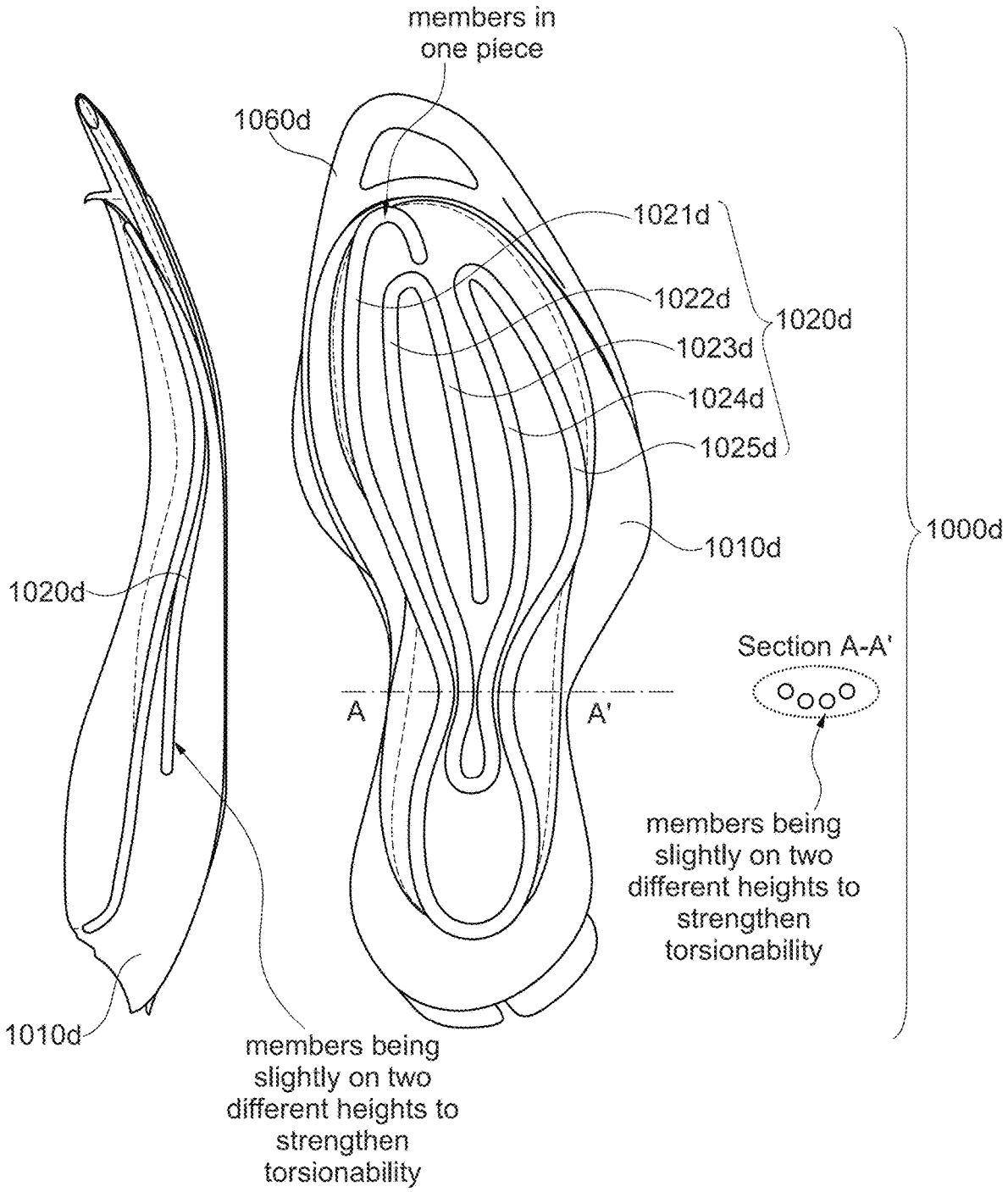

The soles 1000*a*, 1000*b*, 1000*c*, 1000*d* shown in FIGS. 10*a-d* again comprise a midsole 1010*a*, 1010*b*, 1010*c*, 1010*d*, which may be of any of the constructions and/or materials mentioned in this regard in the present disclosure (e.g., a particle and/or homogeneous foam material). The right-hand picture in each figure shows a top view of the respective sole 1000*a*, 1000*b*, 1000*c*, 1000*d*, and the left-hand picture a lateral side view. At least partially embedded within the midsoles 1010*a*, 1010*b*, 1010*c*, 1010*d* are respective reinforcing structures 1020*a*, 1020*b*, 1020*c*, 1020*d*. In some embodiments, at the toe end of the soles, the respective reinforcing structures 1020*a*, 1020*b*, 1020*c*, 1020*d* may also partially protrude from or be exposed e.g. at the bottom side of the midsole (s. FIGS. 10*a* and 10*b*), or at least be arranged in close proximity to the bottom surface of the midsole (s. FIGS. 10*c* and 10*d*).

Each of the reinforcing structure 1020*a*, 1020*b*, 1020*c*, 1020*d* comprises five reinforcing members 1021*a*, 1022*a*, 1023*a*, 1024*a*, 1025*a*, 1021*b*, 1022*b*, 1023*b*, 1024*b*, 1025*b*, 1021*c*, 1022*c*, 1023*c*, 1024*c*, 1025*c*, 1021*d*, 1022*d*, 1023*d*, 1024*d*, 1025*d*, respectively, extending throughout the front half of the sole 1000*a*, 1000*b*, 1000*c*, 1000*d* and each corresponding to a respective toe/metatarsal bone of the foot. The reinforcing members 1021*a*, 1022*a*, 1023*a*, 1024*a*, 1025*a*, 1021*b*, 1022*b*, 1023*b*, 1024*b*, 1025*b*, 1021*c*, 1022*c*, 1023*c*, 1024*c*, 1025*c*, 1021*d*, 1022*d*, 1023*d*, 1024*d*, 1025*d* also extend beyond the arch region and into the back half of the sole.

A peculiarity of the reinforcing structures 1020*a*, 1020*b*, 1020*c*, 1020*d* is that some, or even all, of the reinforcing members 1021*a*, 1022*a*, 1023*a*, 1024*a*, 1025*a*, 1021*b*, 1022*b*, 1023*b*, 1024*b*, 1025*b*, 1021*c*, 1022*c*, 1023*c*, 1024*c*, 1025*c*, 1021*d*, 1022*d*, 1023*d*, 1024*d*, 1025*d* are formed from a continuous rod or tube of material, i.e. the reinforcing members are connected to and merge into each other in certain regions of the sole, in particular in the region underneath the rearfoot/heel. Still, at least two of the reinforcing members of each sole 1000*a*, 1000*b*, 1000*c*, 1000*d* are independent from each other in the sense that they may react and deform independently under a pressure load during walking or running, in particular in the front half of the sole. See, e.g., the reinforcing members 1022*b*, 1024*b* and 1025*b* for FIG. 10*b* and the reinforcing members 1021*d* and 1023*d* for FIG. 10*d*. In FIGS. 10*a* and 10*c* all five reinforcing members are independent and unconnected in the front half of the sole.

In the reinforcing structures 1020*a*, 1020*b* and 1020*c*, the medial, lateral, and central reinforcing members (i.e., the reinforcing members 1021*a*, 1023*a*, 1025*a* and 1021*b*, 1023*b*, 1025*b* and 1021*c*, 1023*c*, 1025*c*) have a large diameter than the remaining two reinforcing members of the respective structure, and they are provided as hollow tubes, while the thinner two reinforcing members are provided as solid rods. See also the cross sections 10*a-c* taken in the arch region of each of the depicted soles 1000*a-c*.

In the reinforcing structure 1020*d* of FIG. 10*d*, all five reinforcing members 1021*d*, 1022*d*, 1023*d*, 1024*d*, 1025*d* are provided as tubes of the same diameter and wall thickness, see the cross section 10*d*. Here, the members 1022*d*, 1023*d* as well as 1024*d*, 1025*d* are also connected in the toe region, underneath the $2^{nd}$ & $3^{rd}$ and $4^{th}$ & $5^{th}$ metatarsal bone, respectively, to provide an additional support to these 'weaker' toes (compared to the big toe/$1^{st}$ metatarsal bone). A further feature of the structure is that the 'loop' connecting the reinforcing members 1022*d*, 1024*d* in the arch regions lies lower within the midsole 1010*d* than the 'loop' connecting the reinforcing members 1021*d*, 1025*d* (s. the left hand picture in FIG. 10*d*), hence providing a heel support that has a lower center and raised side rims, to provide a kind of heel cup the heel can settle into.

An outsole 1060*a*, 1060*b*, 1060*c*, 1060*d* that may be attached to the midsoles 1010*a*, 1010*b*, 1010*c*, 1010*d* is also schematically shown in FIGS. 10*a-d*.

FIGS. 11*a-f* show a reinforcing structure 1120 and a forefoot support plate 1190, according to some embodiments, that may be incorporated into embodiments of a sole according to the present disclosure, e.g. one of the soles 100-900 or 1000*a*, 1000*b*, 1000*c*, 1000*d* discussed so far in this detailed description.

Figure 11A:
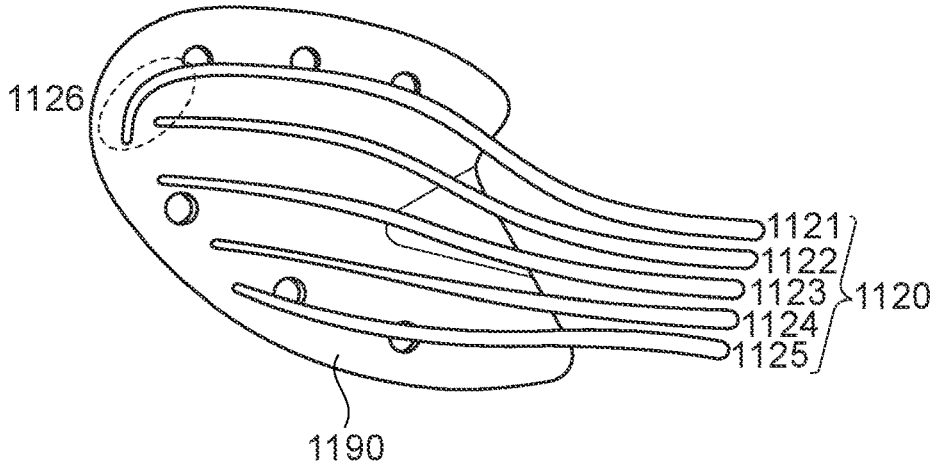
FIGS. 11*a-f* illustrate a sole with five rod-/tube-shaped reinforcing members and a forefoot support plate according to some embodiments.
Figure 11B:
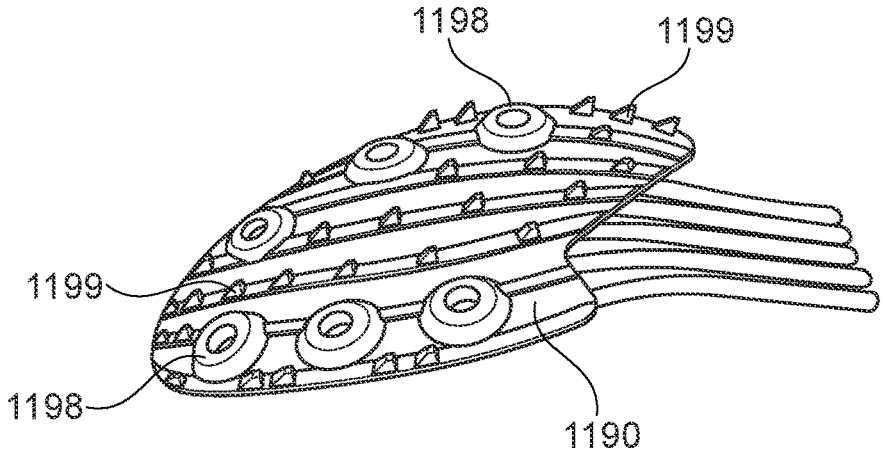
Figure 11C:
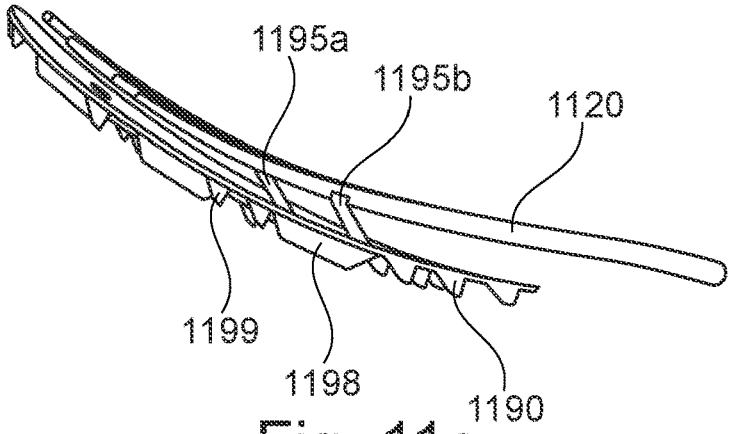
Figure 11D:
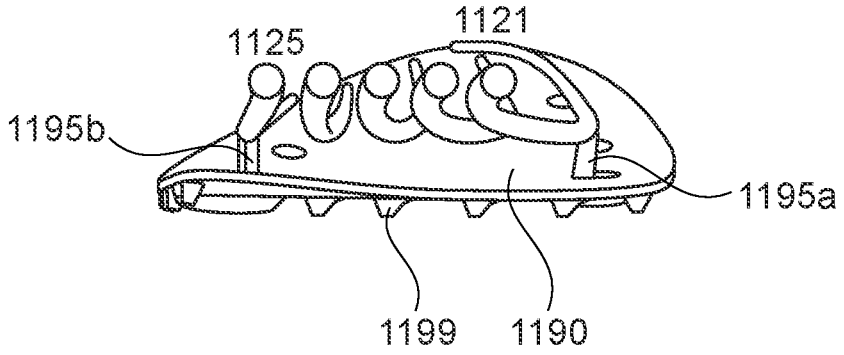
Figure 11E:
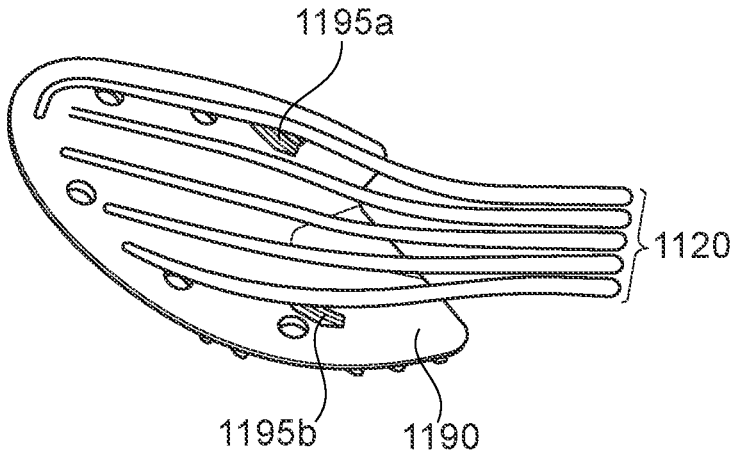
Figure 11F:
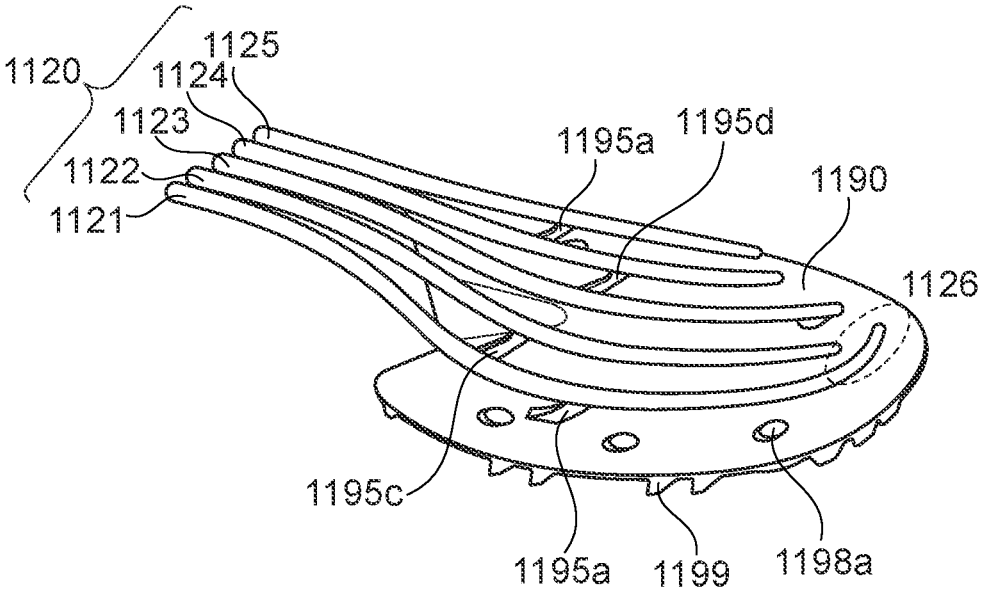

FIG. 11*a* shows a top view, FIG. 11*b* a bottom view, FIG. 11*c* a lateral side view, FIG. 11*d* a rear view, and FIG. 11*e* a tilted lateral side view of the reinforcing structure 1120 and a forefoot support plate 1190 with connectors 1195*a*, 1195*b* between the two. FIG. 11*f* shows a tilted medial side view of a modification of the reinforcing structure 1120 and forefoot support plate 1190 with an increased number of connectors 1195*a*, 1195*bb*, 1195*c*, 1195*d* between the two.

The reinforcing structure 1120 has five reinforcing members 1121, 1122, 1123, 1124, 1125, each corresponding to one toe/metatarsal bone of the foot. The reinforcing member 1121 corresponding to the big toe/first metatarsal bone also 'curls in' underneath the big toe (cf. the region 1126), to provide additional support for toe-off, as already discussed numerous times. In some embodiments, all of the reinforcing members 1121, 1122, 1123, 1124, 1125 have more or less (e.g. within a few percent, say within 10%, or 5%, or 2%) the same diameter (understood, e.g., as their diameter at a certain cross-sectional plane or longitudinal position along the sole, or as their average diameter along their extension). In other case, that may be different, though. Also, if the reinforcing members 1121, 1122, 1123, 1124, 1125 are provided tube-shaped, i.e. have at least some hollow sections, their wall thickness may also vary. For example, the wall thickness of the members 1121 and 1123 may be larger, making them stiffer than the remaining members, as already discussed.

In other respects, the reinforcing structure 1120 is similar to, for example, the reinforcing structures 120, 220 or 920, and reference is therefore made to the corresponding statements above, for conciseness.

The forefoot support plate 1190 is arranged beneath the reinforcing structure 1120 in the present case (it may in principle also be arranged above it), and in the shown examples it also acts as an outsole or part of the outsole in the forefoot region of the sole. The forefoot support plate 1190 may, for example, be made from, or comprise a fiber-reinforced low-weight material to provide increased stiffness for a dynamic and efficient push-off, for example for running- or sprinting shoes.

To further facilitate such a dynamic push-off and fast movements, the forefoot support plate 1190 of the shown examples comprises both profile elements 1199 to improve traction, as well as grommets or sockets 1198 into which spikes or cleats (not shown) may be mounted (removably or permanently). In some embodiments, for example, as shown in FIG. 11*f*, each socket 1198 is further fitted with a (e.g., plastic or metal) thread 1198*a* for such spikes to cleats to be removably screwed into.

In FIGS. 11*a-e*, the medial and lateral reinforcing members 1121 and 1125 are connected to the forefoot support plate 1190 by two connectors or wings 1195*a* and 1195*b*, respectively. In some embodiments, for example, as shown in FIG. 11*f*, there are additional connectors 1195*c* and 1195*d* between the reinforcing members 1122 and 1124, respectively, and the forefoot support plate 1190. These connectors serve, for example, the purpose of further increasing the mechanical coupling and general rigidity of the forefoot support construction provided by the reinforcing structure 1120 and forefoot support plate 1190, and hence facilitate the transmission of high push-off force from the leg and foot to the ground.

What is not shown in FIG. 11*a-f*, for clarity of exposition, is the midsole material that will generally be arranged between the forefoot support plate 1190 and the reinforcing members 1121, 1122, 1123, 1124, 1125, and into which the reinforcing members 1121, 1122, 1123, 1124, 1125 will generally be at least partially embedded, as already discussed. Reference is therefore made in this regard to the explanations already given herein, for conciseness.

FIGS. 12*a-i* show a sole 1200 (or parts thereof), according to some embodiments, having at least two reinforcing members extending in a front half of the sole, wherein at least a first one of the reinforcing members further extends rearwardly beyond the midfoot area and into a heel area of the sole and wraps up to a posterior portion of the ankle region.

Figure 12A:
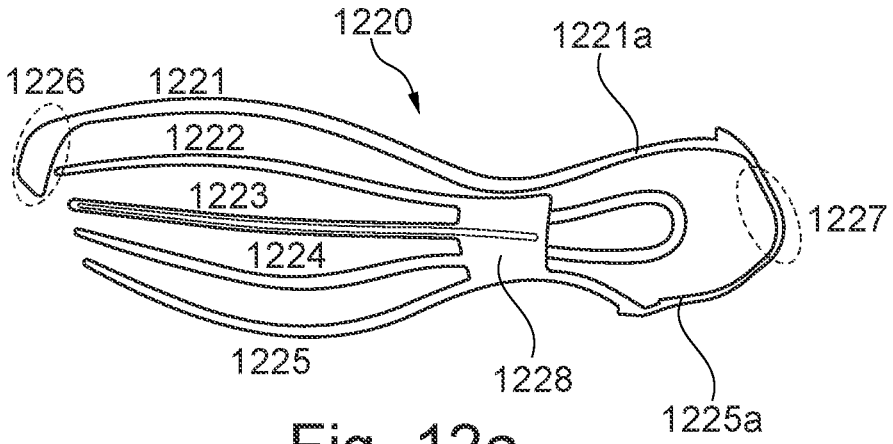
FIGS. 12*a*-I illustrate a sole with five reinforcing members of which two extend rearwardly beyond the midfoot area and into a heel area of the sole, wrap up to a posterior portion of the ankle region, and are connected behind the heel to form a heel support according to some embodiments.
Figure 12B:
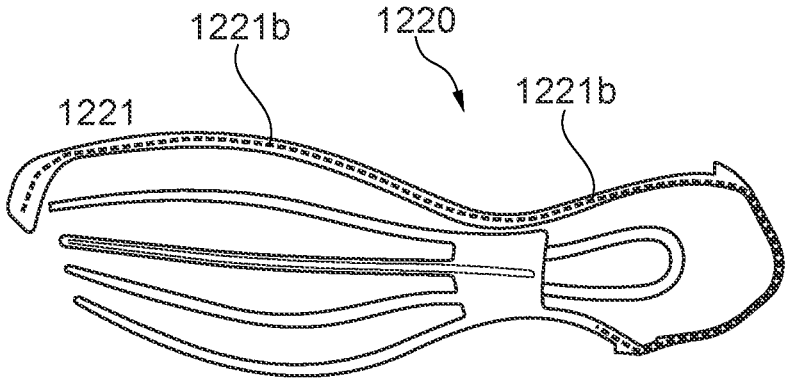
Figure 12C:
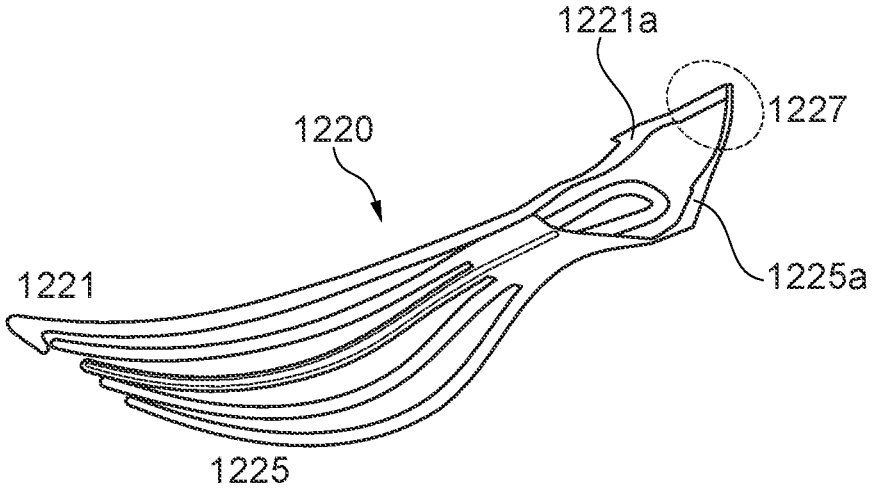
Figure 12D:
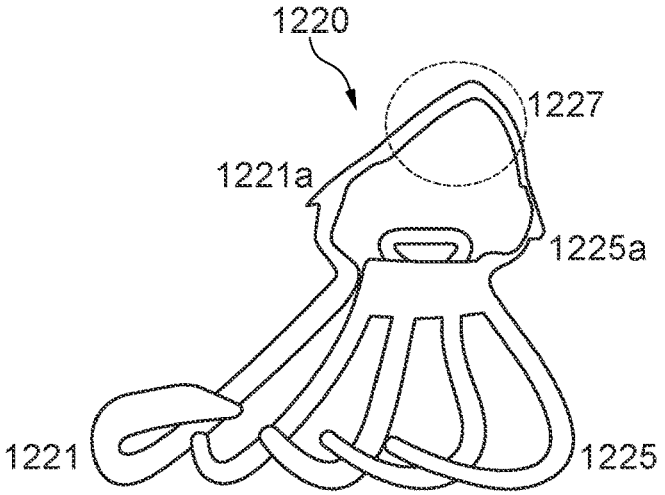
Figure 12E:
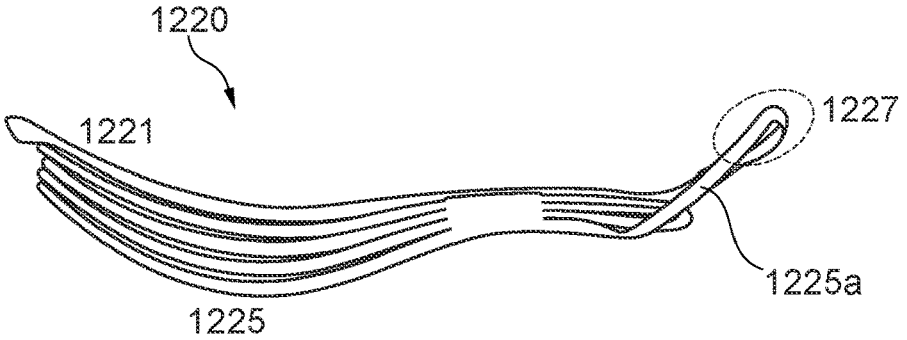
Figure 12F:
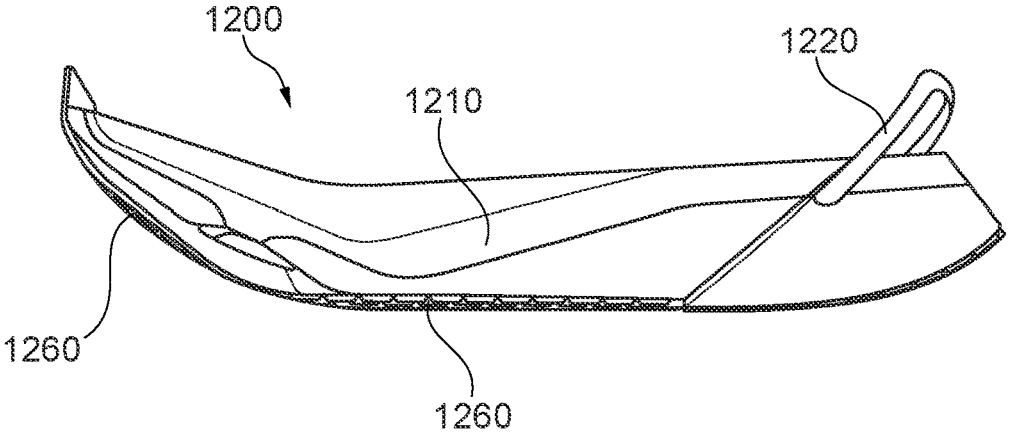
Figure 12G:
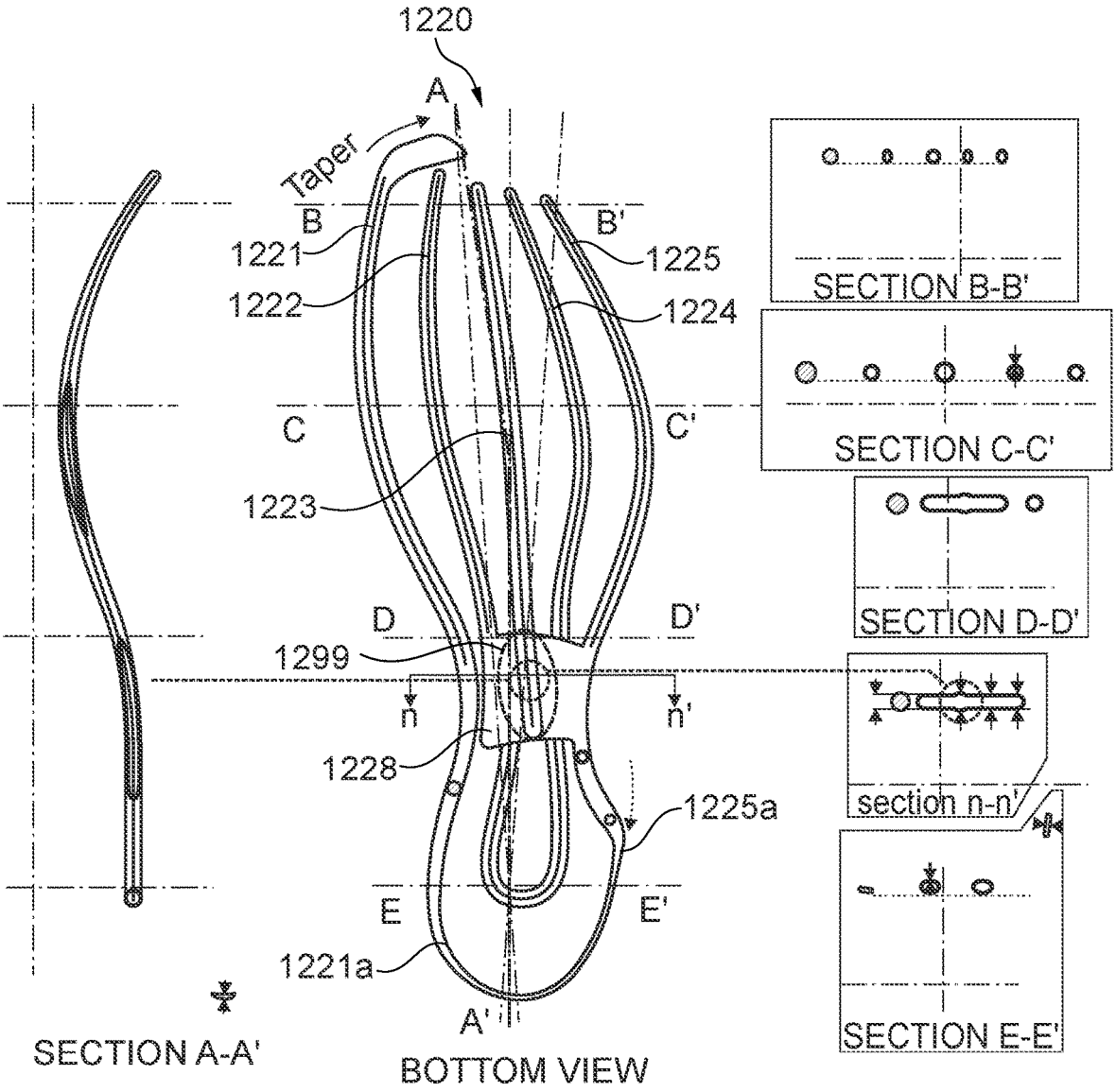
Figure 12H:
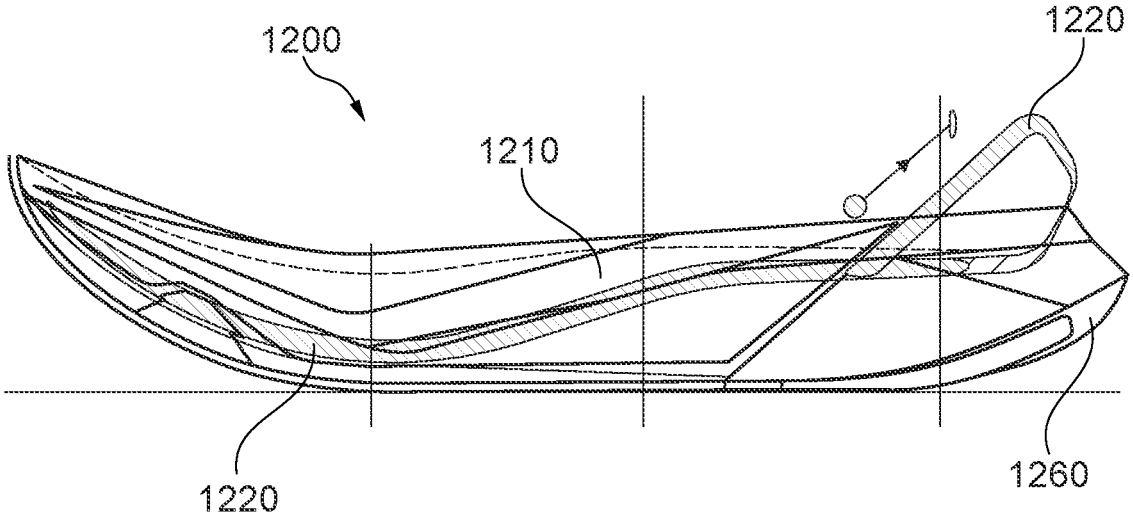
Figure 12I:
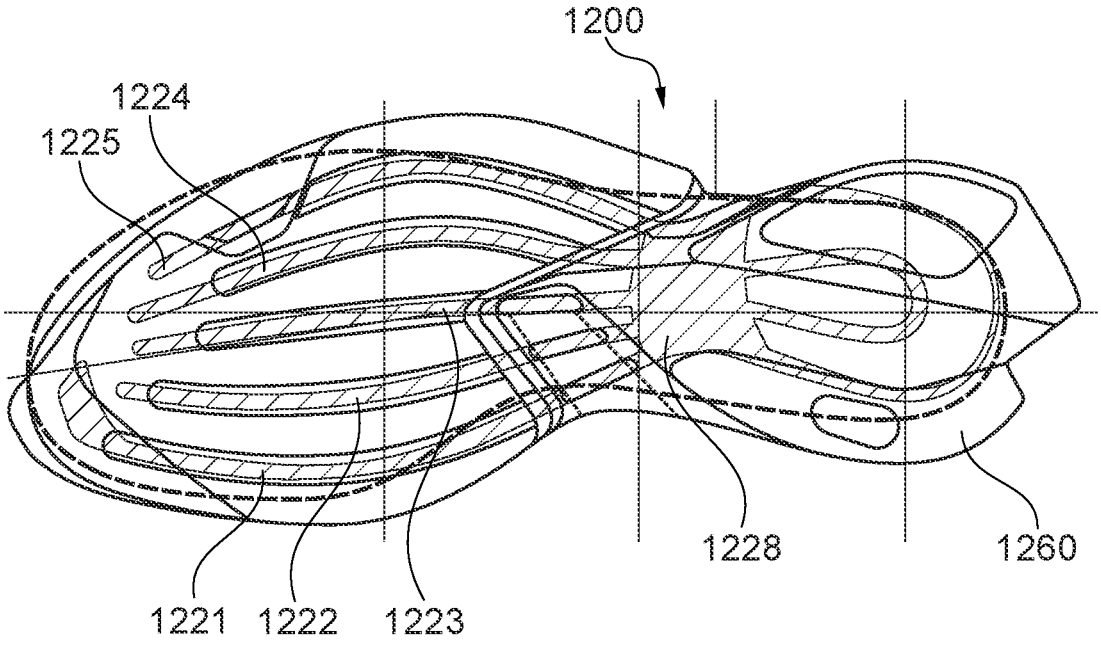

FIGS. 12*a* and 12*b* show a top view of the reinforcing structure 1220 of this sole 1200, FIG. 12*c* a tilted lateral side view, FIG. 12*d* a front view, FIG. 12*e* another tilted lateral side view, FIG. 12*f* an example of the reinforcing structure 1220 being embedded within a midsole 1210, and FIGS. 12*g*, 12*h* and 12*i* show constructional drawings pertaining to the shown embodiment.

It is once again pointed out that everything that has been said or disclosed so far, in particular with regard to the embodiments and examples of FIGS. 1*a*-11*f*, may also apply (if not physically or technically impossible, of course) to the embodiments and examples described and disclosed in the following, even if not explicitly discussed in every detail.

The sole 1200 comprises a reinforcing structure 1220 containing five reinforcing members 1221, 1222, 1223, 1224, 1225 extending in the front half of the sole 1200 and each corresponding to a toe/metatarsal bone of the foot (however, in some embodiments a smaller or larger number of reinforcing members is also possible, e.g. 2, 3, 4 or 6 or 7 reinforcing members).

A first, medial reinforcing member 1221 corresponds to the big toe/first metatarsal bone. A second, later reinforcing member 1225 corresponds to the $5^{th}$ metatarsal bone. Between these two, three reinforcing members 1222, 1223 and 1224 are arranged, corresponding to the $2^{nd}$, $3^{rd}$ and $4^{th}$ metatarsal bone, respectively.

The first, medial reinforcing member 1221 comprises a flattened or taper tip that extends towards the front edge/tip of the sole 1200 (cf., e.g., FIGS. 12*h* and 12*i*) and 'curls in' underneath the big toe (cf. the region 1226), to provide additional support for toe-off.

The reinforcing members 1221 and 1223 corresponding to the $1^{st}$ and $3^{rd}$ metatarsal bones have a larger diameter as the remaining three reinforcing members 1222, 1224 and 1225. This can be seen from FIG. 12*g*, where several cross-sections through the reinforcing structure 1220 are shown. Going from medial to lateral (i.e. from member 1221 to member 1225), the indicated diameters of the five reinforcing members are: at their tips just in front of cross section B-B' 4 mm, 3 mm, 4 mm, 3 mm and 3 mm; around the region of cross section C-C' 6 mm, 5 mm, 6 mm, 5 mm and 5 mm; just in front of cross section D-D': 6 mm, 5 mm, 6 mm, 5 mm and 5 mm. At every longitudinal position along the sole 1200, the reinforcing members 1221 and 1223 are therefore thicker, and hence stiffer and more resistant to deformation that the other members (a wall thickness of 1 mm is also indicated for some sections of the reinforcing members in FIG. 12*g*). However, the wall thickness is another parameter besides the diameter that may be varied among the reinforcing members 1221, 1222, 1223, 1224, 1225 and/or along a given reinforcing member to change and influence their physical properties.

In the region of the arch of the foot, the reinforcing members 1222, 1223, 1224, 1225 are further connected by a hollow connection region 1228 with a central surface bulge (s. the cross-section n-n' in FIG. 12*g*) to provide additional support and stability to this region of the sole 1200.

It is pointed out that in the center of the hollow connection region 1228, in the area indicated by the ellipse 1299, the dashed lines do not indicate a separate tube-shaped member, but a surface bulge on the hollow connection region 1228 which is slightly higher (6 mm) than the rest of this hollow midfoot connection region 1228 (5 mm) (s. also the cross section n-n').

The first, medial reinforcing member 1221 and the second, lateral reinforcing member 1225 further extends rearwardly beyond the midfoot area and into the heel area of the sole and form sections 1221*a* and 1225*a*, respectively, that wrap up to the posterior portion of the ankle region and merge into each other behind the heel in region 1227 (s. FIGS. 12*c*, 12*d*, 12*e*, 12*f* and 12*h* for information about the three-dimensional configuration of this region). In this manner, a support structure for the heel of a wearer is provided that 'locks the heel in place' and allows for a particular good transmission of forces and an increased lever during push-off and a sufficient stabilization of the foot.

To further promote this effect, and while most of the reinforcing members may be provided as hollow members, i.e. tube-shaped (cf. the cross-sections in FIG. 12*g*), the first reinforcing member 1221 can be provided as a solid member, i.e. rod-shaped. This is indicated in FIG. 12*b* by the dashed line 1221*b*, showing the (approximate) extension of this solid section of the reinforcing structure 1220. As mentioned, the remaining parts may be provided as hollow structures (although not absolutely necessary), e.g. to save weight.

Irrespective of the additional support provided by the sections 1221*a* and 1225*a* and heel support where the two are joined in the region 1227, the reinforcing members 1221, 1222, 1223, 1224, 1225 are still adapted to be independently deflected by forces acting on the sole during a gait cycle in the front half of the sole 1200, so that the corresponding advantages, which have already been discussed in detail, are not lost.

Finally, as already mentioned, FIGS. 12*f*, 12*h* and 12*i* shown examples of how the reinforcing structure 1220 may be implemented into and embedded within a midsole 1210 of the sole, and how it may be arranged in relation to the midsole 1210 and a potential outsole 1260.

Figure 13:
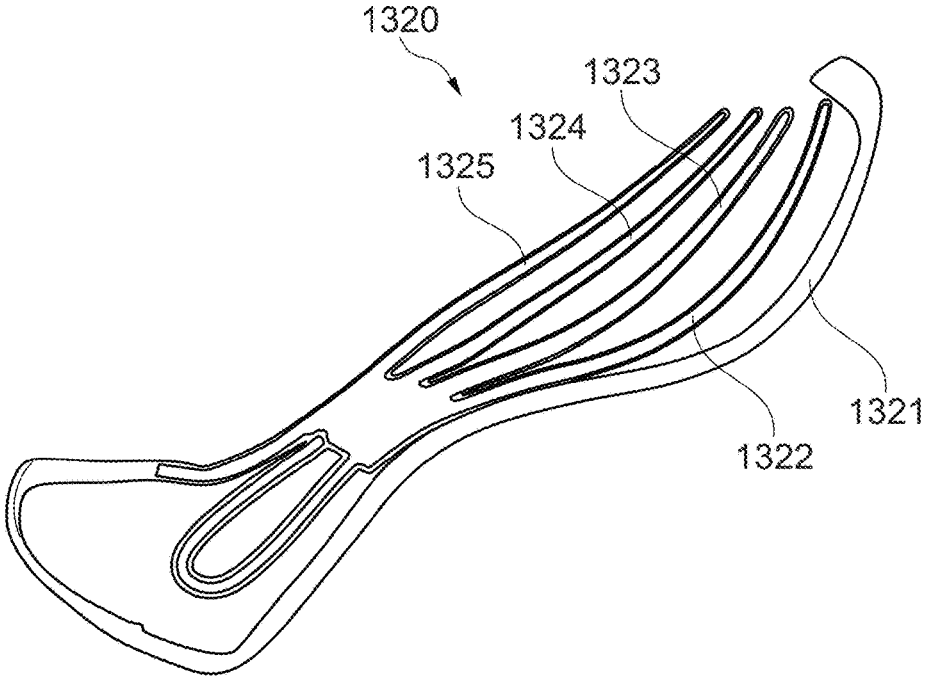
FIG. 13 illustrates a sole with five reinforcing members of which two extend rearwardly beyond the midfoot area and into a heel area of the sole, wrap up to a posterior portion of the ankle region, and are connected behind the heel to form a heel support according to some embodiments.

FIG. 13 shows another example of a reinforcing structure 1320 quite similar to the reinforcing structure 1220, in a tilted medial side view. It contains five reinforcing members 1321, 1322, 1323, 1324, 1325 and all of the statements made above with regard to the reinforcing members 1221-1225 generally also apply to the reinforcing members 1321, 1322, 1323, 1324, 1325. In reinforcing structure 1320, as shown in FIG. 13, however, the core of the reinforcing members 1322, 1323, 1324, 1325 is filled with a filling (e.g. plastic or metal) material, as indicated by the different color compared to the reinforcing member 1321 in FIG. 13.

Figure 14:
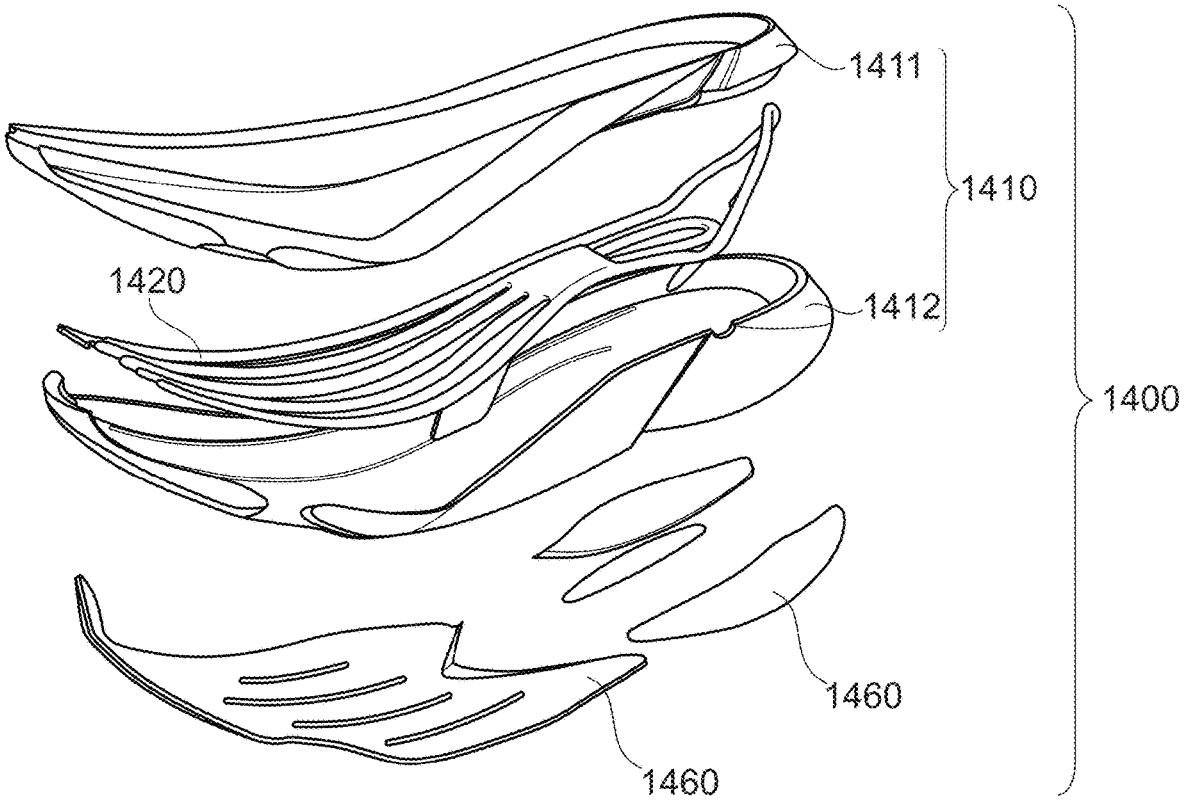
FIG. 14 illustrates a sole with five reinforcing members of which two extend rearwardly beyond the midfoot area and into a heel area of the sole, wrap up to a posterior portion of the ankle region, and are connected behind the heel to form a heel support according to some embodiments.

A sole 1400, according to some embodiments, is shown in FIG. 14 in an exploded view. Sole 1400 includes a reinforcing structure 1420, which may e.g. be the reinforcing structure 1220 or 1320 just discussed. All of what has been said about the corresponding members, elements and components of the reinforcing structures 1220 and 1320 therefore also applies to the reinforcing structure 1420 (unless physically or technically ruled out, of course) and is therefore not repeated.

The sole 1400 comprises a midsole 1410 with an upper midsole part 1411 and a lower midsole part 1412, between which reinforcing structure 1420 is positioned. It is completely embedded within the midsole 1410. The sole also comprises an outsole 1460, which in the embodiment shown here comprises several individual sub-parts (this need not always be the case, however).

With regard to the different midsole parts 1411, 1412, the outsole 1460 and possible details and materials etc. that may be used in this regard, reference is in particular made to the corresponding statements and explanations given with regard to these components in relation with FIGS. 1*a-f*, 2, 3*a-b*, 4, 5*a-b*, 6*a-d*, 7*a-b*, 8*a-b* and 9*a*, which apply analogously here and are therefore not repeated again.

Figure 15A:
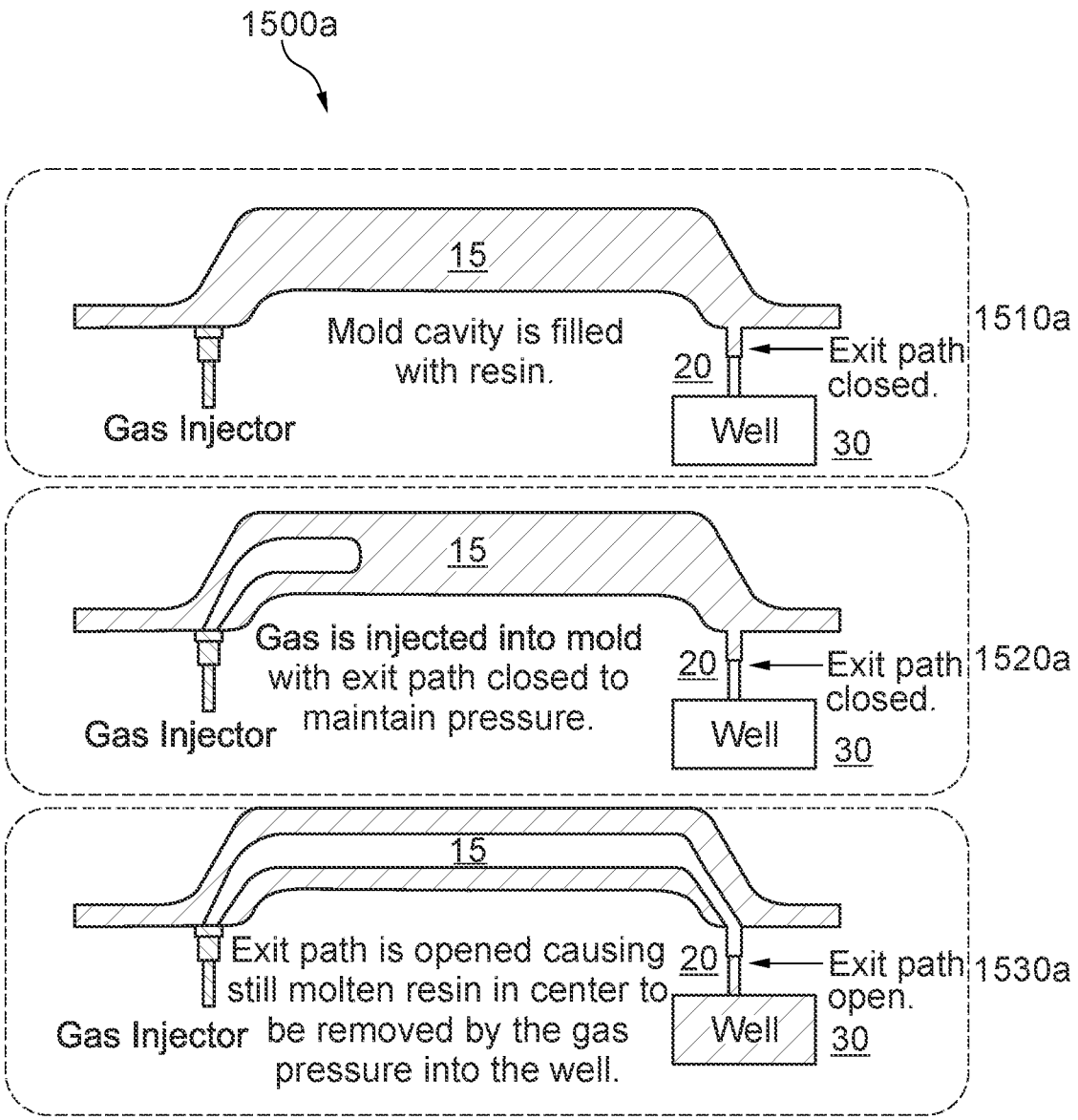
FIGS. 15*a-b* illustrate a method for the manufacture of a reinforcing member comprising a hollow section according to some embodiments.
Figure 15B:
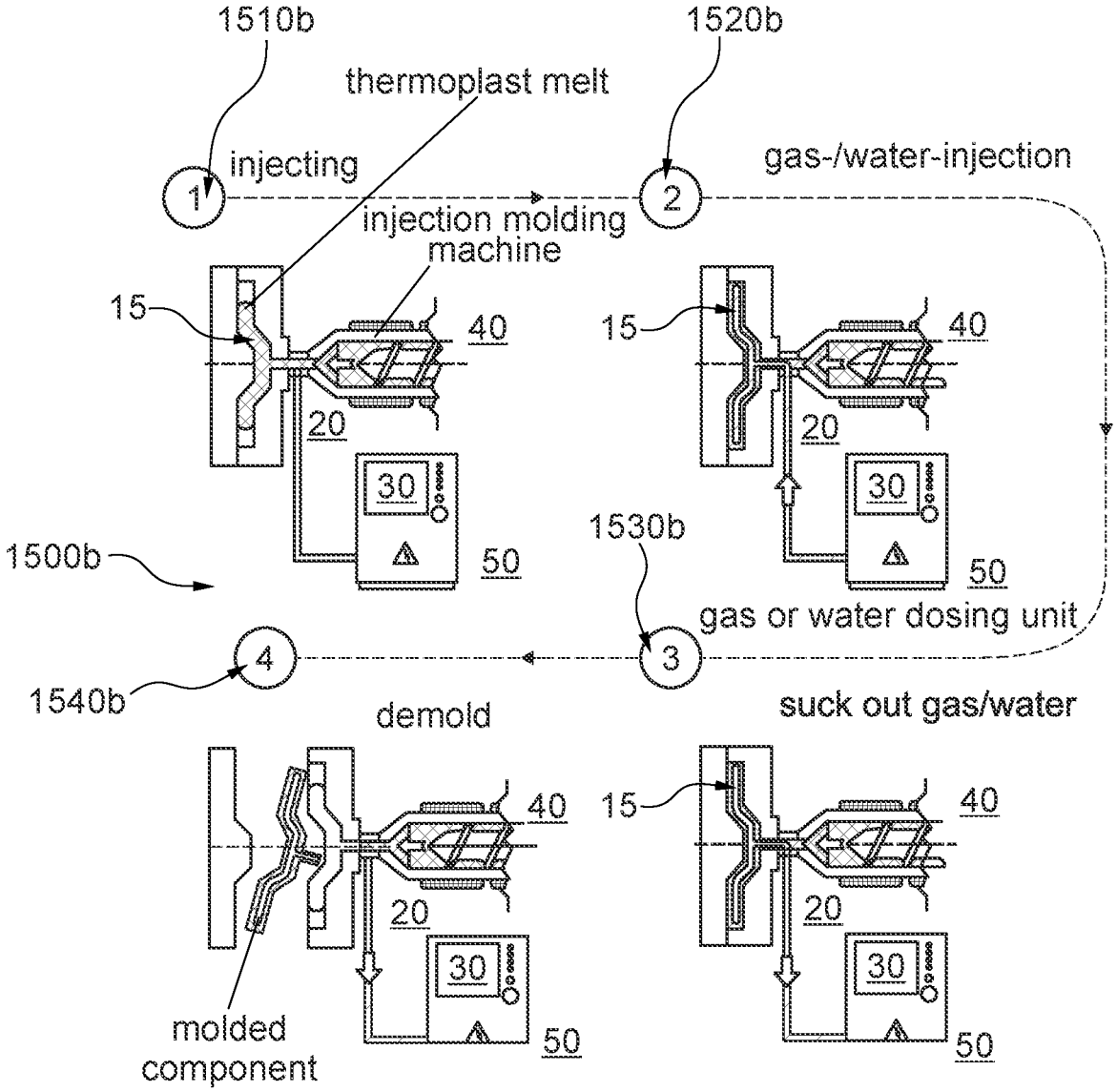

FIGS. 15*a-b* show methods 1500*a* and 1500*b* for the manufacture of a reinforcing structure or part of a reinforcing structure for a shoe sole with at least one reinforcing member with a hollow section, for example the manufacture of any of the reinforcing structures 120, 220, 320, 420, 720, 820, 1020, 1120, 1220, 1320, 1420 or hollow part thereof discussed herein so far.

The following discussion will focus on the manufacture of one single hollow section of such a reinforcing structure for clarity of exposition, but the skilled person will understand that the method may also be expanded to the manufacture of several such hollows section, potentially in combination with solid/non-hollow sections, on a single machine and in a single go. The component obtained by the method may, of course, also be subsequently joined, glued, connected etc. to other components or parts to for the reinforcing structure if need be. Details about such steps will not be the focus of the following discussion, however.

The method 1500*a* comprises the step of injecting a liquid molding material into a molding cavity 15 of a mold, the molding cavity 15 having a shape corresponding to the outer dimensions of the reinforcing member with the hollow section that is to be manufactured (as mentioned, for clarity of exposition, the simple case the one hollow reinforcing member is manufactured is discussed here and shown in FIGS. 15*a* and 15*b*, but the generalization to and modifications necessary for more complicated configurations are clear to the skilled person). The result of this step is shown at reference 1510*a* in FIG. 15*a* where the molding cavity 15 is filled with the (still liquid) molding material.

The liquid molding material may be a plastic material suitable for injection molding, e.g., EVA or TPU or some other material known to the skilled person of that purpose.

The method further comprises, see reference 1520*a* in FIG. 15*a*, the step of injecting a displacement gas into the molding cavity under pressure. Instead of a displacement gas, also a displacement liquid could be sued, as explained below in relation to FIG. 15*b*. The displacement gas can be air or nitrogen, for example, or another gas which may be inert in the sense that it does not react with the liquid injection material but simply displaces it and pushes the injected material against the walls of the molding cavity 15.

To achieve this displacement of the injected material, during the above two steps. An exit path 20 leading to an outlet well 30 is closed, such that the gas pressure mounts and can be maintain within the molding cavity 15.

Once a sufficient amount of gas has been injected and a sufficient gas pressure been established, the exit path 20 is opened such that the pressurized displacement gas 'washes out' the still liquid material from the center of the molding cavity 15 and into the outlet well 30, see reference 1530*a* in FIG. 15*a*, thus creating a hollow tube of injected material in the molding cavity 15 that then solidifies to form the hollow section of the reinforcing member.

FIG. 15*b* shows a modified method 1500*b* wherein the exit path 20 for removing the displacement medium from the molding cavity is also used as an injection path for the medium, so that the medium itself closes the exit path 20 during its injection under pressure into the molding cavity 15, which can simplify the operation of the machine.

At reference 1510*b*, a liquid material is injection molded by an injection molding machine 40 into a molding cavity 15 having a shape corresponding to the outer dimensions of the reinforcing member with the hollow section that is to be manufacture.

At reference 1520*b*, the method 1500*b* comprises injecting a displacement gas or liquid (e.g., water) into the molding cavity 15 under pressure. In the present case, this is done via an inlet path 20 that will also be used as exit path to wash out the liquid material from the center of the molding cavity 15. Since the displacement medium is injected via the path 20 into the molding cavity 15 under pressure, the medium itself seals off the path 20 as long as the injection pressure is kept up, and no additional valve or outline line is needed in this case.

This is done at reference 1530*b*, where the displacement gas or liquid is removed again from the molding cavity 15 via the path 20 and into an outlet well 30 within a corresponding unit 50, 'taking with it' the liquid material still present in the center of the molding cavity 15 at this point in time.

Prior to the removal at reference 1530*b*, the injected molding material may be allowed to set or cure at least partially within the molding cavity 15, particularly at the walls of the molding cavity 15 (which may, e.g., be heated for this purpose), while the material in the center is still kept in the liquid phase. This facilitates the removal of the unwanted molding material in the center of the molding cavity along with the removal of the displacement medium (this option also applies to the embodiment 1500*a* discussed above).

Afterwards, the component may be allowed to set and cure (e.g., while being actively cooled), and then be demolded, see reference 1540*b* in FIG. 15*b*.

Figure 16A:
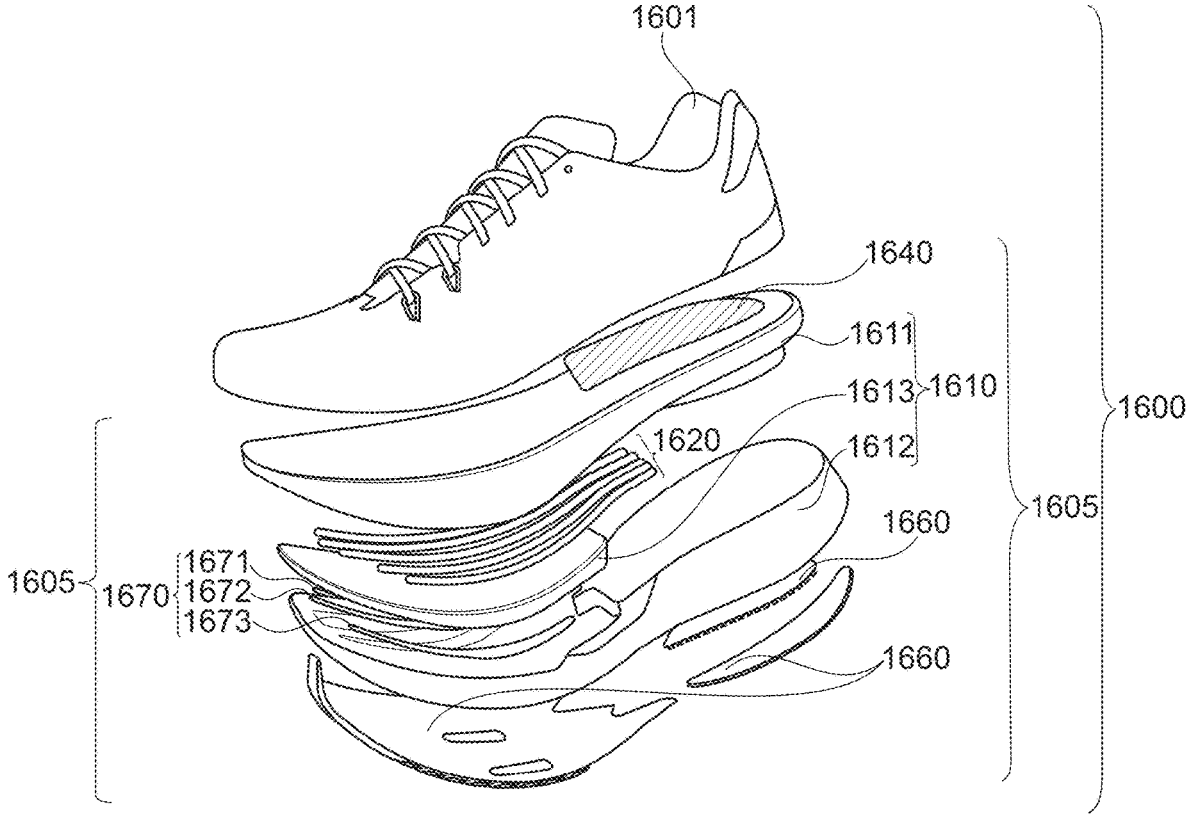
FIGS. 16*a-e* illustrate a sole with five rod-/tube-shaped reinforcing members and three blade members according to some embodiments.
Figure 16B:
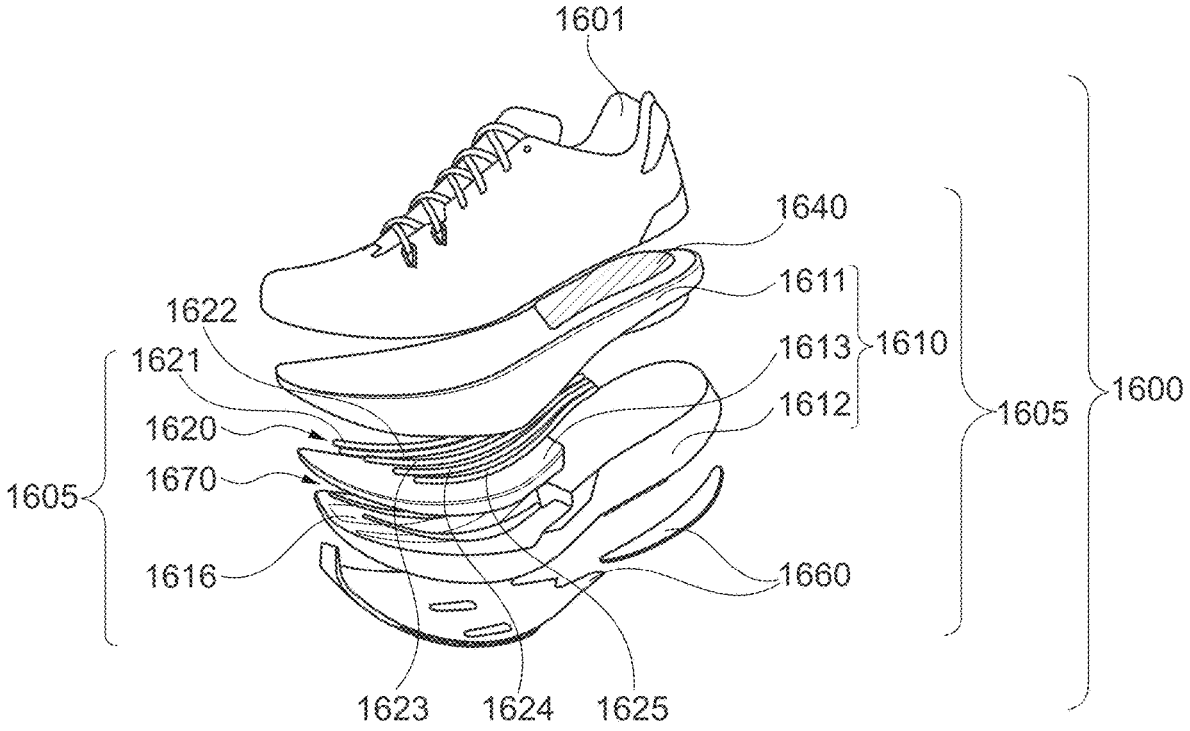
Figure 16C:
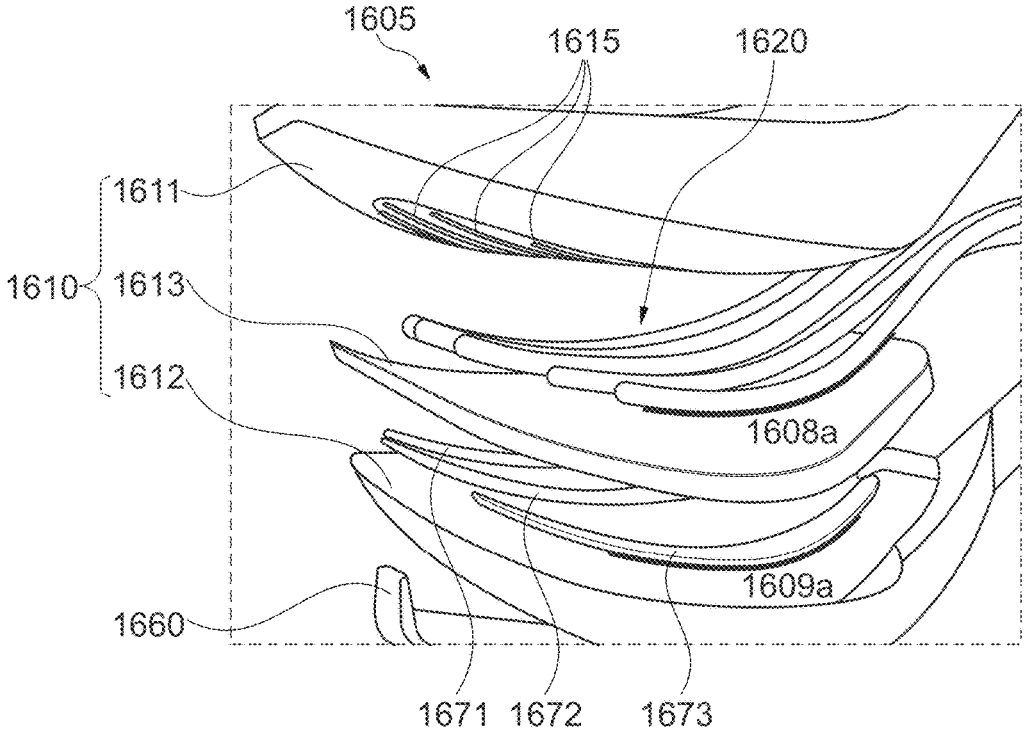
Figure 16D:
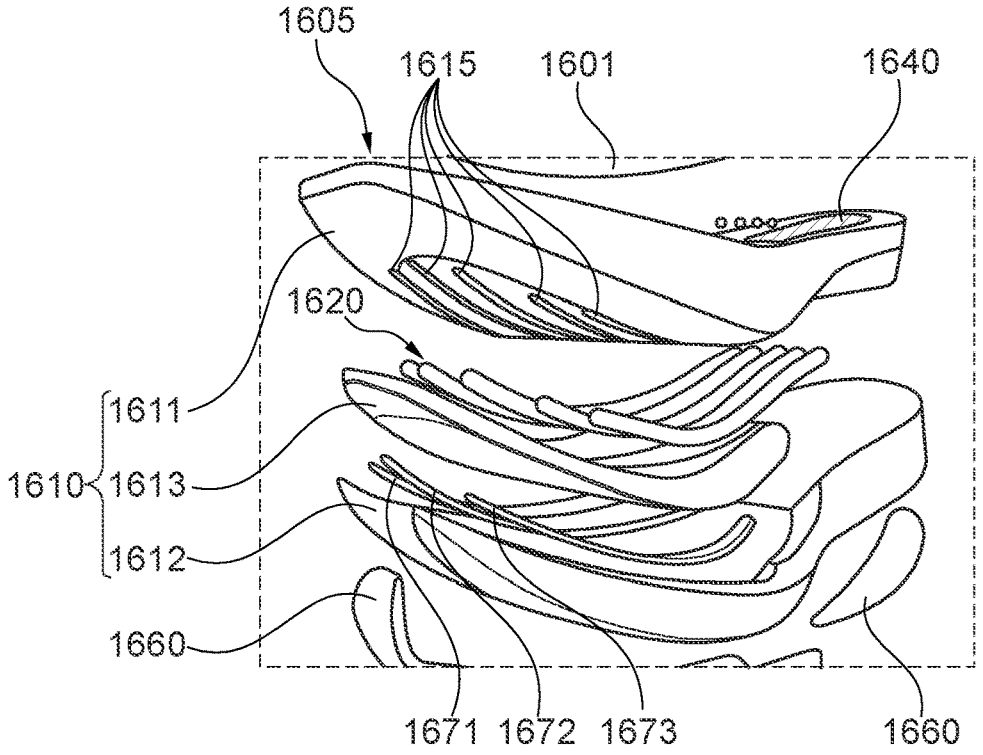
Figure 16E:
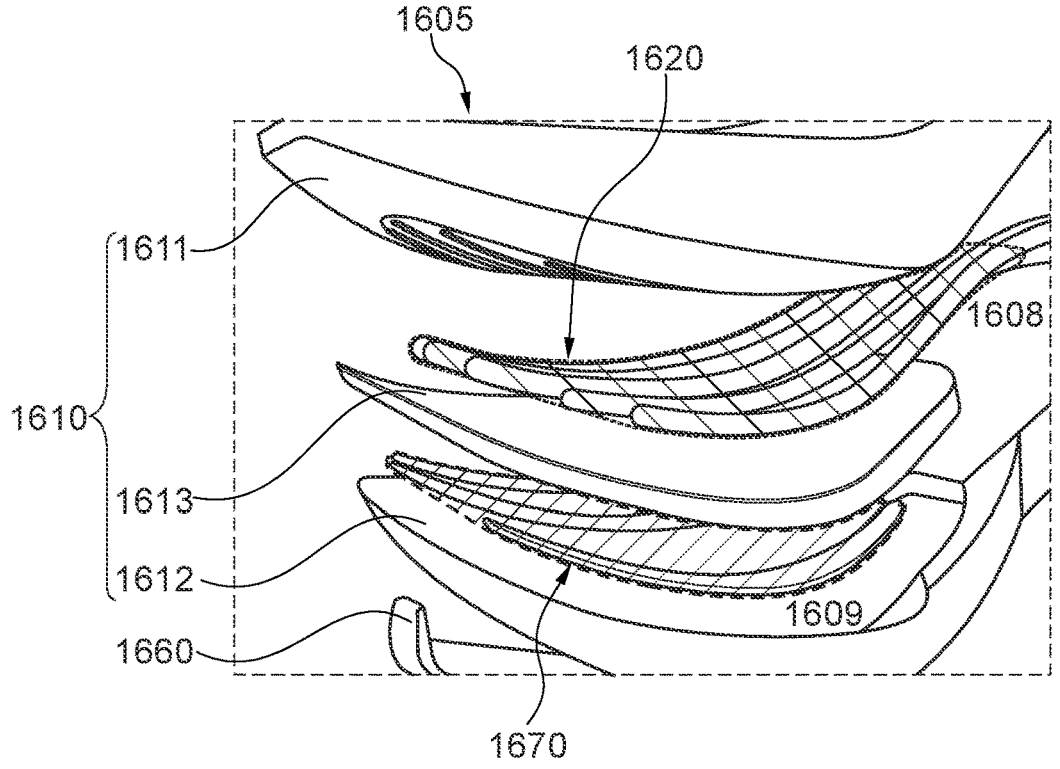

FIGS. 16*a-e* show a shoe 1600, or parts thereof, of a shoe according to some embodiments the present disclosure, from different view angles. FIGS. 16*a* and 16*b* show an exploded view of the entire shoe 1600, from the lateral side and from two slightly different angles. FIGS. 16*c* and 16*d* show close-up views of the front of the sole 1605 of the shoe 1600. FIG. 16*e* illustrates the concept of the first and second layer used in the discussion herein.

The shoe 1600 comprises an upper 1601, which will not be discussed in further detail herein. The shoe 1600 further comprises a sole 1605 with a midsole 1610 with an upper midsole part 1611, a lower midsole part 1612 and an intermediary midsole part 1613. Fully embedded within the midsole 1610 is a reinforcing structure 1620 comprising five rod-shaped and/or tube-shaped reinforcing members, individually referenced by reference numerals 1621, 1622, 1623, 1624, 1625. The five reinforcing members 1621, 1622, 1623, 1624, 1625 each correspond to a respective metatarsal bone. The sole 1605 of the shoe 1600 further comprises a load distribution member 1640 partially embedded within the top side of the upper midsole part 1611. The upper midsole part 1611 thus separates the reinforcing members 1621, 1622, 1623, 1624, 1625 from the load distribution member 1640, i.e., the reinforcing members 1621-1625 on the one hand and the load distribution member 1640 on the other hand are provided as separate and individual elements. The load distribution member 1640 and the upper midsole part 1611 may further be covered by a sock-liner (not shown), which may be replaceable or permanently connected to the load distribution member 1640 and the upper midsole part 1611. The sole 1605 of the shoe 1600 also comprises an outsole 1660, to improve traction and wear resistance. The shoe 1600 may also be fitted with cleats and/or spikes, to make it suitable for track-and-field activities, for example. The shoe 1600 may be a sports shoe, in particular a running shoe.

The upper, lower and/or intermediary midsole parts 1611, 1612, 1613 may comprise or be made of a polymer foam material. The midsole parts 1611, 1612, 1613 can comprise or be made of the same material, or they can comprise or be made of different materials. It is also possible that within a given midsole part, the material composition changes locally, i.e., that different materials are used in different regions, e.g., to locally influence the mechanical properties of the upper, lower and/or intermediary midsole part 1611, 1612, 1613. The polymer foam material can comprise a homogeneous foam material, like ethylene-vinyl-acetate (EVA) or injection-molded thermoplastic polyurethane (TPU), or thermoplastic polyester ether elastomer (TPEE), Polyamide, PEBA or other suitable materials. The polymer foam material can also comprise a particle foam. For example, particle foams made of or comprising particles of expanded thermoplastic polyurethane (eTPU), expanded polyamide (ePA), expanded polyether-block-amide (ePEBA) and/or expanded thermoplastic polyester ether elastomer (eTPEE) are particularly well suited for use in performance footwear, because they provide a high degree of cushioning and energy return back to the wearer. For example, particle foams of eTPU maintain their beneficial properties over a large temperature range (e.g., from −20° C. up to 40° C.). Particle foams including particles of expanded polylactide (ePLA), expanded polyethylene terephthalate (ePET), expanded thermoplastic olefin (eTPO) and/or expanded polybutylene terephthalate (ePBT) are also possible. To give one specific example, the lower midsole part 1612 may be made from a homogeneous EVA- or TPU- or TPEE-foam material, to provide good overall stability and wear resistance to the sole of the shoe 1600, while the upper midsole part 1611 and/or intermediary midsole part 1613 may be made from a particle foam comprising particles of eTPU, ePA, ePEBA and/or eTPEE, to provide good cushioning, high energy return, and a smoother transition which reduce eccentric forces and give a comfortable ride.

It is emphasized, however, that alternatively or in addition to using a foam material for the midsole 1610, other materials and manufacturing options may also be used. For example, the midsole 1610 or parts thereof may comprise or be comprised of a lattice structure, for example an additively manufactured lattice structure (e.g., a structure made using a 3D printing method or a laser sintering method or a stereo-lithography method), which, as already mentioned farther above, may be useful both for long distance running shoes, where a high cushioning is preferred, and for sprint spikes or lower distance running shoes where high cushioning is not a necessity, but high stiffness and anatomical guidance of the foot during ground contact is beneficial.

Moreover, it is also emphasized that the present disclosure also covers embodiments wherein the midsole 1610 does not comprise separate upper, lower and intermediary midsole parts, but only one unified midsole component. Or at least two of the upper, lower and intermediary midsole parts may be a unified midsole component, while the remaining midsole component is separate. Such a midsole may also comprise or be made of one or more of the above-mentioned homogeneous foam materials and/or particle foams and/or non-foamed materials like a lattice structure as mentioned above, for example.

It will be appreciated that in what has been said so far about the sole 1605 of the shoe 1600, this sole 1605 is very similar to, for example, the sole 100 shown in FIGS. 1*a-f* or the sole 200 shown in FIG. 2. Everything that has been discussed, for example, about the reinforcing structures 120 and 220 therefore also applies to the reinforcing structure 1620 with reinforcing members 1621, 1622, 1623, 1624, 1625 discussed here, and vice versa, unless physically or technically impossible, of course.

More generally, all of what has been said about specific members, elements and components in the context of the embodiments of present disclosure that have already been discussed above also applies to the corresponding members, elements and components (if present) of the shoe 1600 discussed here, and also to the corresponding members, elements and components (if present) of the further shoes and shoe soles that will still be discussed below in relation to FIGS. 17-24 (unless physically or technically ruled out, of course). To avoid redundancies, not all of these option will therefore be discussed again, but reference is made to corresponding statements above.

In addition to the reinforcing members 1621-1625, the sole 1605 also comprises at least two blade members also extending in the front half of the sole 1605, in the present case three blade members 1671, 1672 and 1673, collectively referred to by the reference numeral 1670 in FIGS. 16*a-e*. In some embodiments, the blade members 1671, 1672 and 1673 do not extend into the back half of the sole but their extension is restricted to the region from the toe area to the area of the arch of the foot, but in some embodiments this may be different and the blade members (or one or two of them) may also extend beyond the arch region and into the back half of the foot. One or several or all of the blade members 1671, 1672 and 1673, for example the medial blade member 1671, may also protrude from the front of the sole 1605 and be visible from the outside. Moreover, the above-said can also apply to the reinforcing members 1621, 1622, 1623, 1624, 1625, which also extend, at least, in the front half of the sole 1605.

Similar to the grooves 215 for the reinforcing members 220 of the sole 200 shown in FIG. 2, the lower midsole part 1612 of the sole 1605 may comprise three grooves 1616 in which the three blade members 1671, 1672 and 1673 may rest. This may help to secure the blade members 1671, 1672 and 1673 in their position and thus help to avoid or limit the use of adhesives or glues, for example, and to generally facilitate assembly of the sole 1605. Similar grooves 1615 also exist for the reinforcing members 1621-1625, in the upper midsole part 1611, as shown in FIGS. 16*c* and 16*d*, for example.

The reinforcing members 1621, 1622, 1623, 1624, 1625 define a first layer 1608 within the sole 1605, and the blade members 1671-1673 define a second layer 1609 in the sole 1605. In FIG. 16*e*, these two layers 1608 and 1609 have been indicated. As the skilled person understands, the two layers 1608 and 1609 can be thought of as being spanned or defined by the reinforcing members 1621-1625 and blade members 1671, 1672, 1673, respectively, in much the same way the canopy of an umbrella is spanned by the foldable ribs of the umbrella. A different way to determine the two layers 1608 and 1609 would be to imagine that the reinforcing members 1621, 1622, 1623, 1624, 1625 and the blade members 1671, 1672, 1673 were glued or welded to a respective piece of textile material (or something similar, for example a mesh-like material or a foil), with any excess around the outermost members being cut off. It is also emphasized that such a construction may actually be used within the scope of the present disclosure, even though this is not shown here and this concept is only discussed as a conceptual aid.

In the sole 1605, the first layer 1608 and the second layer 1609 are displaced from one another in a vertical direction, wherein the first layer 1608 is arranged above the second layer 1609, and the two layers are fully distinct from one another (s. FIG. 16*e*), meaning there is no direct connection between the reinforcing members 1621, 1622, 1623, 1624, 1625 and the blade members 1671, 1672, 1673 in the case shown here. In some embodiments, this may be different, though.

In the gap defined between the first layer 1608 and the second layer 1609, the intermediary midsole part 1613 is arranged, such that the gap is filled with the (foam) material of the intermediary midsole part 1613. Suitable materials for this part and the other parts of the midsole have been discussed above.

Moreover, in a vertical projection of the sole 1605 (i.e., when viewed "from the top") the first layer 1608 and the second layer 1609 at least partially overlap (as opposed to the members being arranged in totally different regions of the sole, for example). In other words, the reinforcing members 1621, 1622, 1623, 1624, 1625 "are stacked on top" of the blade member 1671, 1672, 1673 within the sole 1605.

As can been seen, for example, in FIGS. 16*b* and 16*c*, the first layer 1608 and the second layer 1609 comprise respective sections, in the forefoot area and generally in the region underneath the metatarsal bones, with corresponding curvature. This has been indicated in FIG. 16*c* by the two lines 1608*a* and 1609*a*. Pictorially speaking, the two layers 1608 and 1609, and hence the reinforcing members 1621, 1622, 1623, 1624, 1625 and blade members 1671, 1672, 1673, have a geometry in this region that fits together like two "onion shells". This allows the foot to settle nicely and snugly into the supporting structure provided by the reinforcing- and blade members and allows for a natural roll-off movement of the foot.

The blade members 1671, 1672, 1673 of the sole 1605 have a flattened, oval cross-section, as can be seen particularly well in FIG. 16*c*. This can help to keep the stack height or thickness of the sloe 1605 down, despite two sets of structural members (i.e., the reinforcing members 1621, 1622, 1623, 1624, 1625 and the blade members 1671, 1672, 1673) being stacked on top of each other and being interspersed and displaced by the intermediary midsole part 1613 within the sole 1605.

As has already been discussed, for example, in detail with regard to the sole 100 of FIG. 1, a diameter of the reinforcing members can vary between some or all of the reinforcing members. This also applies, with all options and corresponding technical effects, to the reinforcing members 1621, 1622, 1623, 1624, 1625 of the sole 1605. Alternatively or in addition, a diameter of at least one of the reinforcing members 1621-1625 can also vary along said reinforcing member. Also in this regard, reference is made to the corresponding statements and explanations above.

Further, much the same also applies to the blade members 1671, 1672, 1673. In other words, a diameter of the blade members 1671, 1672, 1673 can vary between at least two of the blade members 1671, 1672, 1673, and alternatively or in addition, a diameter of at least one of the blade members 1671, 1672, 1673 can vary along said blade member. For example, each blade member 1671, 1672, 1673 can have a thicker center portion compared to its front and back tips, and the lateral blade member 1673 could have a smaller cross-section (for example, taken as the average value along the respective blade member, or taken at a specific position along the longitudinal axis of the sole 1605) than the medial blade member 1671, and hence be more flexible than the medial blade member 1671. The cross-section of one or more of the blade members 1671, 1672, 1673 could also become more rounded in certain sections or portions, to increase the bending stiffness of the respective member in that section or portion compared to an oval or even flatter blade member.

Possible materials for reinforcing members have already been discussed above in relation to some embodiments of the present disclosure, and these considerations also apply to the reinforcing members 1621, 1622, 1623, 1624, 1625. The blade members 1671, 1672, 1673 can comprise a reinforced polymer material, for example a reinforced polyamide (PA) material, in particular a glass-fiber reinforced-, or carbon-fiber reinforced-, or carbon infused polymer material.

In some embodiments, a sole with at least two reinforcing members and at least two blade members will now be discussed in relation to FIGS. 17 and 18*a-e*. Insofar as no explicit statements about specific members, elements and components of the following embodiments will be made, all of the options and possibilities that have already been discussed up to this point for corresponding members, elements and components of the previous embodiments may apply, even if not explicitly repeated and discussed again—unless, of course, this is physically or technically ruled out.

Figure 17:
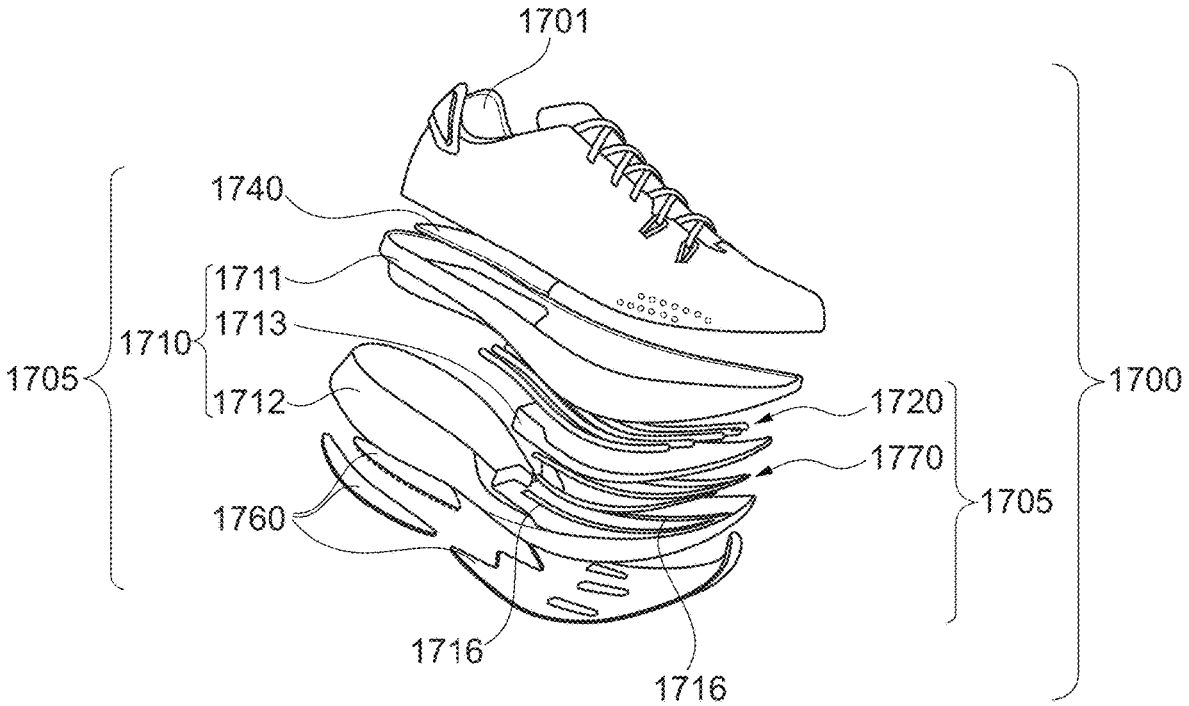
FIG. 17 illustrates a sole with five rod-/tube-shaped reinforcing members and three blade members according to some embodiments.

FIG. 17 shows a shoe 1700 with a sole 1705, which is very similar to the shoe 1600 discussed above. The shoe 1700 comprises an upper 1701, and the sole 1705 comprises a midsole 1710 with an upper midsole part 1711, a lower midsole part 1712 and an intermediary midsole part 1713.

Fully embedded within the midsole 1710 is a reinforcing structure 1720 comprising five rod-shaped and/or tube-shaped reinforcing members, each corresponding to a respective metatarsal bone. The sole 1705 of the shoe 1700 further comprises three blade members 1770 vertically displaced and arranged below the reinforcing members 1720. The lower midsole part 1712 comprises three grooves 1716 in which the three blade members 1770 sit, and the upper midsole part 1711 may comprise corresponding grooves (in its bottom surface, which is not visible in FIG. 17) for the reinforcing members 1720. The sole 1705 further comprises a load distribution member 1740 partially embedded within the top side of the upper midsole part 1711. The sole 1705 also comprises an outsole 1760, and it may further contain a sock-liner or insole (not shown here).

What is different compared to the sole 1605 of the shoe 1600 is that the three blade members 1770 of the sole 1705 of the shoe 1700 have a slightly smaller width (in medial-to-lateral direction) namely a width that is comparable to the diameter of the rod-/tube shaped reinforcing members 1720 in this case. In the sole 1605 of the shoe 1600, by contrast, the blade members 1671, 1672, 1673 have a width that is larger than the diameter of the rod-/tube-shaped reinforcing members 1621, 1622, 1623, 1624, 1625, at least in their central section away from their tips. This can result in the blade members 1770 having a slightly smaller deformation stiffness and a slightly larger flexibility, for example, than the blade members 1671, 1672, 1673.

FIGS. 18*a-e* show another sole 1800 (for the left foot, in the case shown here) with three blade members 1871, 1872 and 1873 (collectively referred to by the reference numeral 1870) and further details about the geometry of these blade members. The blade member 1871 is arranged on the medial side of the sole 1800, the blade member 1872 is a central member, and the blade member 1873 is arranged on the lateral side of the sole 1800, cf. FIG. 18*a*.

The sole 1800 comprises a midsole 1810 with an upper midsole part 1811, a lower midsole part 1812 and an intermediary midsole part 1813. Fully embedded within the midsole 1810 is a reinforcing structure comprising several reinforcing members, which are not visible in FIG. 18 and which will not be further discussed here, for conciseness. Reference is instead made to the corresponding options and possibilities discussed so far. The sole 1800 also comprises an outsole 1860, and the sole 1800 may further contain a sock-liner, a load distribution member, etc., as already discussed numerous times by now (all not shown here).

The three blade members 1871, 1872 and 1873 are arranged (in the assembled state of the sole 1800) in corresponding grooves 1816 in the lower midsole part 1811, similar to what has already been discussed with regard to the soles 1605 and 1705, for example.

FIGS. 18*b*-18*e* are included to provide a better understanding of the possible geometry of such blade members.

Figure 18A:
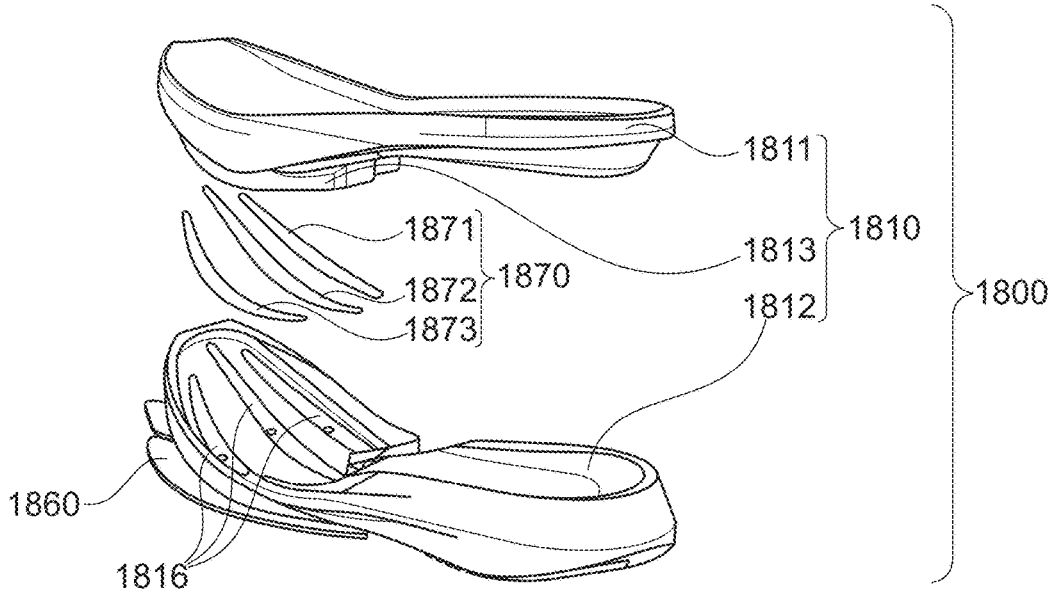
FIGS. 18*a-e* illustrate a sole with three blade members and details about the geometry of the blade members according to some embodiments.
Figure 18B:
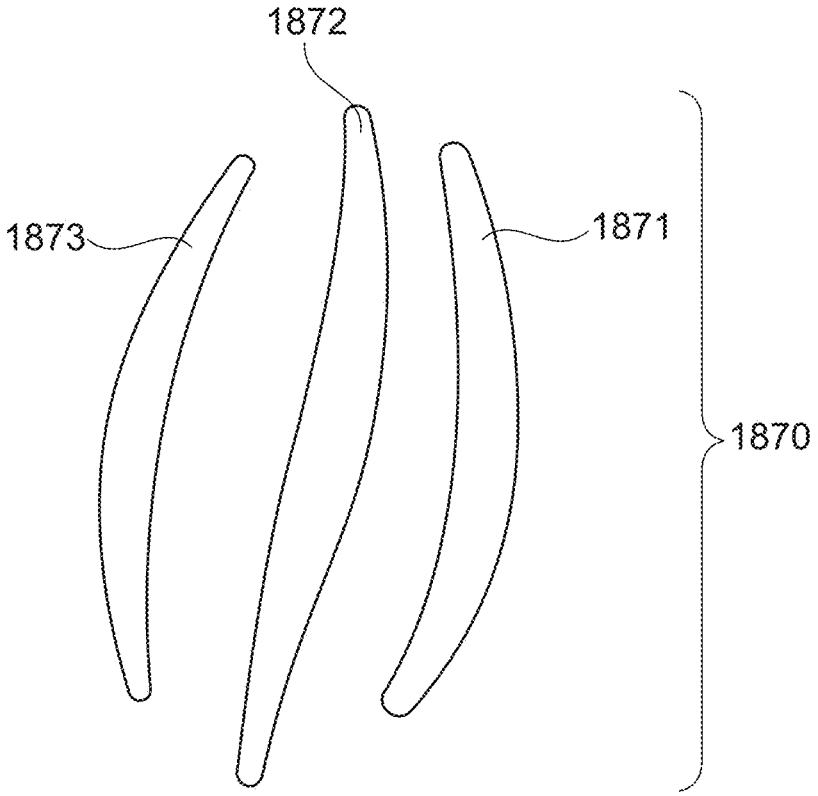

FIG. 18*b* shows the blade members 1871, 1872, 1873 in a top view (with reference to their arrangement within the assemble state of the sole 1800).

Figure 18C:
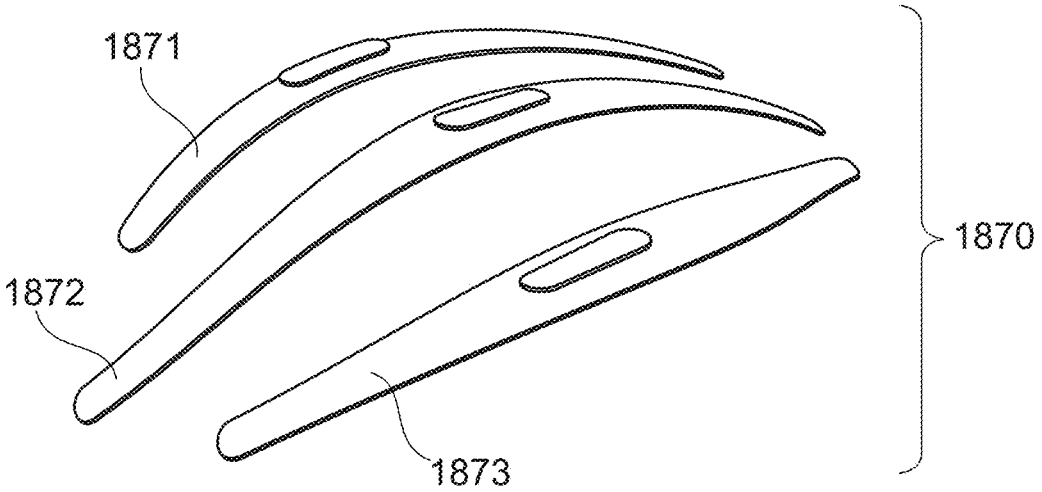

FIG. 18*c* shows a perspective lateral side view of the blade members 1871, 1872, 1873 in an upside-down configuration, i.e., as viewed in a lateral side view of the sole 1800 when looking at it with its bottom side turned upwards and in a direction from the heel towards the toes.

Figure 18D:
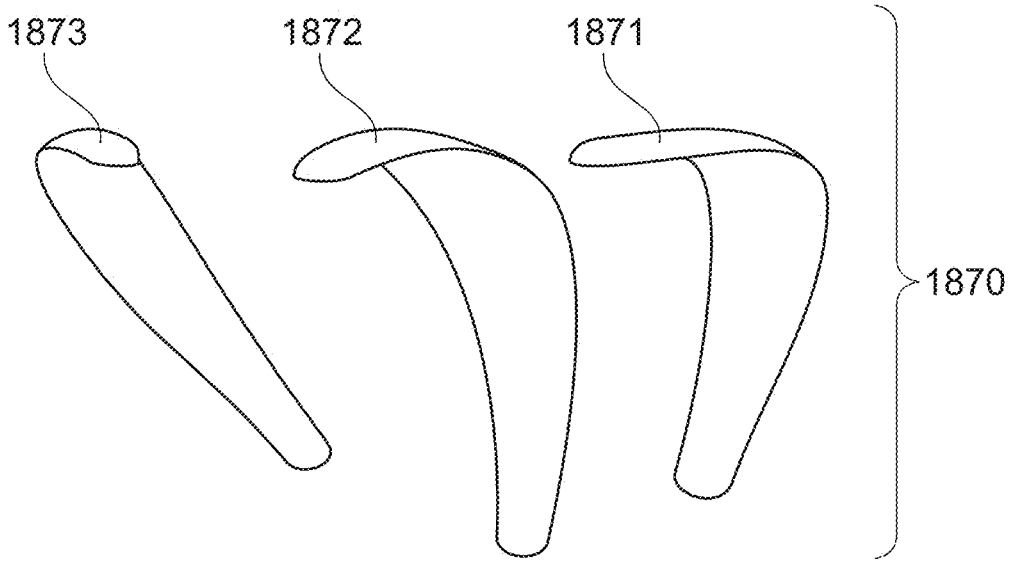

FIG. 18*d* shows the members from the front, again in an upside-down configuration, i.e., with the bottom side of the sole 1800 facing upwards in FIG. 18*d*.

Figure 18E:
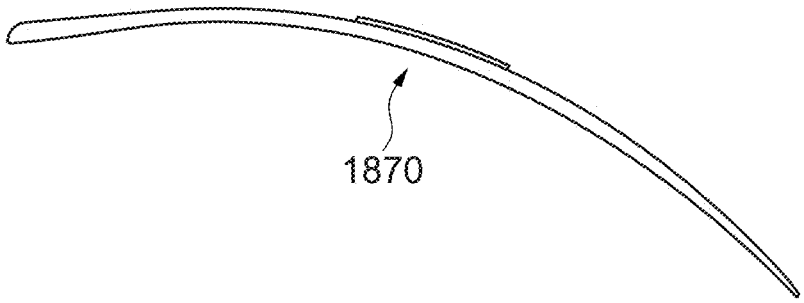

FIG. 18*e* shows a lateral side view (projection on the sagittal plane), also in an upside-down configuration.

As can be seen from these figures, the blade members 1871, 1872, 1873 both comprise non-linear sections or curvature in the top view (s. FIG. 18*b*) as well as in the front- and side view (s. FIGS. 18*c-e*), which allow the blade members to follow the natural anatomy and anatomical landmarks of the foot of a wearer.

Figure 21A:
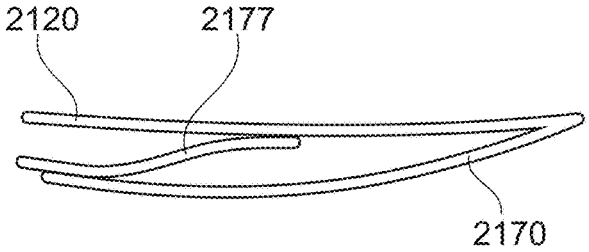
Figure 21B:
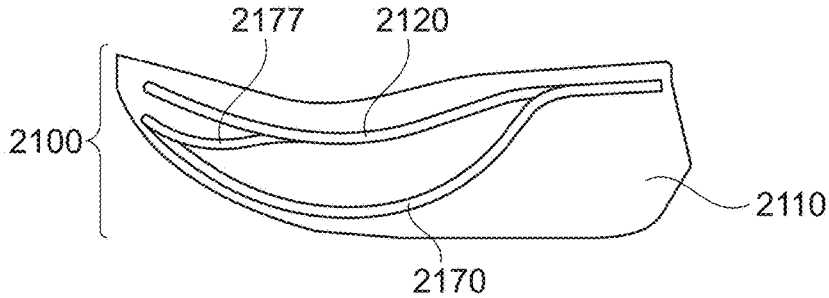
Figure 21C:
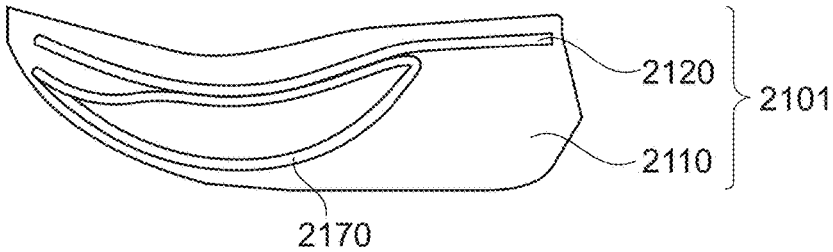
Figure 21D:
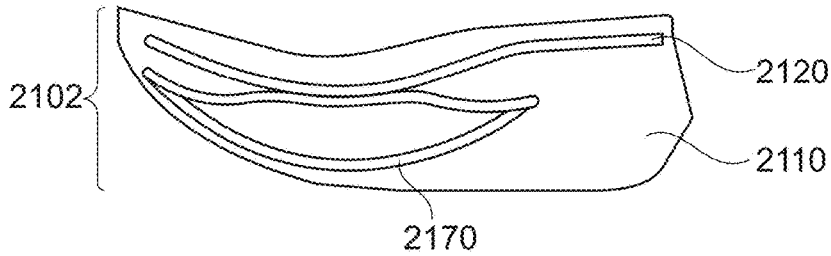
Figure 21E:
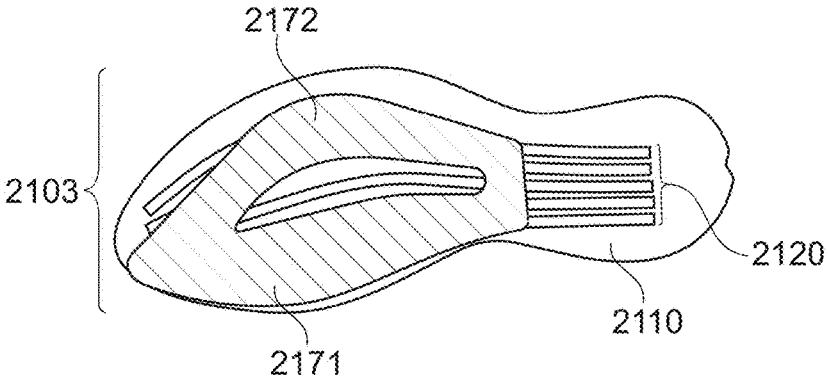
Figure 22:
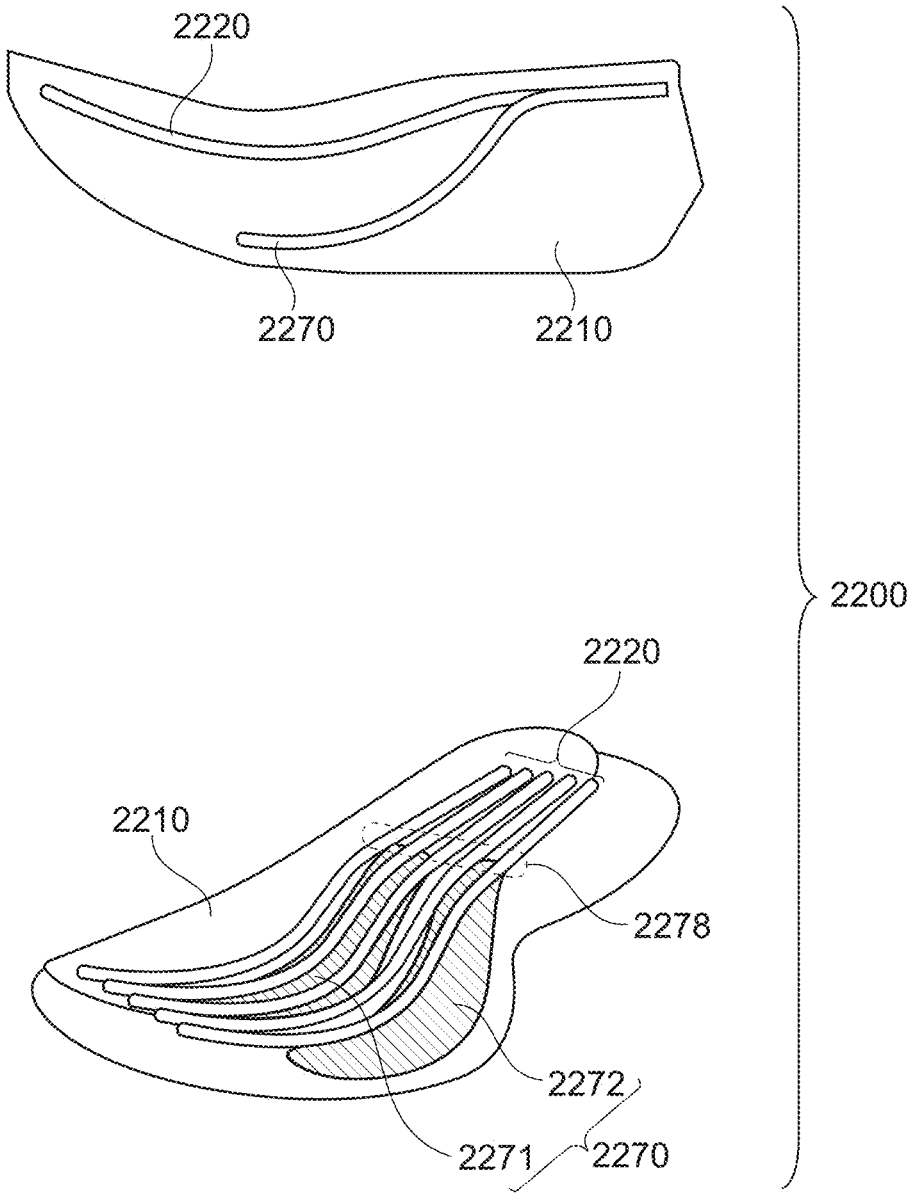
Figure 23:
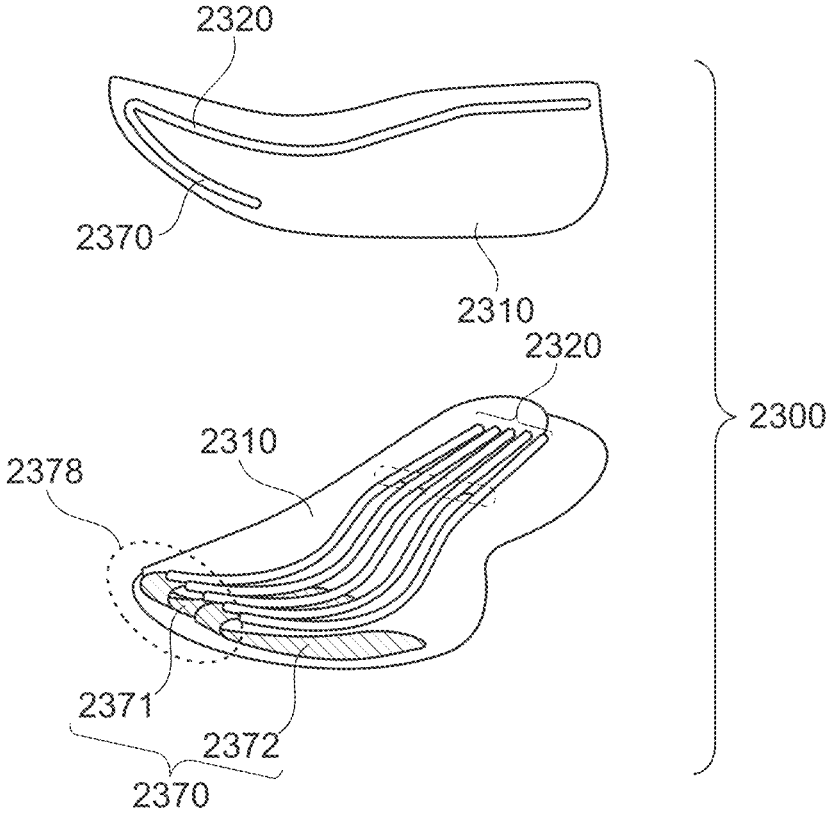
Figure 24:
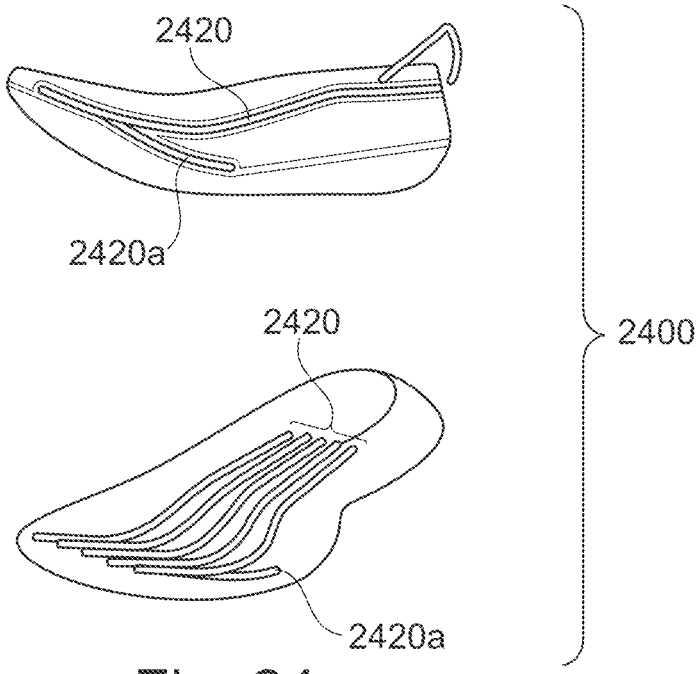
FIG. 24 illustrates possible modification of the sole of FIG. 23 according to some embodiments.

FIGS. 19-23 show additional shoe soles with reinforcing members and blade members according to some embodiments, and FIG. 24 shows a possible modification of the sole shown in FIG. 23. Again, insofar as no detailed statements about specific members, elements and components of the following embodiments will be made, all of the options and possibilities that have already been discussed up to this point for corresponding members, elements and components of the previous embodiments may apply, even if not explicitly repeated and discussed again—unless, of course, this is physically or technically ruled out.

Figure 19:
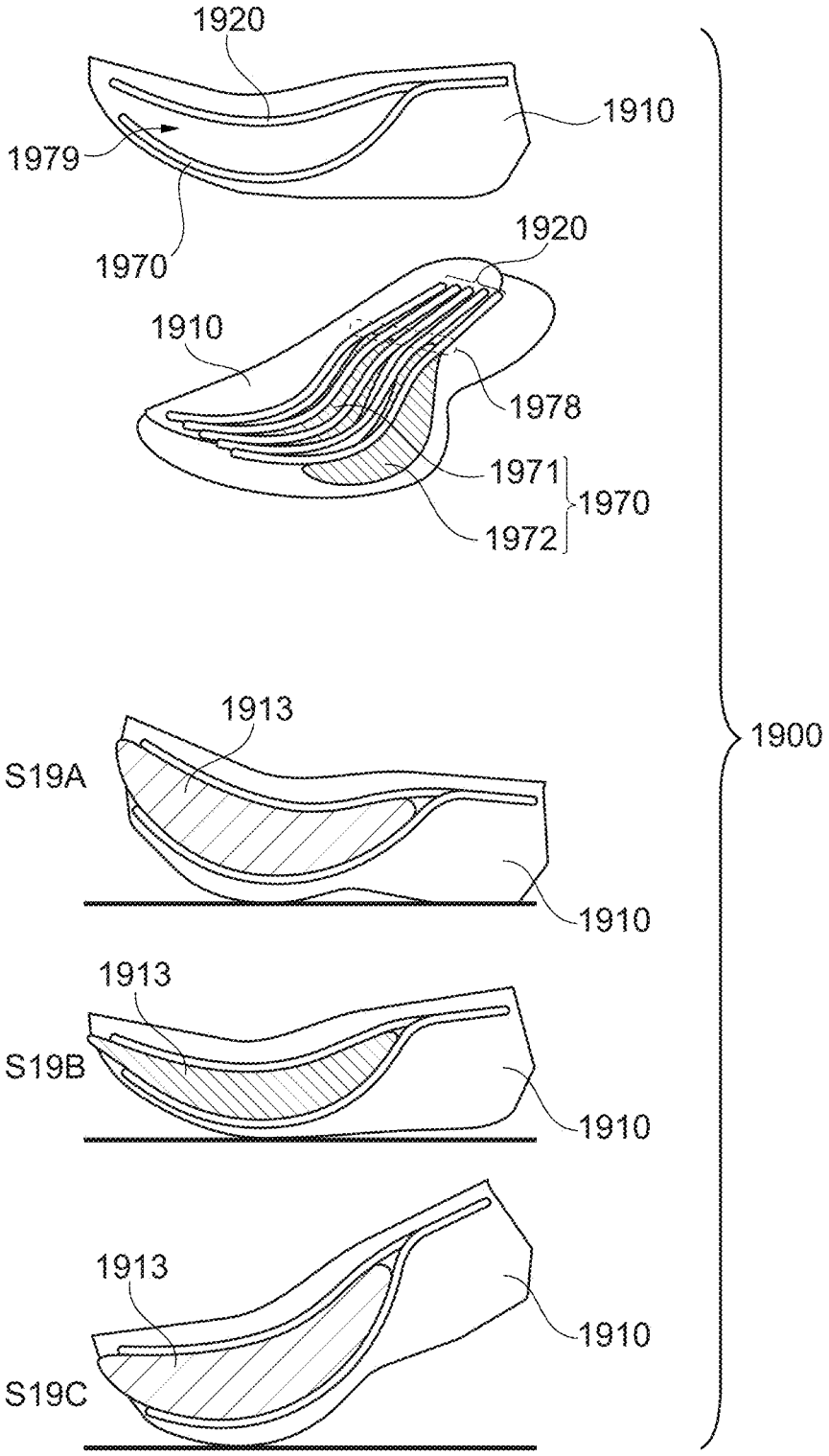
FIGS. 19-23 illustrate further soles with reinforcing members and blade members according to some embodiments.

FIG. 19 shows a sole 1900 for a shoe, for example, a sports shoe, with a midsole 1910 with five reinforcing members 1920 (one for each metatarsal bone) and two blade members 1970 embedded therein, namely a medial blade member 1971 and a lateral blade member 1972. The two blade members 1971 and 1972 are generally arranged beneath the reinforcing members 1920, such that the layer defined or spanned by the reinforcing members 1920 and the layer defined or spanned by the blade members 1970 are generally distinct and vertically displaced from one another.

But, in the sole 1900, the blade members 1971 and 1972 are connected to (some) of the reinforcing members 1920 in a region 1978 towards the back end of the sole 1900. In other words, the layers defined or spanned by the two sets of members 1920 and 1970 meet or merge in the region 1978. In the case shown here, the medial blade member 1971 is connected to outmost two reinforcing members on the medial side of the sole 1900 in the region 1978, and the lateral blade member 1972 is connected to outmost two reinforcing members on the lateral side of the sole 1900 in the region 1978. The connection may be created, for example, by means of a glue or adhesive, or by welding the elements together, or the elements may by integrally manufactured, such as by injection molding or 3D-printing methods, for example.

In the forefoot region of the sole 1900 and also extending partially into the back half of the sole 1900, there is hence a gap 1979 between the reinforcing members 1920 and the blade members 1970, and this gap 1979 may be filled by a foam material or intermediary midsole part 1913, as shown in the bottom half of FIG. 19. Such a construction may improve the forward propulsion of the sole during walking or running, as illustrated in the bottom half of FIG. 19 at steps S19A, S19B and S19C:

At step S19A, showing the sole in an uncompressed state at or just before landing and foot strike, the forefoot region of the sole 1900 still has its original stack height/thickness and the foam material 1913 is (largely) uncompressed and does not store a significant amount of elastic energy.

At step S19B, during the stance phase, the foam material 1913 gets "squeezed in" by the supporting structure created by the reinforcing members 1920 and the blade members 1970 arranged above and beneath the foam material 1913, respectively, leading to a decreases stack height/thickness of the sole 1900 in the forefoot region and the storage of elastic energy in the system.

At step S19C, upon lift-off and unloading, this elastic energy in the system gets (at least partially) released, helping forward propulsion of the wearer, and the original configuring of the sole 1900 is basically restored (generally, some small energy losses, for example, due to hysteresis in the involved materials, may occur).

Figure 20A:
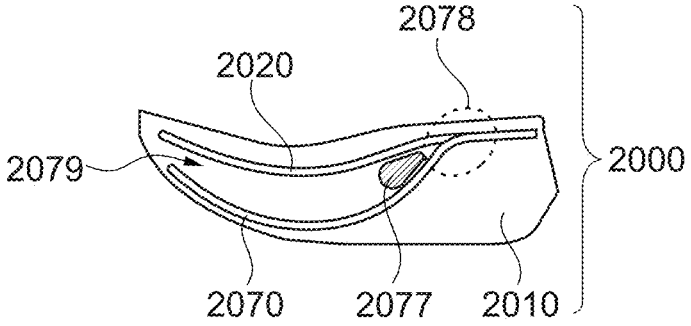

FIG. 20*a* shows a sole 2000 and possible modifications thereof with a midsole 2010 including reinforcing members 2020 (for example, five reinforcing members, each corresponding to a metatarsal bone, as shown in the sole 2004 in FIG. 20*a*) and blade members 2070 (for example, two blade members as discussed in relation to FIG. 19, or three blade members as discussed in relation to FIGS. 16 *a-e*, 17 and 18 *a-e*). The blade members 2070 are generally arranged beneath the reinforcing members 2020, such that the layer defined or spanned by the reinforcing members 2020 and the layer defined or spanned by the blade members 2070 are generally distinct and vertically displaced from one another, but in a region 2078 towards the back end of the sole 2000 the blade members 2070 are connected to (some) of the reinforcing members 2020, hence the layers defined by the two sets of members 2020, 2070 meet or merge in this region.

In the forefoot region of the sole 2000 and also extending partially into the back half of the sole 2000, there is again a gap 2079 between the reinforcing members 2020 and the blade members 2070, similar to the sole 1900 discussed above with relation to FIG. 19. Here, however, a spring member 2077 is arranged in the gap 2079, instead of the gap being filled by a foam material as above. It is emphasized, however, that also in the sole 2000 and the modifications thereof discussed below, the gap 2079 may further contain a foam material, in addition to the spring member 2077.

In the sole 2000, the spring member 2077 is provided as a bounceball-type element (e.g., a rubber ball) arranged at or close to the hinge point where the reinforcing members 2020 and blade members 2070 meet and are connected to one another.

Figure 20B:
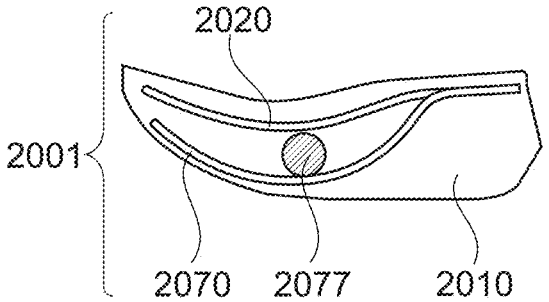

In the modification shown below, i.e. in the sole 2001 shown in FIG. 20*b*, the spring member 2077 is provided as a springy tube (e.g., a rubber tube) at the rocker loading point, i.e. towards the front end of the arch region of the foot. The spring member 2077 of the sole 2001 may thus potentially allow, for example, to store energy during the transition phase (>50 ms), wherein the storage of energy through the spring element 2077 may come from the collapsing load of the plantar arch during the middle of the stance phase. It may also allow to transfer energy towards the last point of contact during push-off, and/or to return energy during the push-off when the spring element 2077 gets unloaded at the end of the stance phase.

Figure 20C:
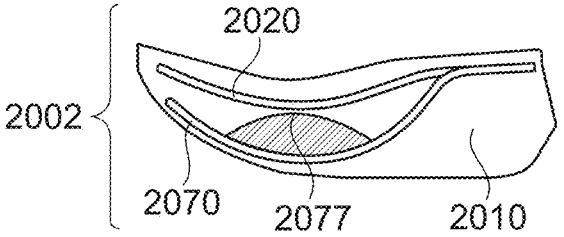

In the modification shown below that, i.e. in the sole 2002 shown in FIG. 20*c*, the spring member 2077 is provided by a (biased) spring steel insert.

In each of the soles 2000, 2001, 2002, there may be, for example, one such spring member 2077 in total, or one spring member 2077 per blade member, or one spring member 2077 per reinforcing member, and so forth. The precise number of spring members 2077 can be determined according to the desired degree of "springiness" of the sole, for example.

Figure 20D:
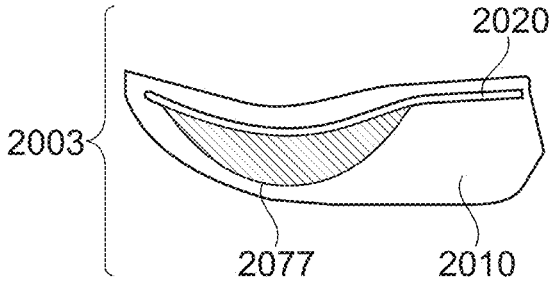
Figure 20E:
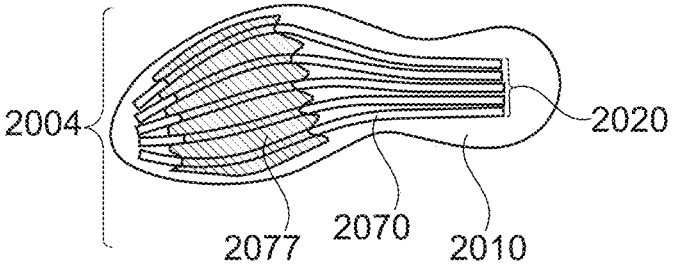

In the bottom two modifications shown in FIGS. 20*d* and 20*e*, i.e., in the soles 2003 and 2004, respectively, the blade members 2070 themselves act as spring-like members, namely as spring steel members connected at their front and rear end to at least one reinforcing member in the sole 2003, and as a kind of interlocking finger elements in the sole 2004. This reduces the number of individual components in the sole and may hence reduce weight and manufacturing complexity and expenses, for example.

FIGS. 21*b*-21*e* show soles and possible modifications thereof with a midsole 2110 with a springboard-type supporting structure formed by a set of reinforcing members 2120 shown in FIG. 21*a* (for example, five reinforcing members, each corresponding to a metatarsal bone, as shown in the sole 2103, shown in FIG. 21*e*) and a set of blade members 2170 (for example, two blade members as also shown in the sole 2103, shown in FIG. 21*e*, or three blade members as discussed above) with the blade members 2170 again being generally arranged beneath the reinforcing members 2120 (shown in FIGS. 21*b*-21*d*)

In the version of the springboard structure 2120 included in the sole 2100 shown in FIG. 21*b*, a slight modification of which is shown in isolation (i.e., without a surrounding midsole 2110) in FIG. 21*a*, there is a spring member (or several spring members) 2177 arranged between the front tip portion of one or more of the blade members 2170 and the front or middle portion of one or more of the reinforcing members. This spring member 2177 or the spring members may be connected to the blade member(s) and/or reinforcing member(s), or it may be held in position by the surrounding material of the midsole 2110, for example, without being attached to these members.

In the versions of the springboard structures included in the soles 2101 and 2102 (shown in FIGS. 21*c* and 21*d*, respectively), however, there is no additional spring member but the blade members 2170 themselves provide the springboard structure by forming the "loop" that can be seen in the side view of these two soles that are depicted in in FIGS. 21*c* and 21*d*.

In some embodiments, as shown in the sole 2103 in FIG. 21*e*, which may, for example, be a bottom view of the sole 2101 or the sole 2102, there can be two blade members 2170, namely a medial blade member 2171 and a lateral blade member 2172 that form the "loop" of the sole 2101 or 2102, and that are arranged beneath the five reinforcing members 2120 of the sole 2103. The medial and lateral blade members 2171 and 2172 are further connected at the front and back ends, to increase the overall stability of this springboard construction.

Such a connection between two or more of the blade members and a design of the blade members as a segmented plate is possible also for all the other embodiment discussed herein, if not explicitly stated otherwise or physically or technically ruled out.

FIG. 22 shows a sole 2200, which is a modification of the sole 1900 shown in FIG. 19. There are again five reinforcing members 2220, each corresponding to a metatarsal bone, and two blade members 2271 and 2272 (collectively referred to by the reference numeral 2270), which are connected to the outmost two medial and lateral reinforcing members, respectively, in the region 2278 in the back half of the sole 2200.

The main difference is that the medial and lateral blade members 2271 and 2272 of the sole 2200 only extend up towards the middle of the front half of the sole, while the blade members 1971 and 1972 extend almost the entire way up towards the tip of the sole 1900 (cf., e.g., the top picture in FIG. 19 and the top picture in FIG. 22). This may make the tip of the sole 2200 softer and more flexible than the tip of the sole 1900, for example, and it may also help to reduce the stack height/thickness of the tip of the sole 2200 compared to the sole 1900.

FIG. 23 shows a possible variation of the sole 2200 in the form of a sole 2300, wherein the medial and lateral blade members 2371 and 2372 (collectively referred to by the reference numeral 2370) are now connected to the outmost two medial and lateral reinforcing members 2320 not in the back half of the sole 2300, but at the tip of the sole 2300 and of the reinforcing members 2320, i.e. in the region 2378.

Finally, FIG. 24 shows yet another possible variation of the sole 2300, namely sole 2400, wherein the blade members are replaced by five "spring-arm" rods 2420*a* extending in a downward- and backward direction from the tip of each one of the five reinforcing members 2420. As shown in the top picture of FIG. 24, there may also be one or more reinforcing members (e.g. the outmost lateral and/or medial one), that extend rearwardly beyond the midfoot area and into a heel area of the sole and wrap up to a posterior portion of the ankle region, as discussed, for example, in detail in the context of FIGS. 12*a-i*, 13 and 14, to which discussion reference is therefore made in this regard.

The following examples are described to facilitate the understanding of the disclosure:

Aspect 1 of the description—A sole for a shoe, such as a running shoe, includes at least two reinforcing members extending in a front half of the sole, wherein the reinforcing members are adapted to be independently deflected by forces acting on the sole during a gait cycle.

Aspect 2 of the description—The sole according to aspect 1, wherein each of the reinforcing members comprises a non-linear section.

Aspect 3 of the description—The sole according to aspect 2, wherein each of the reinforcing members comprises a section having a concave shape in a side view of the sole.

Aspect 4 of the description—The sole according to one of aspects 2-3, wherein each of the reinforcing members has a shape comprising a localized low point relative to a horizontal plane, and wherein each of said low points is located in the front half of the sole.

Aspect 5 of the description—The sole according to aspect 4, wherein each of said low points is located in a region between a midfoot area and a toe area of the sole.

Aspect 6 of the description—The sole according to aspect 5, wherein each of said low points is located in a region of the metatarsophalangeal joints, MTP joints.

Aspect 7 of the description—The sole according to one of aspects 4-6, wherein each of said low points is located at a distance of at least 5 mm beneath a plane that is tangential to an upper side of a structure formed by the reinforcing members. In some embodiments, each of said low points is located at a distance of at least 8 mm beneath a plane that is tangential to an upper side of a structure formed by the reinforcing members.

Aspect 8 of the description—The sole according to aspect 7, wherein the distance between the tangential plane and each of said low points depends on the position of the respective low point relative to a lateral or a medial edge of the sole.

Aspect 9 of the description—The sole according to one of aspects 2-8, wherein the section of each reinforcing member with the non-linear shape extends at least from the midfoot area to the toe area of the sole.

Aspect 10 of the description—The sole according to one of aspects 1-9, wherein the reinforcing members extend rearwardly beyond the midfoot area and into a heel area of the sole.

Aspect 11 of the description—The sole according to one of aspects 1-10, wherein the reinforcing members are plate-like members.

Aspect 12 of the description—The sole according to one of aspects 1-10, wherein the reinforcing members are rod-shaped and/or tube-shaped members.

Aspect 13 of the description—The sole according to aspect 11 or 12, wherein the reinforcing members comprise solid sections.

Aspect 14 of the description—The sole according to one of aspects 11-13, wherein the reinforcing members comprise hollow sections.

Aspect 15 of the description—The sole according to one of aspects 11-14, wherein a diameter of the reinforcing members varies between at least two of the reinforcing members and/or wherein a diameter of at least one of the reinforcing members varies along said reinforcing member.

Aspect 16 of the description—The sole according to one of aspects 11-15, wherein there are five reinforcing members, each corresponding to a respective metatarsal bone.

Aspect 17 of the description—The sole according to aspect 16, wherein the reinforcing members corresponding to the first and the third metatarsal bone have a higher deflection stiffness than the three remaining reinforcing members.

Aspect 18 of the description—The sole according to one of aspects 16-17, wherein the reinforcing members corresponding to the first and the third metatarsal bone have a larger diameter than the three remaining reinforcing members.

Aspect 19 of the description—The sole according to one of aspects 1-18, wherein the reinforcing members comprise one or more of the following materials: carbon fibers, a carbon fiber composite material, a glass fiber composite material.

Aspect 20 of the description—The sole according to one of aspects 1-19, wherein at least two of the reinforcing members are connected by a connecting member.

Aspect 21 of the description—The sole according to one of aspects 1-20, wherein the reinforcing members extend substantially along a longitudinal direction of the sole.

Aspect 22 of the description—The sole according to one of aspects 1-21, wherein the reinforcing members are arranged next to each other in a medial-to-lateral direction.

Aspect 23 of the description—The sole according to aspect 22, wherein the reinforcing members are connected to a mesh-like material.

Aspect 24 of the description—The sole according to one of aspects 1-23, further comprising a load distribution member arranged in a back half of the sole. In some embodiments, the load distribution member may be arranged in the heel area of the sole.

Aspect 25 of the description—The sole according to aspect 24, wherein the load distribution member comprises a load distribution plate.

Aspect 26 of the description—The sole according to one of aspects 24-25, wherein the load distribution member comprises one or more of the following materials: carbon fibers, a carbon fiber composite material, a glass fiber composite material.

Aspect 27 of the description—The sole according to one of aspects 24-26, wherein the load distribution member extends into the midfoot area of the sole.

Aspect 28 of the description—The sole according to one of aspects 24-27, wherein the reinforcing members and the load distribution member at least partially overlap.

Aspect 29 of the description—The sole according to one of aspects 24-28, wherein the reinforcing members and the load distribution member are independent elements.

Aspect 30 of the description—The sole according to one of aspects 1-29, wherein the reinforcing members are at least partially embedded within a midsole of the sole, wherein the midsole comprises a polymer foam material.

Aspect 31 of the description—The sole according to aspect 30, wherein the reinforcing members are completely embedded within the midsole.

Aspect 32 of the description—The sole according to one of aspects 30-31, wherein the midsole comprises a particle foam, such as a particle foam comprising particles of expanded thermoplastic polyurethane, eTPU, particles of expanded polyamide, ePA, particles of expanded polyether-block-amide, ePEBA, and/or particles of expanded thermoplastic polyester ether elastomer, eTPEE.

Aspect 33 of the description—The sole according to one of aspects 30-32, wherein the midsole comprises a homogeneous foam material.

Aspect 34 of the description—The sole according to one of aspects 30-33, wherein the midsole comprises a lower midsole part and an upper midsole part, and wherein the reinforcing members are positioned between the lower midsole part and the upper midsole part.

Aspect 35 of the description—The sole according to aspect 34 in combination with one of aspects 24-29, wherein the reinforcing members and the load distribution member are separated by the upper midsole part.

Aspect 36 of the description—The sole according to aspect 35, wherein the load distribution member is at least partially embedded within the upper midsole part.

Aspect 37 of the description—The sole according to one of aspects 1-36, further comprising a sock-liner.

Aspect 38 of the description—The sole according to aspect 37 in combination with one of aspects 35-36, wherein the sock-liner is arranged on top of the upper midsole part and at least partially covers the load distribution member.

Aspect 39 of the description—The sole according to one of aspects 1-38, further comprising an outsole.

Aspect 40 of the description—The sole, such as running shoe, comprising a sole according to one of the preceding aspects 1-39.

Aspect 41 of the description—The sole for a shoe, such as a running shoe, including at least two reinforcing members extending in a front half of the sole, wherein at least a first one of the reinforcing members further extends rearwardly beyond the midfoot area and into a heel area of the sole and wraps up to a posterior portion of the ankle region.

Aspect 42 of the description—The sole according to aspect 41, wherein also a second one of the reinforcing members further extends rearwardly beyond the midfoot area and into the heel area of the sole and wraps up to the posterior portion of the ankle region.

Aspect 43 of the description—The sole according to aspect 41 or 42, wherein the reinforcing members are adapted to be independently deflected by forces acting on the sole during a gait cycle, such as in the front half of the sole.

Aspect 44 of the description—The sole according to one of aspects 42-43, wherein the first reinforcing member is a medial reinforcing member and the second reinforcing member is a lateral reinforcing member.

Aspect 45 of the description—The sole according to one of aspects 42-44, wherein the first reinforcing member and the second reinforcing member are joined behind the heel.

Aspect 46 of the description—The sole according to one of aspects 41-45, wherein the first reinforcing member further comprises a flattened tip extending into a region underneath the first metatarsophalangeal head.

Aspect 47 of the description—The sole according to one of aspects 41-46, wherein the reinforcing members are rod-shaped and/or tube-shaped members.

Aspect 48 of the description—The sole according to one of aspects 41-47, wherein a diameter of the reinforcing members varies between at least two of the reinforcing members and/or wherein a diameter of at least one of the reinforcing members varies along said reinforcing member.

Aspect 49 of the description—The sole according to one of aspects 41-48, wherein some or all of the reinforcing members comprise hollow sections and wherein a wall thickness of the hollow sections varies between at least two of the reinforcing members and/or along at least one of the reinforcing members.

Aspect 50 of the description—The sole according to one of aspects 41-49, wherein there are five reinforcing members, each corresponding to a respective metatarsal bone, and wherein the first reinforcing member corresponds to the first metatarsal bone.

Aspect 51 of the description—The sole according to aspect 50, wherein the reinforcing members corresponding to the first and the third metatarsal bone have a higher deflection stiffness than the three remaining reinforcing members.

Aspect 52 of the description—The sole according to one of aspects 50-51, wherein the reinforcing members corresponding to the first and the third metatarsal bone have a larger diameter and/or larger wall thickness than the three remaining reinforcing members.

Aspect 53 of the description—The sole, such as running shoe, comprising a sole according to one of the preceding aspect 41-52.

Aspect 54 of the description—A method for the manufacture of a reinforcing structure or part of a reinforcing structure for a shoe sole with at least one reinforcing member with a hollow section, the method includes the steps of injecting a liquid molding material into a molding cavity of a mold, the molding cavity having a shape corresponding to the outer dimensions of the reinforcing member with the hollow section; injecting a displacement gas into the molding cavity under pressure, wherein during steps a. and b. an exit path connecting the molding cavity to an outlet well is closed; and opening the exit path to release the pressurized displacement gas and remove the liquid molding material from the center of the molding cavity to form the hollow section.

Aspect 55 of the description—The method according to aspect 54, wherein the method is used in the manufacture of a sole according to one of aspects 41-52, or of a shoe according to aspect 53.

What is claimed is:

1. A sole for a shoe, comprising:

at least two reinforcing members extending at least in a front half of the sole; and at least two blade members extending at least in the front half of the sole, wherein the reinforcing members define a first layer within the sole and the blade members define a second layer in the sole, and wherein the first layer and the second layer are at least partially displaced from one another in a vertical direction by an intermediary midsole part that is located in the front half of the sole and is located between the first layer and the second layer.

2. The sole of claim 1, wherein the first layer is at least partially arranged above the second layer.

3. The sole of claim 1, wherein the first layer is fully distinct from the second layer.

4. The sole of claim 1, wherein the first layer and the second layer at least partially overlap in a vertical projection of the sole.

5. The sole of claim 1, wherein the first layer and the second layer comprise sections with corresponding curvature.

6. The sole of claim 1, wherein the reinforcing members are rod-shaped or tube-shaped members.

7. The sole of claim 6, wherein the blade members comprise a flattened shape as compared to a shape of the reinforcing members.

8. The sole of claim 1, wherein the at least two reinforcing members comprise five reinforcing members, and each of the five reinforcing members correspond to a respective metatarsal bone.

9. The sole of claim 1, wherein a first reinforcing member of the at least two reinforcing members has a first diameter, and a second reinforcing member of the at least two reinforcing members has a second diameter different from the first diameter.

10. The sole of claim 1, wherein a first blade member of the at least two blade members has a first diameter, and a second blade member of the at least two blade members has a second diameter different from the first diameter.

11. The sole of claim 1, wherein a diameter of at least one of the reinforcing members or at least one of the blade members varies along said reinforcing member or blade member.

12. The sole of claim 1, wherein there is a connection between at least one blade member and one reinforcing member.

13. The sole of claim 12, wherein each blade member is connected to at least one reinforcing member.

14. The sole of claim 1, wherein the blade members are connected among each other.

15. The sole of claim 14, wherein the blade members are provided as a segmented plate.

16. The sole of claim 1, wherein a spring member is arranged in a gap defined between the first layer and the second layer.

17. The sole of claim 1, wherein the intermediary midsole part comprises a foam material arranged in a gap defined between the first layer and the second layer.

18. The sole of claim 1, wherein the blade members comprise a reinforced polymer material.

19. The sole of claim 18, wherein the reinforced polymer material is one of a glass fiber reinforced material, a carbon fiber reinforced material, or a carbon infused polymer material.

20. A shoe, comprising the sole of claim 1.

21. The sole of claim 1, comprising an upper midsole part, the upper midsole part comprising grooves, wherein the reinforcing members are located between the intermediary midsole part and the upper midsole part and fit at least partially within the grooves.

* * * * *